United States Patent [19]

Umeda

[11] Patent Number: 4,693,590

[45] Date of Patent: Sep. 15, 1987

[54] ELECTRONIC COPIER WITH AUTOMATIC DOCUMENT FEEDER AND SORTER

[75] Inventor: Shin Umeda, Tokyo, Japan

[73] Assignee: Ricoh Company, Ltd., Tokyo, Japan

[21] Appl. No.: 765,821

[22] Filed: Aug. 15, 1985

[30] Foreign Application Priority Data

| | | | |
|---|---|---|---|
| Aug. 20, 1984 | [JP] | Japan | 59-172615 |
| Aug. 31, 1984 | [JP] | Japan | 59-182317 |
| Sep. 1, 1984 | [JP] | Japan | 59-183516 |
| Sep. 1, 1984 | [JP] | Japan | 59-183518 |
| Sep. 2, 1984 | [JP] | Japan | 59-183158 |
| Sep. 2, 1984 | [JP] | Japan | 59-183161 |
| Sep. 3, 1984 | [JP] | Japan | 59-185214 |

[51] Int. Cl.[4] ..... G03G 15/00

[52] U.S. Cl. ..... 355/14 SH; 355/3 SH; 355/14 R; 355/3 R

[58] Field of Search ..... 355/14 SH, 14 R, 3 R, 355/3 SH, 6

[56] References Cited

U.S. PATENT DOCUMENTS 4,248,528 2/1981 Sahay ..... 355/6 X 4,305,652 12/1981 Dattilo et al. ..... 355/6

*Primary Examiner*—A. C. Prescott

*Attorney, Agent, or Firm*—Oblon, Fisher, Spivak, McClelland & Maier

[57] ABSTRACT

An electronic copier having an automatic document feeder and a sorter and selectively operable in a multi-job mode for continuously copying a plurality of groups of documents which differ in copying condition from each other. Single display means displays any desired job data. In response to a copy start signal, single display means displays job data associated with one group of documents which are to be copied.

11 Claims, 64 Drawing Figures

| FIG.8A | FIG.8B |
|---|---|

| |
|---|
| FIG. 10A |
| FIG. 10B |

| |
|---|
| FIG. 13A |
| FIG. 13B |

| FIG. 14A |
| --- |
| FIG. 14B |

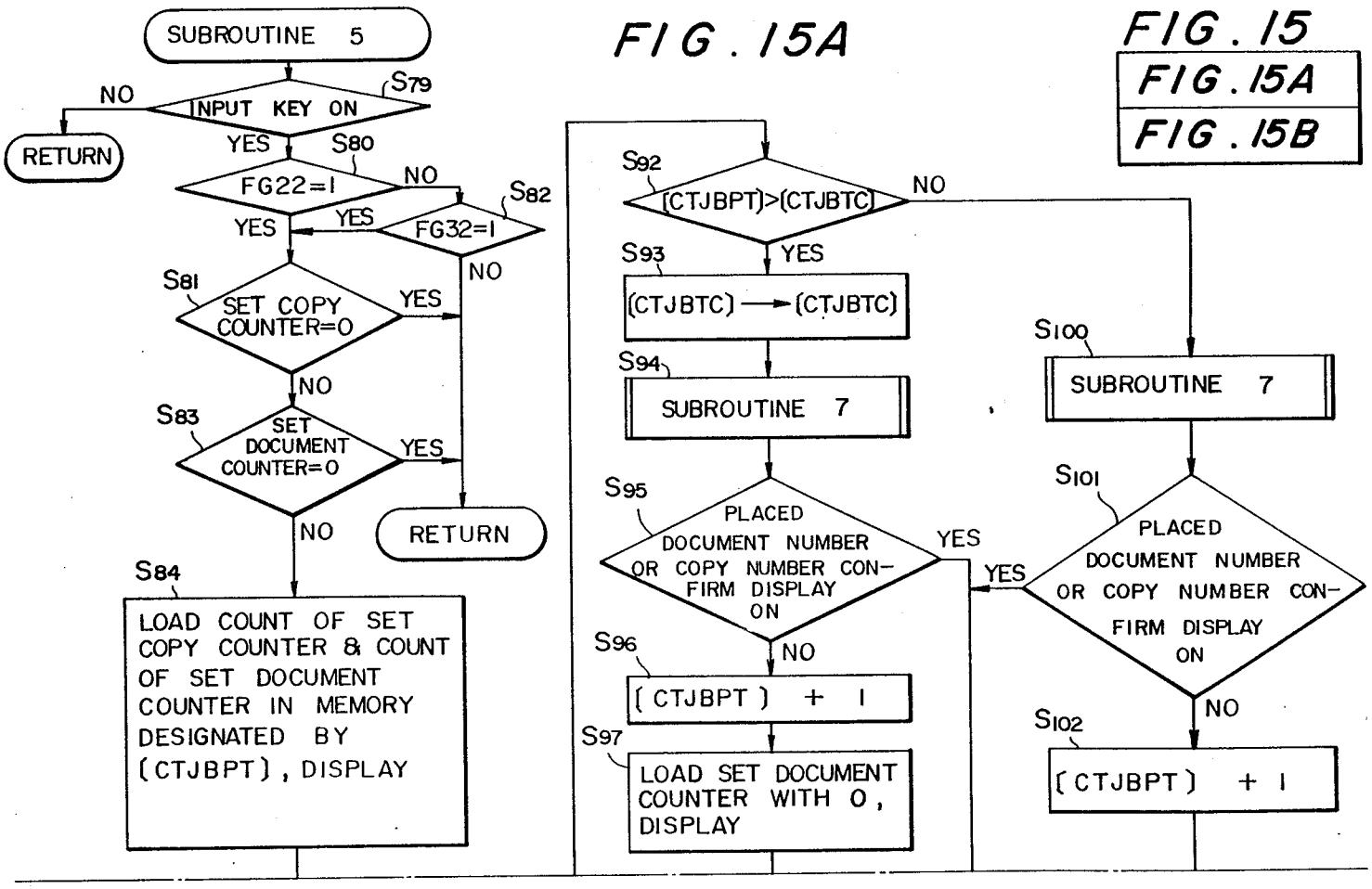
FIG. 15
FIG. 15A
FIG. 15B
FIG. 15A
SUBROUTINE 5
S79
INPUT KEY ON
YES
NO
RETURN
S80
FG22=1
YES
NO
S82
FG32=1
YES
NO
S81
SET COPY COUNTER=0
YES
NO
S83
SET DOCUMENT COUNTER=0
YES
NO
RETURN
S84
LOAD COUNT OF SET COPY COUNTER & COUNT OF SET DOCUMENT COUNTER IN MEMORY DESIGNATED BY (CTJBPT), DISPLAY
S92
(CTJBPT)>(CTJBTC)
YES
NO
S93
(CTJBTC) → (CTJBTC)
S94
SUBROUTINE 7
S95
PLACED DOCUMENT NUMBER OR COPY NUMBER CONFIRM DISPLAY ON
YES
NO
S96
(CTJBPT) + 1
S97
LOAD SET DOCUMENT COUNTER WITH 0, DISPLAY
S100
SUBROUTINE 7
S101
PLACED DOCUMENT NUMBER OR COPY NUMBER CONFIRM DISPLAY ON
YES
NO
S102
(CTJBPT) + 1

| FIG. 16A |
| --- |
| FIG. 16B |

| FIG. 17A |
| --- |
| FIG. 17B |

| |
|---|
| FIG. 19A |
| FIG. 19B |
| FIG. 19C |

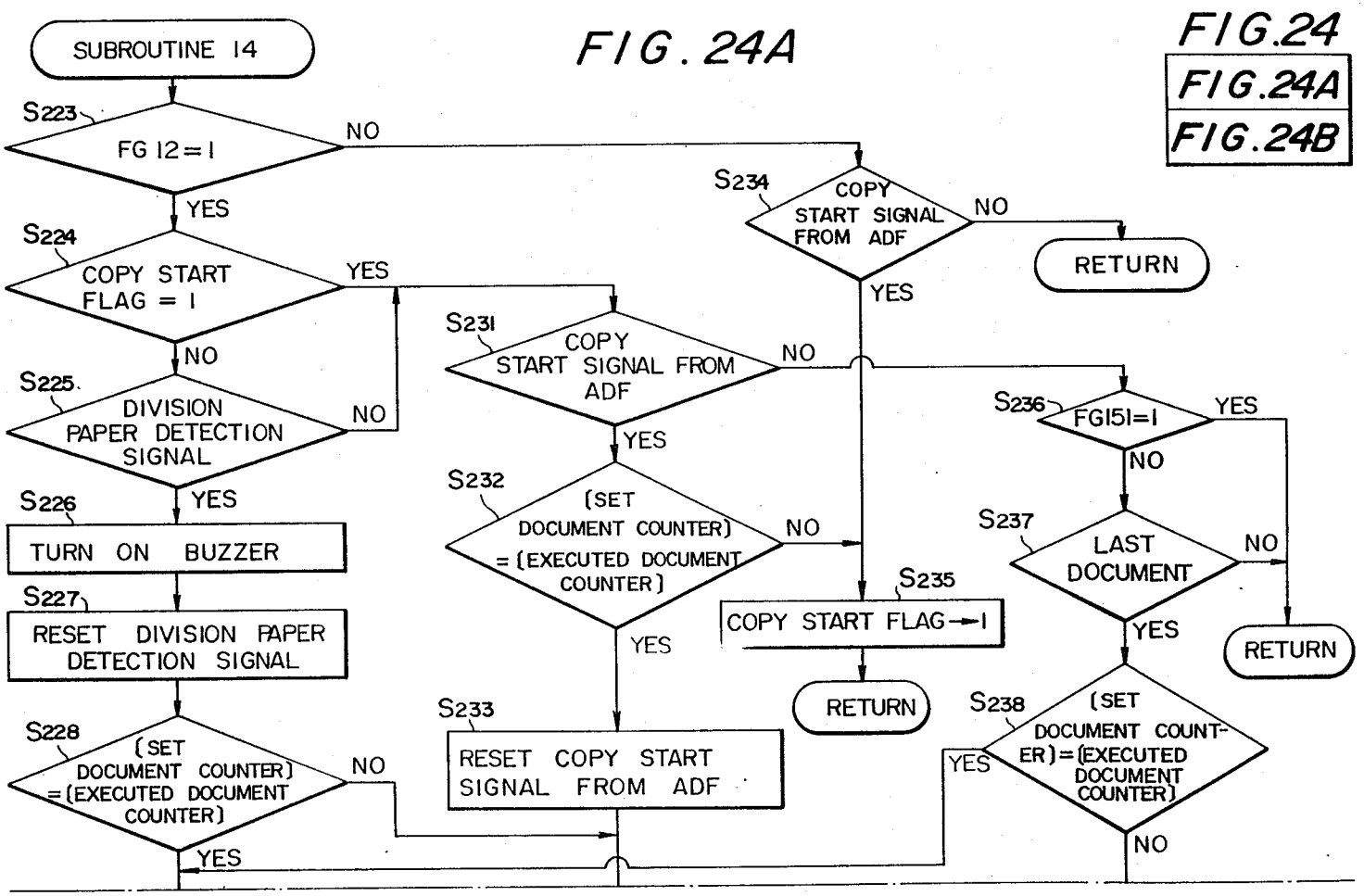
FIG.24
FIG.24A
FIG.24B
FIG. 24A
SUBROUTINE 14
S223
FG 12=1
NO
YES
S224
COPY START FLAG = 1
NO
YES
S225
DIVISION PAPER DETECTION SIGNAL
NO
YES
S226
TURN ON BUZZER
S227
RESET DIVISION PAPER DETECTION SIGNAL
S228
{SET DOCUMENT COUNTER} ={EXECUTED DOCUMENT COUNTER}
NO
YES
S231
COPY START SIGNAL FROM ADF
NO
YES
S232
{SET DOCUMENT COUNTER} ={EXECUTED DOCUMENT COUNTER}
NO
YES
S233
RESET COPY START SIGNAL FROM ADF
S234
COPY START SIGNAL FROM ADF
NO
YES
RETURN
S235
COPY START FLAG←1
RETURN
S236
FG15=1
YES
NO
S237
LAST DOCUMENT
NO
YES
RETURN
S238
{SET DOCUMENT COUNTER}={EXECUTED DOCUMENT COUNTER}
YES
NO SUBROUTINE 21
S284
{TPC}≧R
NO
YES
S289
{TPC}=R
NO
YES
RETURN
S290
AFG22=1
NO
YES
S285
DIVISION PAPER SENSOR MEANS ON
NO
YES
S286
AFG21 ← 1
RETURN
S287
AFG21=1
NO
YES
S288
AFG22 ← 1
RETURN

ELECTRONIC COPIER WITH AUTOMATIC DOCUMENT FEEDER AND SORTER

BACKGROUND OF THE INVENTION

The present invention relates to an electronic copier which is equipped with an automatic document feeder and a sorter.

Electronic copiers known in the art include a copier of the type capable of continuously copying a plurality of documents which share the same copying conditions. The problem with such a copier is that, when it comes to a plurality of groups of documents which differ in copying condition from each other, it cannot continuously copy them and requires an operator to perform copy starting manipulations every time the copying conditions are changed.

SUMMARY OF THE INVENTION

It is therefore an object of the present invention to provide an electronic copier with an automatic document feeder and a sorter which is capable of continuously copying a plurality of groups of documents which are different in copying conditions from each other.

It is another object of the present invention to provide an electronic copier which is capable of calculating and displaying the total number of copies to be produced before a copying operation is started.

It is another object of the present invention to provide an electronic copier which, after completing copying cycles on one group of original documents, is capable of displaying copying conditions associated with another group of original documents which are to be copied next.

It is another object of the present invention to provide an electronic copier which is capable of determining whether the number of original documents actually fed by an automatic document feeder is equal to a number preset in a set document number store means, which is adapted to store the number of documents that is entered for each of different copying conditions, and displaying the result.

It is another object of the present invention to provide an electronic copier which is capable of calculating and displaying the number of usable, or remaining, number of bins in a sorter.

It is another object of the present invention to provide an electronic copier which automatically sets up a stack mode or a sort mode depending upon the entered number of documents, i.e. whether it is one or not.

It is another object of the present invention to provide an electronic copier which is capable of selectively setting up a multi-job mode for continuously copying a plurality of groups of documents which are different in copying condition, and allowing single display means to display desired job data, and allowing single display means to display responsive to a copy start signal the job data associated with one goup of documents which are to be copied.

It is another object of the present invention to provide a generally improved electronic copier with an automatic document feeder and a sorter.

In accordance with a first aspect of the present invention, there is provided an electronic copier equipped with an automatic document feeder and a sorter, the copier including a multi-job mode setting device for selectively setting up a multi-job mode in which a plurality of groups of documents which differ in copying condition from each other are copied continuously, a copying condition inputting device for inputting copying conditions associated with the plurality of groups of documents, an executed document counter for counting documents which have been copied, an executed copy counter for counting papers, or copies, which are discharged after copying, a job data store for storing the copying conditions entered through the copying condition inputting device, a count of the executed document counter, and a count of the executed copy counter, a division paper sensor for sensing a division paper which is interposed between the documents to divide the documents by group and fed by the automatic document feeder, and a copy control for, when a multi-job mode is set by the multi-job mode setting device, continuously copying the plurality of documents which differ in copying condition from each other responsive to job data stored in the job data store and a detection signal applied from the division paper sensor.

In accordance with a second aspect of the present invention, there is provided an electronic copier equipped with an automatic document feeder and a sorter and capable of selectively setting up a multi-job mode for continuously copying a plurality of groups of documents which differ in copying condition from each other, the copier including, a set document number inputting device for inputting numbers of documents in a multi-job mode, a set document number store for storing set document numbers entered through the set document number inputting device, a set copy number inputting device for inputting numbers of copies to be provided with the documents, a set copy number store for storing set copy numbers entered through the set copy number inputting device, an executed copy counter for counting papers which have been discharged, a total copy number calculating device for calculating a total number of copies which have not been executed based on the set document numbers stored in the set document number store, set copy numbers stored in the set copy number store, and executed copy number stored in the executed copy counter, and a total copy number display for displaying a total number of copies provided by the total copy number calculating device.

In accordance with a third aspect of the present invention, there is provided an electronic copier equipped with an automatic document feeder and a sorter and capable of selectively setting up a multi-job mode for continuously copying a plurality of groups of documents which differ in copying condition from each other, the copier including a set document number inputting device for inputting numbers of documents in a multi-job mode, a set document number store for storing set document numbers entered through the set document number inputting device, a set copy number inputting device for inputting numbers of copies to be provided with the documents, a set copy number store for storing set copy numbers entered through the set copy number inputting device, an executed copy counter for counting papers which have been discharged, a total copy number calculating device for calculating a total number of copies which have not been executed based on the set document numbers stored in the set document number store, set copy numbers stored in the set copy number store, and executed copy number stored in the executed copy number counter, a copy number compensating device for compensating the total number of copies when after interruption of a copying operation those documents in a group of the same copying condition and under execution which have not been copied yet are to be fully copied, and a total copy number display for displaying a total number of copies provided by the total copy number calculating device.

In accordance with a fourth aspect of the present invention, there is provided an electronic copier equipped with an automatic document feeder and a sorter and capable of continuously copying a plurality of groups of documents which differ in copying condition from each other, comprising a copying condition inputting device for inputting copying conditions associated with the plurality of groups of documents, a copying condition store for storing copying conditions which are entered through the copying condition inputting device, a division paper sensor for sensing a division paper which is interposed between the documents to divide the documents by group and fed by the automatic document feeder, and a copying condition display for, when the division paper sensor has sensed a division paper, reading a copying condition associated with a group of documents which are to be copied next out of the copying condition store and displaying the copying condition.

In accordance with a fifth aspect of the present invention, there is provided an electronic copier equipped with an automatic document feeder and a sorter and capable of continuously copying a plurality of groups of documents which differ in copying condition from each other, the copier including a set document number store for storing numbers of documents which are entered copying condition by copying condition, an executed document counter for counting copying condition by copying condition the documents which are fed by the automatic document feeder, a division paper sensor for sensing a division paper which is interposed between the documents to divide the documents by copying condition, a document number equal/unequal decision device for, when the division paper sensor has sensed the division paper, deciding whether a set document number stored in the set document number store is equal to an executed document number provided by the executed document counter, and a document number equal/unequal display for displaying a result of the decision performed by the document number equal-/unequal decision device.

In accordance with a sixth aspect of the present invention, there is provided an electronic copier equipped with an automatic document feeder and a sorter and capable of selectively setting up a multi-job mode for continuously copying a plurality of groups of documents which differ in copying condition from each other, comprising a set copy number store for storing a set number of copies entered, a residue bin number calculating device for calculating a number of bins in the sorter to be used from a set copy number which is stored in the set copy number store and subtracting the number of bins to be used from a maximum number of bins of the sorter, thereby calculating a residual number of bins in the sorter, and a residual bin number display for displaying the residual number of bins provided by the residual bin number calculating device.

In accordance with a seventh aspect of the present invention, there is provided an electronic copier equipped with an automatic document feeder and a sorter and capable of selectivey setting up a stack mode in which the sorter stacks a plurality of papers, or copies, obtained with a single document in a bin and a sort mode in which a plurality of copies obtained with a single document are sequentially distributed to a plurality of bins one by one, the copier including a set document number inputting device for inputting a number of documents, a set copy number inputting device for inputting a number of copies, a set document number decision device for deciding whether the set number of documents entered through the set document number inputting device is one, a sorter mode setting device for setting up the stack mode when the set document number decision device has decided that the set document number is one and the sort mode when the set document number decision device has decided that the set document number is two or more, and a copy paper classification control for controlling classification of copy papers based on the set document number entered through the set document number inputting device, set copy number entered through the set copy number inputting device, and mode selected by the sorter mode setting device.

In accordance with an eighth aspect of the present invention, there is provided an electronic copier equipped with an automatic document feeder and a sorter and capable of selectively setting up a multi-job mode for continuously copying a plurality of groups of documents which differ in copying condition from each other, the copier including a copying condition inputting device for inputting copying conditions associated with the plurality of groups of documents, executed copy counters for counting a number of documents which have been copied and a number of copies, a job data store for storing copying conditions entered through the copying condition inputting device and counts of the executed copy counters, a job data display for displaying one of job data which are stored in the job data store, and a display command inputting device for inputting a display command signal for causing desired one of the job data to be read out of the job data store and displayed by the job data display.

In accordance with another aspect of the present invention, there is provided an electronic copier equipped with an automatic document feeder and a sorter and capable of selectively setting up a multi-job mode for continuously copying a plurality of groups of documents which differ in copying condition from each other, comprising a copying condition inputting device for inputting copying conditions associated with the plurality of groups of documents, executed copy counters for counting a number of documents which have been copied and a number of copies, a job data store for storing copying conditions entered through the copying condition inputting device and counts of the executed copy counters, a job data display for displaying one of job data which are stored in the job data store, a display command inputting device for inputting a display command signal for causing a desired one of the job data to be read out of the job data store and displayed by the job data display, and a display switching device for causing the job data display to display job data associated with a group of documents which are to be copied in response to a copy start signal.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
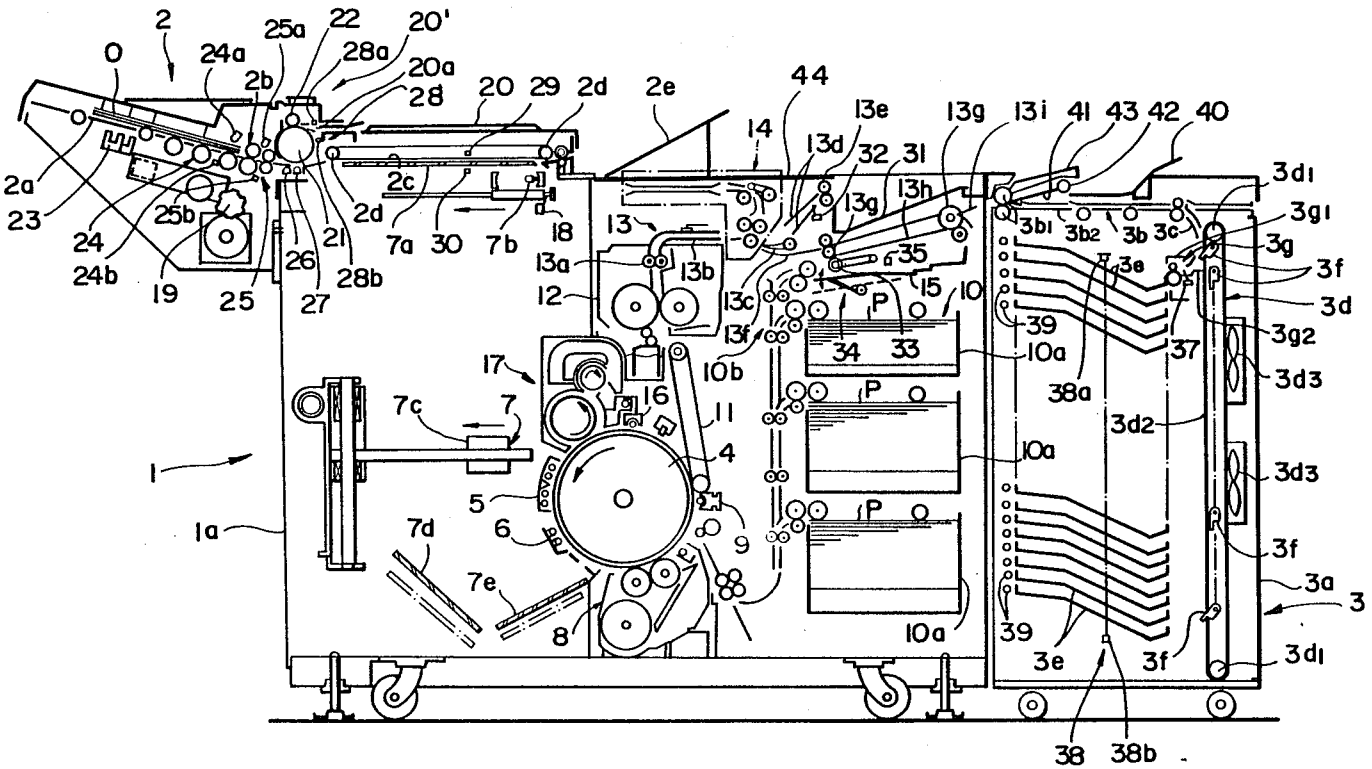
FIG. 1 is a schematic view of an electronic copier embodying the present invention.

Referring to FIG. 1 of the drawings, an electronic copier embodying the present invention is shown and generally designated by the reference numeral 1. An automatic document feeder (ADF) 2 is mounted on the top of the copier 1, while a sorter 3 is positioned adjacent to the copier 1. A housing 1*a* of the copier 1 and a housing 3*a* of the sorter 3 are arranged substantially in contact with each other.

Disposed inside the copier housing 1*a* is a photoconductive element 4 in the form of a drum. The drum 4 is rotatable as indicated by an arrow and is driven by drive means, not shown. Arranged in predetermined positions around the drum 4 are a charger 5, an eraser 6, an exposing device 7, a developing unit 8, a transfer unit 9, a paper feeding device 10, a paper separating and conveying device 11, a fixing unit 12, copy transporting means 13 for transporting a paper P on which a toner image has been fixed, inversion means 14 for inverting the paper P, an intermediate tray 15 for temporarily storing the paper P, a discharger 16, a cleaning unit 17, etc. With such units and devices, the copier 1 repeatedly performs the steps of charging, exposing, developing, transferring, fixing, discharging, and cleaning.

The exposing device 7 includes a glass platen 7*a* located on the top of the copier housing 1*a*, a lamp 7*b* for illuminating an image surface of an original document O which is laid on the glass platen 7*a*, a lens 7*c* for focusing image light from the document O to the drum 4 in a slit configuration, a first mirror 7*d*, and a second mirror 7*e*. The lamp 7*b* is movable as indicated by an arrow and, timed to the movement of the lamp 7*b*, the lens 7*c* is movable as indicated by an arrow in order to focus image light reflected from the whole image surface of the document O to the drum 4. A scanner sensor 18 responsive to the number of scanning movements of the optics made up of the lamp 7*b* and lens 7*c* is located in the vicinity of a home position of the lamp 7*b*. In the exposing device 7, the lens 7, first mirror 7*d* and second mirror 7*e* are variable in position to change the magnification thereof.

The paper feed device 10 comprises a plurality of trays 10*a* for storing papers P, and feed means 10*b* consisting of feed rollers and guide plates adapted to feed papers P one by one from any of the trays 10*a* to a space between the drum 4 and the transfer unit 9.

The ADF 2 is arranged above and in the vicinity of the glass platen 7*a*. The ADF 2 comprises a document table 2*a*, document feed means 2*b* means up of a plurality of rollers and drive means for rotating the rollers for feeding the stack of documents O laid on the table 2*a* one by one from the lowest one in the stack toward the glass platen 7*a*, a belt 2*c* located above the glass platen 7*a*, and belt drive means made up of two rollers 2*d* over which the belt 2*c* is passed, and drive means for rotating the roller 2*d*. The document feed means 2*b* is provided with an encoder 19 for sensing an amount of feed of the document O effected by the means 2*b*.

Each of the documents O put on the table 2*a* is fed by the document feed means 2*b* to between the belt 2*c* and the glass platen 7*a* and, then, transported by the belt 2*c* until it becomes stopped at a predetermined position on the glass platen 7*a*. In this position, the document O is illuminated by the exposing device 7 so that the resulting image light is focused to the drum 4. Thereafter, the document O is fed again by the belt 2*c* outwardly of the glass platen 7*a*. A tray 2*e* is rigidly mounted on the top of the copier housing 1*a* in front of the belt 2*c* with respect to the direction of document transport. In this construction, the document O transported by the belt 2*c* along the glass platen 7*a* will be received by the tray 2*e*.

A table 20 for manual document insertion is disposed above the glass platen 7*a* in such a manner as to cover the belt 2*c* from above. A turn roller 21 is located between the document feed means 2*b* and the belt 2*c*, while a pinch roller 22 is pressed against the turn roller 21 from above. Defined between the turn roller 21, pinch roller 22 and table 20 is an opening 20*a* through which a document O may be manually inserted into the copier 1. As a document O is manually inserted into the opening 20*a* while being guided by the table 20, it is fed to between the glass platen 7*a* and the belt 2*c* by the rotation of the turn roller 21 while being nipped between the turn roller 21 and the pinch roller 22 and, thereafter, it is driven by the belt 2*c* in the previously described manner. The table 20, opening 20*a*, turn roller 21, pinch roller 22 and belt 2*c* constitute in combination a semiautomatic document feeder (SADF) 20'.

Figure 2:
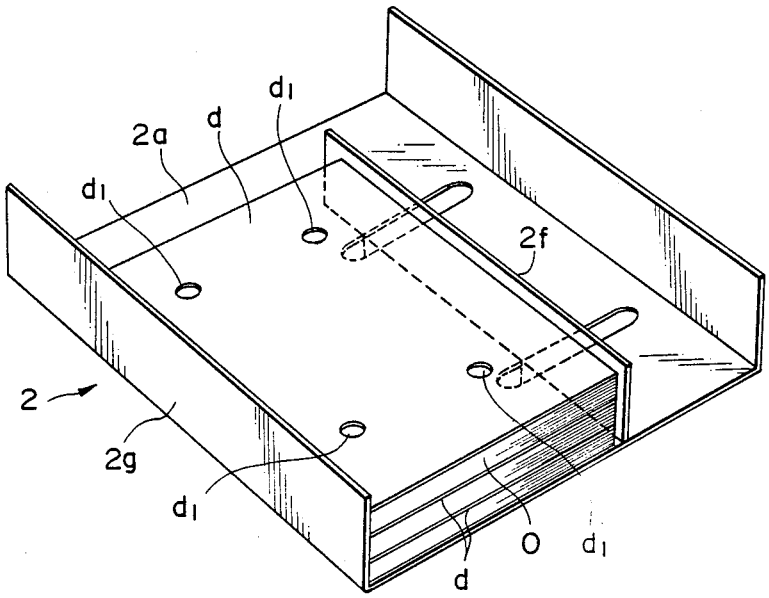
FIG. 2 is a fragmentary perspective view of an automatic document feeder associated with the copier of FIG. 1.

As shown in FIG. 2, a document guide plate 2*f* is positioned on the table 2*a* in such a manner as to be movable toward and away from a stationary document guide plate 2*g* which is also mounted on the table 2*a*. Where a plurality of documents O are stacked on the table 2*a*, the guide plate 2*f* is manually movable relative to the stationary guide plate 2*g* depending upon the size of the documens O, thereby positioning the documents O. Document size sensor means 23 is disposed beneath the table 2*a* in order to sense a position of the movable guide plate 2*f* and, thereby, a document size.

The copier 1 having the above construction is capable of continuously copying a plurality of groups of documents O which are different in copying conditions from each other. Such a copying mode will hereinafter be referred to as a multi-job mode. The other copying mode in which a plurality of documents O sharing the same copying conditions are continuously copied may be called a one-job mode.

A plurality of groups of documents O which are not identical in copying conditions may be loaded on the table 2*a* at the same time. One group of documents O is partitioned from another by a division paper d (FIG. 2). Each of the division papers d is provided with four openings d1 which are equally distant from the center on diagonals. Alternatively, each division paper d may be provided with a single opening. Furthermore, the opening or openings in the paper d may be replaced with black spots locally provided on the paper d, in which case the paper d should be white, or magnetic thin pieces bonded to the paper d.

First document sensor means 24 is located in the vicinity of the table 2*a* in order to see if documents O are laid on the table 2*a* and is made up of a light-emitting element 24*a* and a light-receiving element 24*b*. In front of the table 2*a* with respect to the sheet feed direction, a division paper sensor means 25 is positioned to sense the openings d1 to distinguish the papers d from the documents O. The means 25, like the means 24, is implemented by a light-emitting element 25*a* and a light-receiving element 25*b*. Where magnetic thin pieces are bonded to each paper d as previously mentioned, the sensor means 25 will comprise a magnetic sensor. First sheet feed sensor 26 and second sheet feed sensor 27 are positioned between the division paper sensor means 25 and the belt 2*c* and beneath the turn roller 21, each of the sensors 26 and 27 comprising a light-emitting element and a light-receiving element. The output signal of the first sheet feed sensor means 26 is adapted to control the document feed means 2*b*, while the output of the second sheet feed sensor means 27 is adapted to sense jams of the documents O.

Second document sensor means 28 which comprises a light-emitting element 28*a* and a light-receiving element 28*b* is positioned adjacent to the table 20 to determine whether a document O has been laid on the table 20. The belt 2*c* and table 20 are integrally rotatable, or openable, away from the glass platen 7*a* so that a document O may be laid on the glass platen 7*a*; when the belt 2*c* and table 20 are closed, the document O will be pressed against the glass platen 7*a* from above. A magnet 29 is fixed to a support plate which supports the belt 2*c*, while pressure plate open/close sensor means 20 is positioned adjacent to the glass platen 7*a* and in alignment with the magnet 29. The sensor means 30 comprises a magentic sensor. When the belt 2*c* is brought to the vicinity of, or into contact with the glass platen 7*a*, the sensor means 30 senses it to become "on"; as the belt 2*c* is moved away from the glass platen 7*a*, the sensor means 30 becomes "off".

The paper transport means 13 comprises feed roller 13*a* for feeding a paper P which comes out of the fixing unit 12, a guide plate 13*b* for guiding the paper P from the rollers 13*a* toward the inversion means 14, a pawl 13*c* for switching the direction of movement of the paper P which has reached the inversion means 14, guide plates 13*d* and a feed roller 13*e* for upwardly guiding the paper P which has been guided by the pawl 13*c*, a guide plate 13*f* for guiding the paper P, which has been guided by the pawl 13*c*, toward the sorter 3, belt drive rollers 13*g*, a belt 13*h*, and a pawl 13*i* located at the sorter 3 side of one of the rollers 13*g* which is closest to the sorter 3 so as to selectively guide the paper P toward the sorter 3 and the intermediate tray 15.

A tray 31 for receiving copies is located in a position past the roller 13*e* with respect to the feed direction of the roller 13*e*. The paper P which is guided upwardly by the pawl 13*c* is driven by the guide plates 13*d* and roller 13*e* onto the tray 31. A copy discharge sensor 32 is positioned in the vicinity of the guide plates 13*d* and comprised of a movable piece which is displaced by a paper P and a sensor for sensing a displacement of the movable piece.

A paper P which is guided downwardly by the pawl 13*i* is received in the intermediate tray 15, which is angularly movable. A feed roller 33 is positioned above the intermediate tray 15, while tray raising means 34 is positioned beneath the tray 15. The tray raising means 34 is adapted to push up the tray 15 to bring the paper P on the tray 15 into pressing contact with the feed roller 33, thereby allowing the paper P to be fed out of the tray 15. The paper P thus pressed against the roller 3 is fed by the roller 3 to feed means 10*b* of the paper feed device 10 and, by the feed means 10*b*, to between the drum 4 and the transfer unit 9. Located near the intermediate tray 15 is an intermediate tray sensor 35 which comprises a light-emitting element and a light-receiving element for determining whether papers P are stored in the tray 15.

Figure 3:
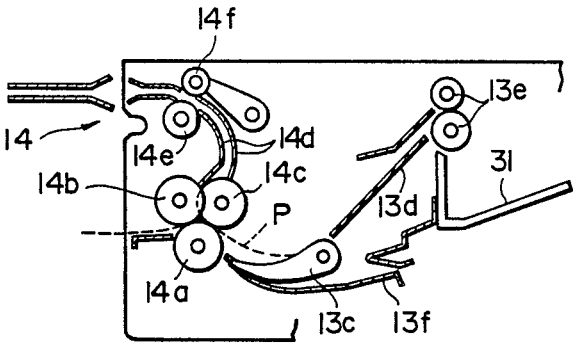
FIGS. 3-5 are views of inversion means included in the copier of FIG. 1.
Figure 4:
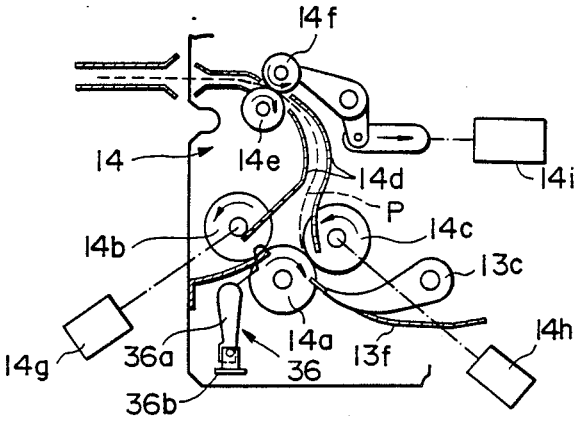
Figure 5:
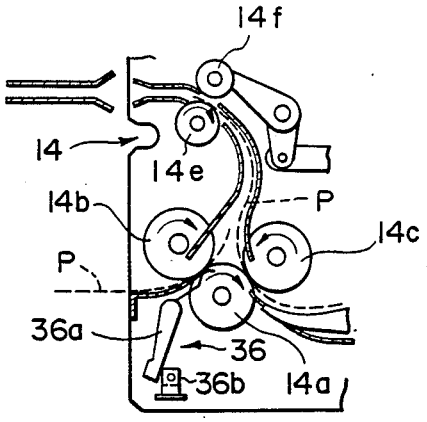

As shown in FIGS. 3–5, the inversion means 14 comprises a main inversion roller 14*a*, two inversion rollers 14*b* and 14*c* movably arranged above the roller 14*a*, two inversion guide plates 14*d* disposed above the rollers 14*b* and 14*c*, a reverse rotation roller 14*e* disposed in an upper portion of the guide plates 14*d*, a return roller 14*f* movable toward and away from the roller 14*e*, etc.

Solenoids 14*g* and 14*h* respectively are associated with the inversion rollers 14*b* and 14 so as to selectively move them toward each other as shown in FIG. 3 and away from each other as shown in FIGS. 4 and 5. Specifically, when the solenoids 14*g* and 14*h* are deenergized, the rollers 14*b* and 14*c* are brought close to each other and, when they are energized, the rollers 14*b* and 14*c* are moved away from each other.

A solenoid 14*i* is associated with the return roller 14*f*. When the solenoid 14*i* is energized, the return roller 14*f* is pressed against the reverse rotation roller 14*e* and, when it is deenergized, the roller 14*f* is moved away from the roller 14*e*.

An inversion sensor 36 is positioned near the rollers 14*a* and 14*b* to sense a paper P which may intervene between the rollers 14*a* and 14*b*. The sensor 36 comprises a movable piece 36*a* which is moved by a paper P and a photointerrupter 36*b* responsive to a displacement of the movable piece 36*a*. If a paper P is absent between the rollers 14*a* and 14*b* while the solenoids 14*g* and 14*h* are energized, that is, while the rollers 14*b* and 14*c* are spaced apart from each other as shown in FIG. 4, a lower portion of the movable piece 36*a* intervenes beween a light-emitting element and a light-receiving element of the photointerrupter 36*b* to make the inversion sensor 36 "off"; if a paper P is present between the rollers 14*a* and 14*b*, the movable piece 36*a* is displaced by the paper P with the result that its lower portion is moved away from the position between the cooperative elements of the photointerrupter 36*b* to make the inversion sensor 36 "on". While the solenoids 14*g* and 14*h* are "off", the inversion sensor 36 is retracted from the path of papers P and maintained "off".

In operating modes other than an inversion mode, the solenoids 14*g* and 14*h* are "off" to hold the inversion rollers 14*b* and 14*c* close to each other as shown in FIG. 3. In this condition, a paper P fed from the fixing unit 12 and driven by the roller 13*a* to between the rollers 14*a* and 14*b* is inserted between the rollers 14*a* and 14*c* without being directed toward the inversion guide plates 14*d*. The rollers 14*a* and 14*c* drive the paper P toward the pawl 13*c*.

In an inversion mode, the solenoids 14g and 14h are "on" to maintain their associated rollers 14b and 14c remote from each other as shown in FIGS. 4 and 5. In this condition, a paper P inserted between the rollers 14a and 14b is driven by the rollers 14a and 14b while being guided by the inversion guide plates 14d. At the instant when the leading edge of the paper P has moved past the gap between the reverse rotation roller 14e and the return roller 14f, which are spaced apart from each other, the trailing edge of the copy P is released from between rollers 14a and 14b. At this moment, the inversion sensor 36 becomes "off" to make the return solenoid 14i "on" so that the return roller 14f is moved toward the reverse rotation roller 14e to hold the paper P therebetween. As the rollers 14e and 14f are rotated as indicated by an arrow in FIG. 4, the paper P is inserted between the rollers 14a and 14c and fed thereby toward the pawl 13c. The paper P thus fed by the rollers 14a and 14c is positioned upside down relative to a position which would be provided by the rollers 14a and 14b.

In the case where a plurality of papers P are continuously fed toward the inversion means 14, the paper feed timing is adjusted such that after the preceding paper P has been driven by the reverse rotation roller 14e and return roller 14f to be inserted between the rollers 14a and 14c, the following paper P is inserted between the rollers 14a and 14b.

The copier 1 described above is selectively operable in five different modes, i.e. a one-face mode, a double-face mode, a combination mode and, an inversion mode.

In a one-face mode, after an image pattern on one document O has been copied on one surface of a paper P, the paper P is discharged to the tray 31 without being inverted by the inversion means 14 and without being routed through the intermediate tray 15.

In a double-face mode, after an image pattern of the document O has been copied on one surface of a paper P, an image pattern of another document O is copied on the other surface of the same paper P. During the double-face mode operation, a paper P is provided with an image pattern of one document O on its one surface, then inverted by the inversion means 14, then routed through the intermediate tray 15, then provided with an image pattern of another document O on the other surface, and then discharged to the tray 31 without being inverted by the inversion means 14 and without being routed through the intermediate tray 15.

In a combination mode, image patterns on two documents O are replicated on one surface of a paper P one above the other. Specifically, a paper P is provided with an image pattern of one document O on its one surface, then moved through the intermediate tray 15 without being inverted by the inversion means 14, then provided with an image pattern of another document on the same surface as the first document, and then discharged to the tray 31 without being inverted by the inversion means 14 and without being routed through the intermediate tray 15.

An inversion mode is a mode wherein a paper P which has undergone a one-face mode operation is inverted by the inversion means 14 and then discharged to the tray 31, or a mode wherein after replication on the second surface of a paper P in a double-face mode or a combination mode (second replication on the same paper P), the paper P is inverted by the inversion means 14 to be discharged to the tray 31.

The sorter 3 includes horizontal transport means 3b disposed in an upper portion of the interior of the sorter housing 3a for horizontally transporting papers P which are fed into the sorter by the belt 13h of the copier 1, a redirecting guide plate 3c for downwardly directing the papers P which are conveyed by the horizontal transport means 3b, vertical transport means 3d located beneath the guide plate 3c for vertically downwardly transporting the papers P, a plurality of vertically spaced bins 3e which are positioned near the vertical transport means 3d, a plurality of deflection cams 3f associated in one-to-one correspondence with the bins 3e for deflecting the papers P which are brought thereto by the vertical transport means 3d toward their associated bins 3e, and bin selection means 3g vertically movably interposed between the vertical transport means 3d for guiding the papers P which are deflected by the deflection cams 3f toward predetermined bins 3e.

The horizontal transport means 3b comprises a plurality of feed rollers 3b, and a guide plate $3b_2$, while the vertical transport means 3d comprises two belt drive rollers $3d_1$, a belt $3d_2$ passed over the rollers $3d_1$, and fans $3d_3$ adapted to suck papers P toward the belt $3d_2$. The deflection cams 3f are displaced individually by their associated solenoids, not shown.

The bin selection means 3g comprises a support plate $3g_1$ driven by drive means (not shown) to move up and down, a guide plate $3g_2$ mounted on the support plate $3g_1$ to guide a paper P which is redirected by any of the deflection cams 3f, and a roller $3g_3$ for driving a paper P which is guided by the guide plate $3g_2$ into a bin 3e.

Also mounted on the support plate $3g_1$ of the bin selection means 3g is a copy discharge sensor 37 which comprises a movable piece and a sensor responsive to a displacement of the movable piece. A light-emitting element 38a is positioned above the uppermost one of the bins 3e, while a light-receiving element 38b is positioned below the lowermost one of the bins 3e in alignment with the light-emitting element 38a. Each of the bins 3e is provided with an aperture so that light issuing from the light-emitting element 38a may reach the light-receiving element 38b. The elements 38a and 38b constitute a bin paper sensor 38 for determining whether papers P are present in any of the bins 3e. A plurality of job division displays 39 are located near the bins 3e in one-to-one correspondence and are implemented by light-emitting diodes. The displays 39 serve to distinguish papers P which are stored in the bins 3e by jobs which are different in copying conditions from each other.

The sorter 3 is operable either in a sort mode and a stack mode. In a sort mode, a plurality of papers, or copies, P of each document O are sequentially distributed one by one into the bins 3e in either the one-face mode, double-face mode, combination mode or inversion mode of the copier 1. In a stack mode, a plurality of copies P of each document are stacked in one bin 3e and, if the number of copies P is greater than the capacity of one bin 3e, the copies P are stacked in the next bin 3e, in any of the one-face mode, double-face mode, combination mode and inversion mode of the copier 1.

A tray 40 is positioned on the top of the sorter housing 3a. A pawl 41 and a feed roller 42 are arranged between the tray 40 and one of the feed rollers $3b_1$ which is closest to the copier 1. When a paper P has jammed in the sorter 3, the following papers P are redirected by the pawl 41 toward the tray 40. A tray 43 for manual copy insertion is provided above the tray 40 to allow papers P to be manually inserted into the sorter 3. After a paper P jammed in the sorter 3 has been removed, the papers P discharged to the tray 40 are inserted into the sorter from the tray 43 to be distributed to predetermined bins 3*e*.

Figure 6:
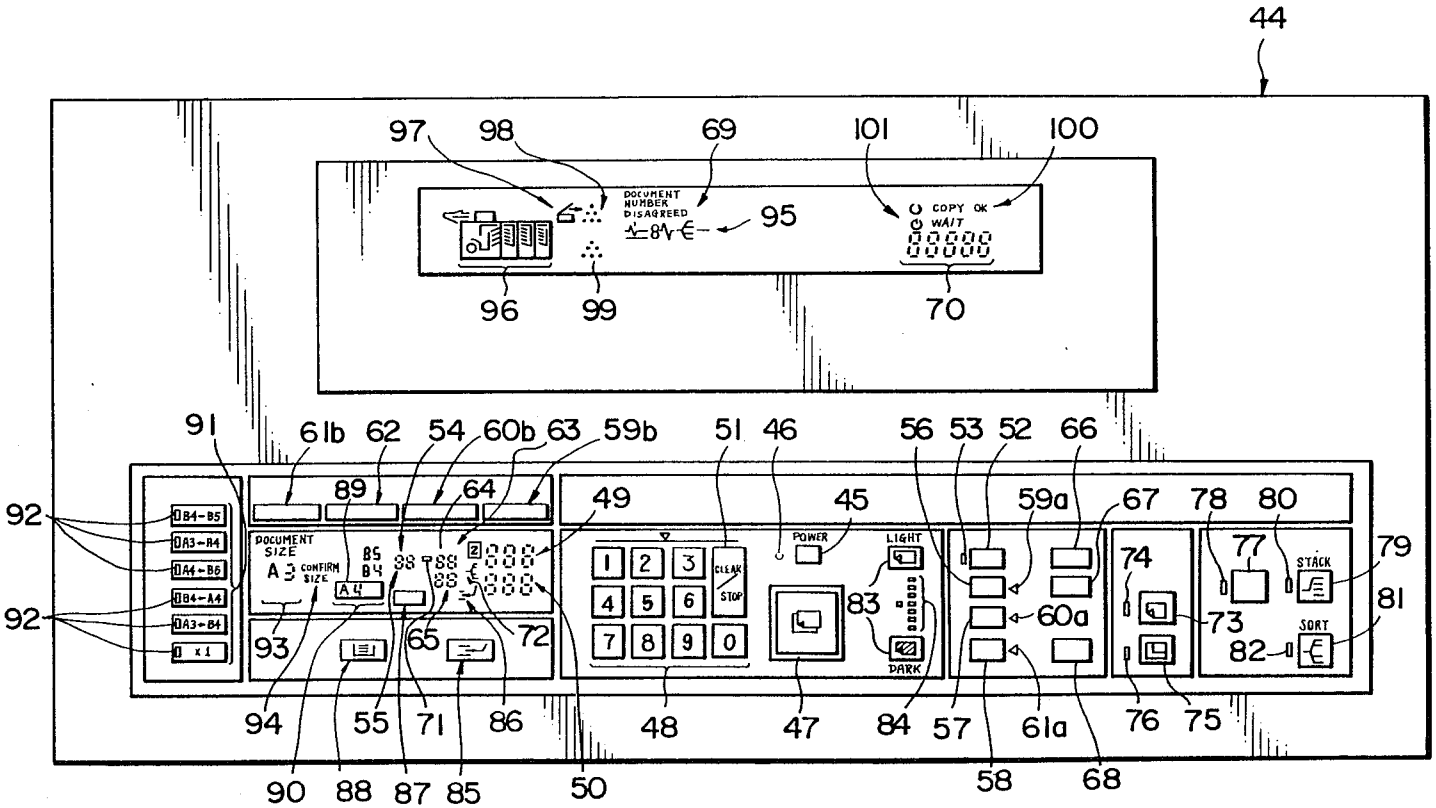
FIG. 6 is a plan view of an operation and display panel included in the copier of FIG. 1.

Referring to FIG. 6, an operation and display panel 44 which is mounted on the top of the copier housing 1*a* is shown. Provided on the panel 44 are a power key 45 for turning on and off a power source, a power source display 46 for displaying on/off condition of the power key 45, a print key 47 for starting a copying operation, ten keys 48 for entering the number of documents, the number of copies and others, a set copy number counter display 49 for displaying a count of a set copy number counter which is adapted to count the copies entered through the ten keys 48, an executed copy number counter display 50 for displaying a count of an executed copy number counter which is adapted to count copies, a clear/stop key 51 for clearing the set copy number counter and interrupting a copying operation, a multi-job key 52 for setting up a multi-job mode, a multi-job mode display 53 for displaying a multi-job mode, a case number display 54 for displaying characters "CASE NUMBER" in a multi-job mode operation, a case number counter display 55 for displaying the number of a job in a multi-job mode, a document number key 56 for entering the number of documents per copying condition, i.e., per case, in a multi-job mode, a copy number key 57 for entering the number of copies per case in a multi-job mode, an input key 58 for entering the number of documents and the number of copies, case by case in a multi-job mode operation, document number key depression displays 59*a* and 59*b*, copy number key depression displays 60*a* and 60*b*, input key depression displays 61*a* and 61*b*, a ten key depression display 62 for instructing depression of the ten keys 48 after the document number key 56 or the copy number key 57 has been depressed, a document number display 63 for displaying characters "NUMBER OF DOCUMENTS" in a multi-job mode, a set document counter display 64 for displaying in a multi-job mode the number of documents to be executed per case, an executed document number counter display 65 for displaying in a multi-job mode a count of an executed document counter which is adapted to count the number of documents which have been executed, a placed numeral confirm key 66 for allowing the operator to confirm an entered content in a multi-job mode, a residual confirm key 67 for allowing the operator in a multi-job mode to confirm the number of documents which can be entered and the number of copies which can be entered, a job cancel key 68 for clearing mainly the content of a desired job in a multi-job mode, a document number unequal display 69 for displaying in a multi-job mode that the set number of documents per case entered is not equal to the number of documents which have actually been executed, a total copy number display 70 for displaying in a multi-job mode the sum of the job-by-job products of the numbers of documents and those of copies associated with jobs to be executed, a placed document number confirm display 71 which flashes when the sum of numbers of documents entered in a multi-job mode is in excess of the maximum number which the ADF 2 can accommodate, a copy number confirmation display 72 which flashes when in a sorter use mode the entered number of copies is in excess of the maximum available number of bins of the sorter 3, an invert key 73 for selecting an inversion mode, an inversion mode display 74 for displaying the on/off condition of the invert key 73, a combine key 75 for selecting a combination mode, a combination mode display 76 for displaying the on/off condition of the combine key 75, a double-face key 77 for selecting a double-face mode, a double-face mode display 78 for displaying the on/off condition of the double-face key 77, a stack key 79 for selecting a stack mode, a stack mode display 80 for displaying the on/off condition of the stack key 79, a sort key 81 for selecting a sort mode, a sort mode display 82 for displaying the on/off condition of the sort key 81, two density control keys 83 for adjusting the copy density, a density display 84 for displaying a density which has been selected by the keys 83, an interrupt key 85 for an interrupt copying operation, an interrupt display key 86 for displaying the on/off condition of the interrupt key 85, a document 2 display 87 for displaying a back face copying operation during a double-face mode or a second surface copying mode during a combination mode, a tray select key 88 for selecting one of the trays 10*a* which stores desired papers P, a selected tray display 89 for displaying the selected tray 10*a*, a paper size display 90 for displaying the size of the papers P stored in the selected tray 10*a*, magnification keys 91 for selectively setting up various magnifications and magnification displays 92 for displaying which one of the keys 91 has been depressed, a document size display 93, a size confirmation display 94 which flashes when none of the trays 10*a* stores papers P of an adequate size which is determined by the size of documents and the selected magnification, a jam display 95, a jam location display 96, document replace display 97, a toner near-end display 98, a toner end display 99, a "COPY OK" display 100, a "WAIT" display 101 for showing a condition in which copying is impossible, etc.

Figure 7:
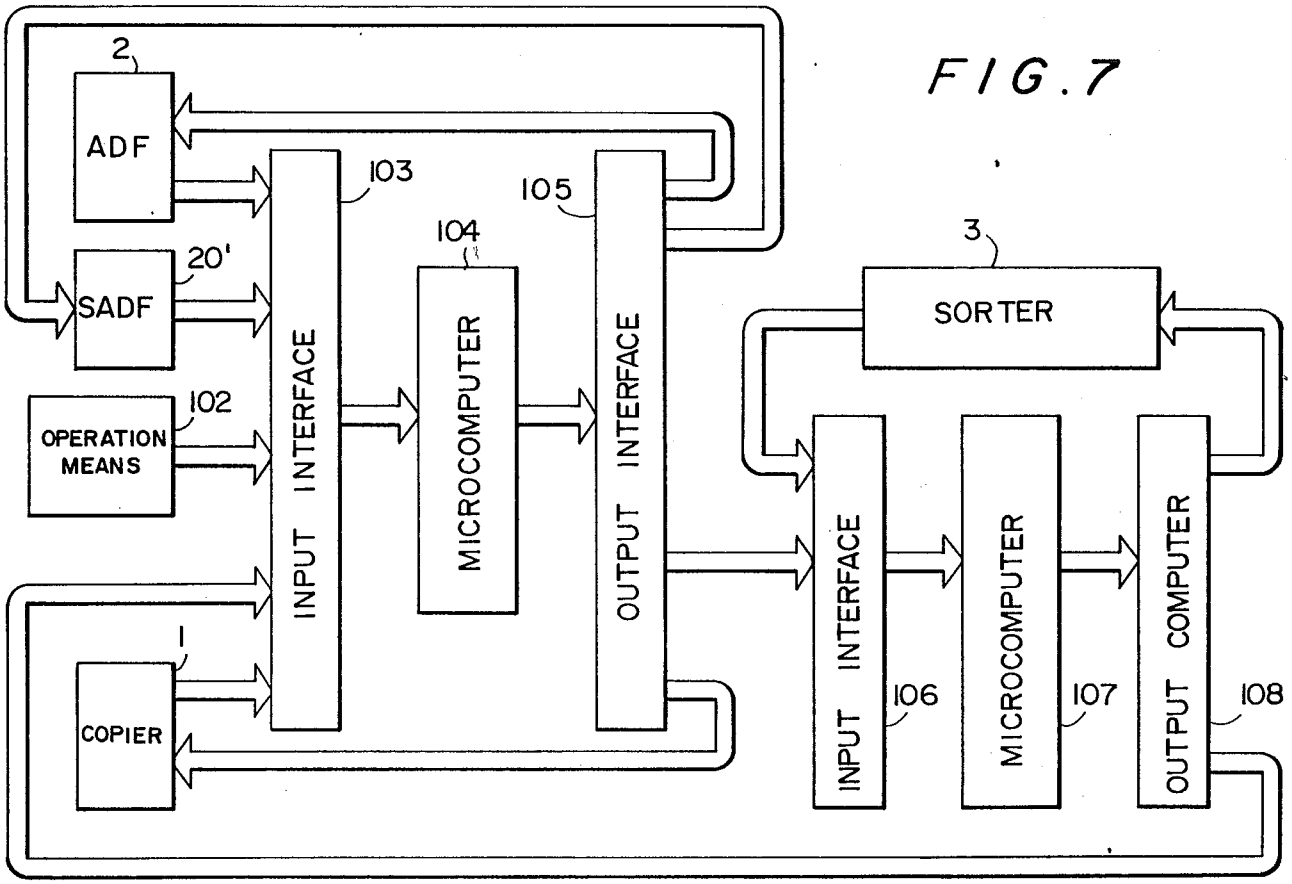
FIG. 7 is a block diagram of a control device included in the copier of FIG. 1.

Referring to FIG. 7, a control device associated with the copier of the present invention is schematically shown. Data entered through the power key 45, print key 47, ten keys 48, multi-job key 53 and others, which in combination constitute operation means 102, are applied to a microcomputer 104 via an input interface circuit 103. Also applied via the interface circuit 103 to the microcomputer 104 are data outputted from the various sensor means which are included in the ADF 2 and SADF 20' of the copier 1. An output interface circuit 105 of the microcomputer 104 is interconnected to the copier 1, ADF 2 and SADF 20'. The data from the output interface circuit 105 are also routed through an input interface circuit 106 to a microcomputer 107. Also applied through the input interface circuit 106 to the microcomputer 107 are data which are outputted from the sensor means installed in the sorter 3. An output interface circuit 108 of the microcomputer 107 is interconnected to the sorter 3 and the input interface circuit 103 of the microcomputer 104.

Figures 8, 8A:
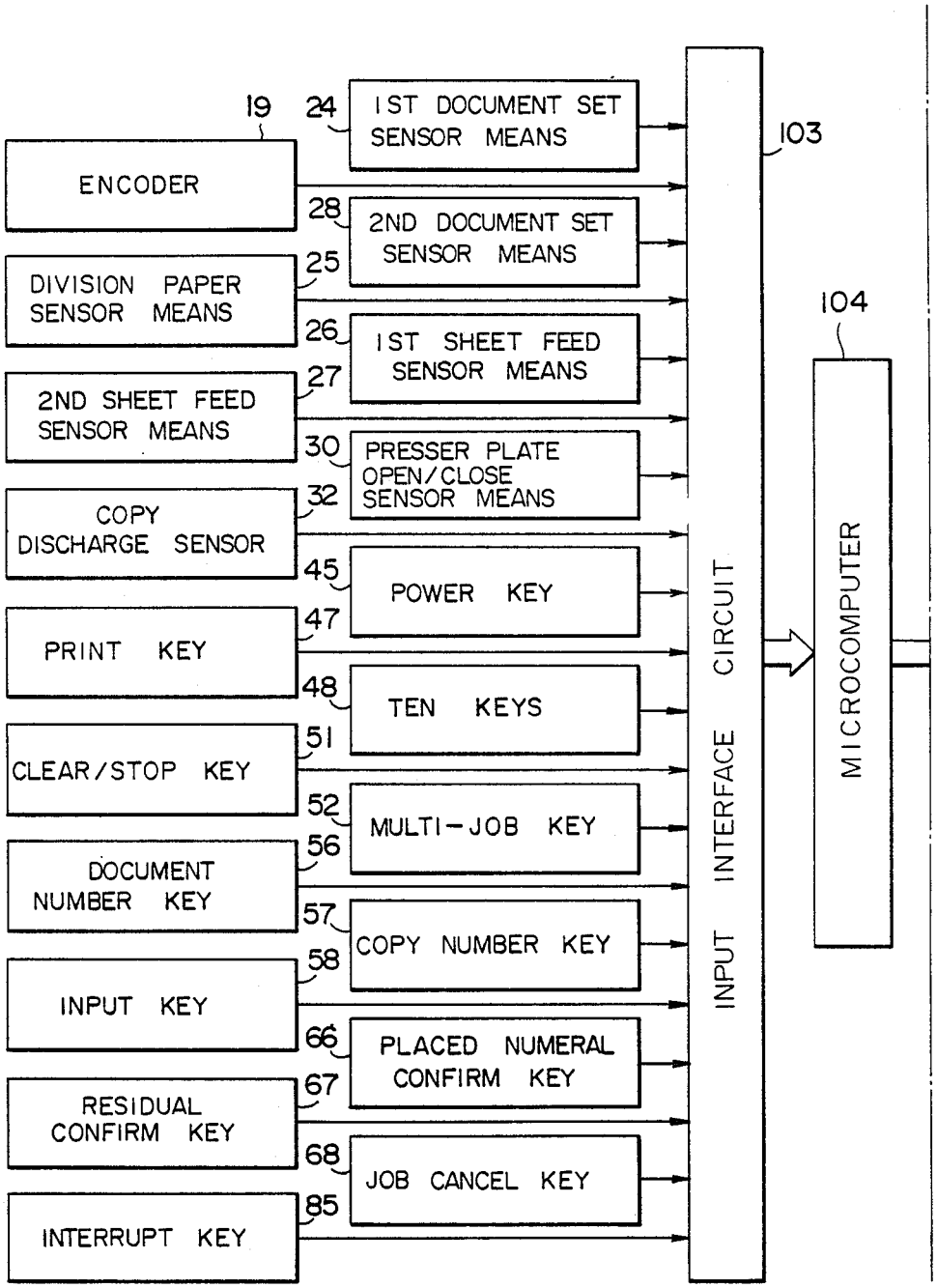
FIGS. 8, 8A, 8B and 9 are fragmentary block diagrams showing essential parts of the control device shown in FIG. 7.
Figure 8B:
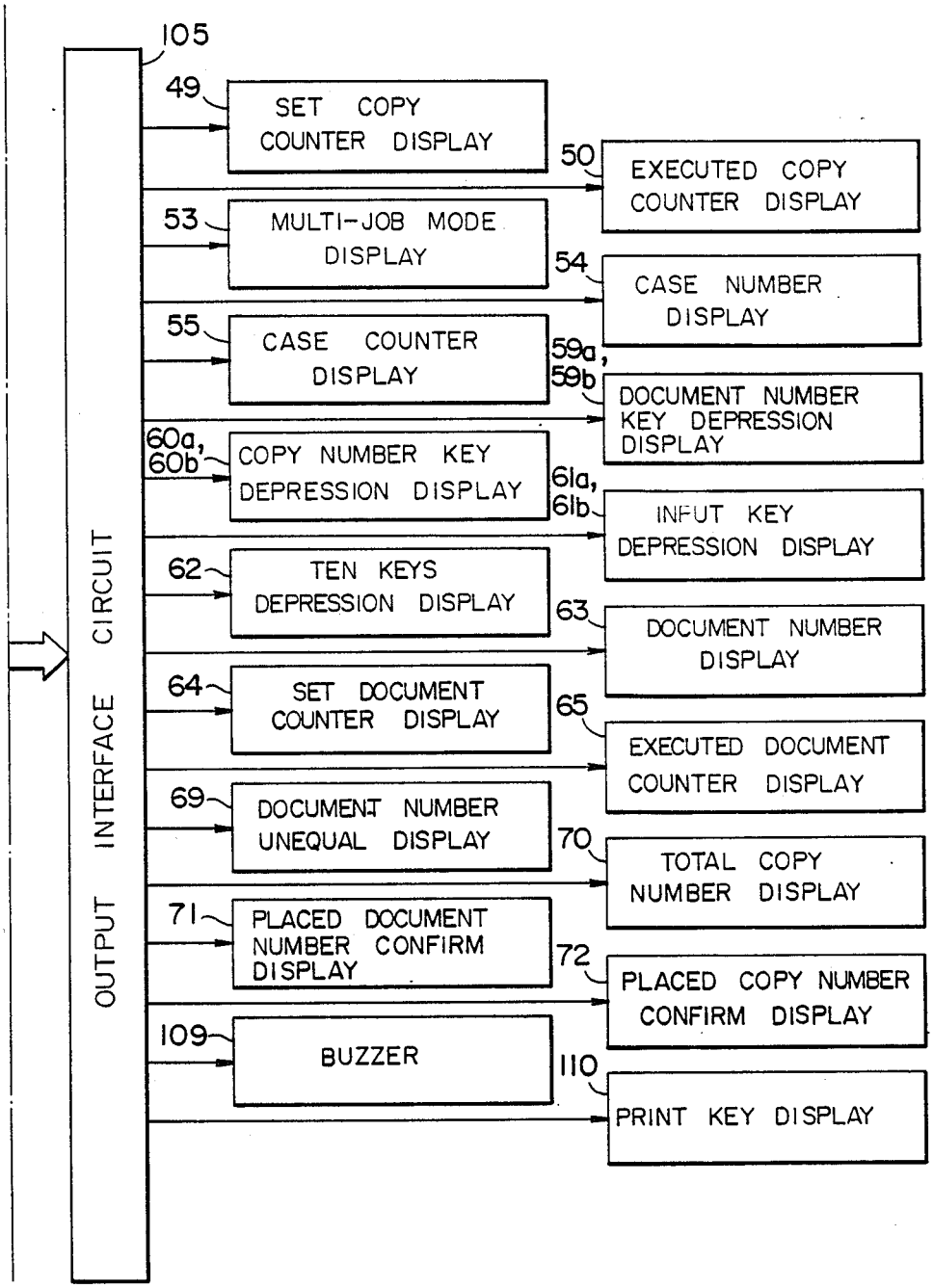

Referring to FIG. 8, there are shown in various sensor means and operation means for supplying data to the microcomputer 104 as well as various displays which are controlled by the microcomputer 104. Specifically, applied to the microcomputer 104 via the input interface 103 are the output data of the first document sensor means 24, encoder 19, second document sensor means 28, division paper sensor means 25, first paper sensor means 26, second paper sensor means 27, presser plate open/close sensor means 30, copy discharge sensor 32, power key 45, print key 47, ten keys 48, clear/stop key 51, multi-job key 52, document number key 56, copy number key 57, input key 58, placed numeral confirm key 66, residual confirm key 67, job cancel key 68, interrupt key 85, etc.

Interconnected to the output interface circuit 105 of the microcomputer 104 are the set copy number counter display 49, executed copy number counter display 50, multi-job mode display 53, case number display 54, case number counter display 55, document number key depression displays 60*a* and 60*b*, input key depression displays 61*a* and 60*b*, ten key depression display 62, document number display 63, set document number counter display 64, executed document number counter display 65, document number unequal display 69, total copy number display 70, document number confirm display 71, copy number confirm display 72, and a buzzer 109, a print key display 110, etc. The print key display 110 is implemented by a red light-emitting diode and a green light-emitting diode which are disposed below the print key 47; the print key 47 is illuminated in red when copying is impossible and in green when copying is possible.

Figure 9:
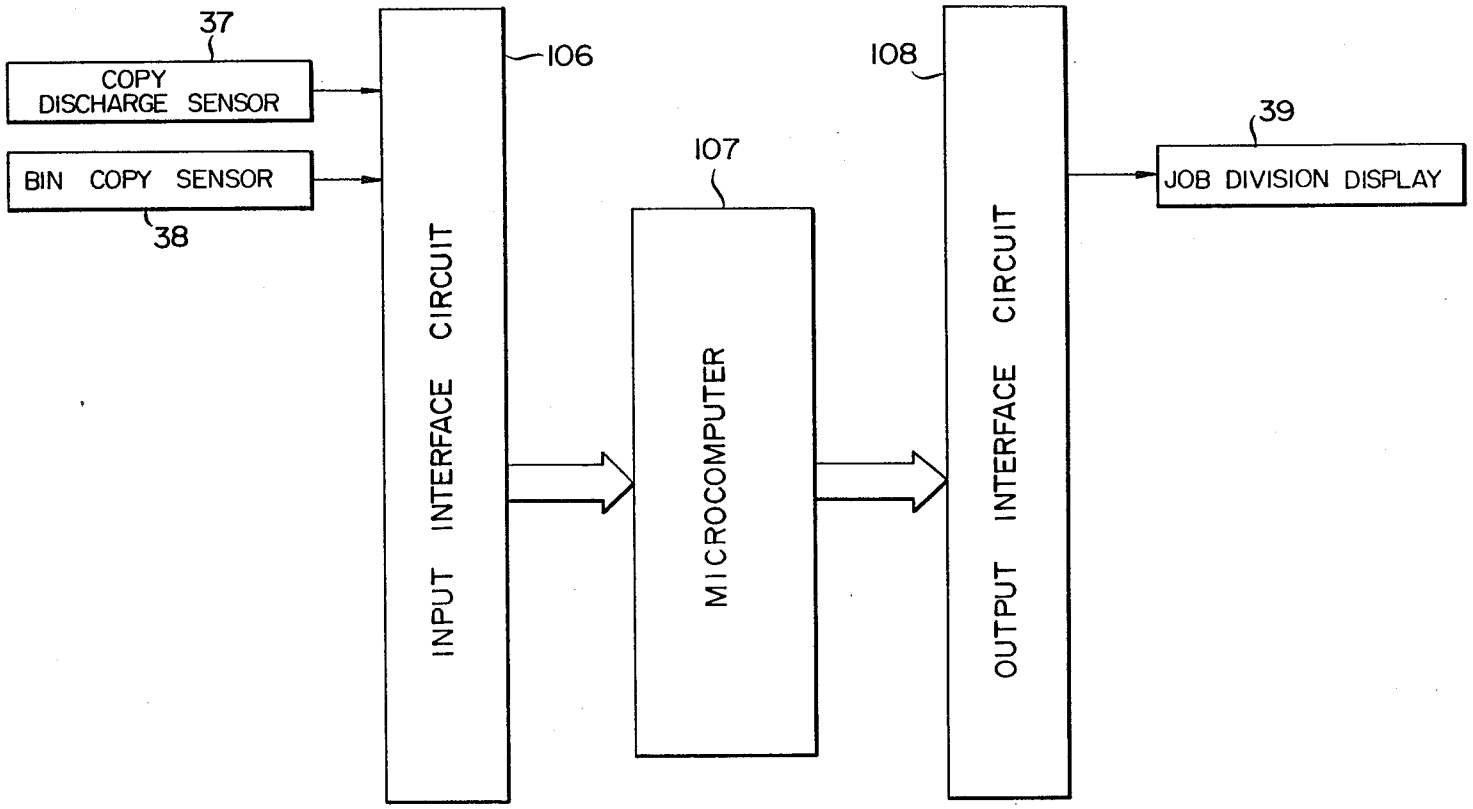

Referring to FIG. 9, major sensors which supply data to the microcomputer 107 and major displays which are controlled by the microcomputer 107 are shown. As shown, data outputted from the copy discharge sensor 37, bin paper sensor 38 and others are applied to the microcomputer 107 via the input interface 106. Interconnected to the output interface 108 of the microcomputer 107 are the job division display 39 and the like.

Reference will be made to FIGS. 6–9 for describing the conditions of the various keys and displays which are associated with a multi-job mode operation.

The multi-job key 52 is depressed when a multi-job mode is desired.

The document number key 56 is used to enter the number of documents per case in a multi-job mode. When the key 56 is depressed, the set document number counter display 64 flashes. Then, a numerical value inputted through the ten keys 48 is counted by the set document number counter which is built in the microcomputer 104 and is displayed on the set document number counter display 64. The numerical value entered through the ten keys 48 may be altered by depressing the clear/stop key 51 and, then, depressing the ten keys 48 to reenter a desired value.

The copy number key 57 is depressed to enter the number of copies per case in a multi-job mode. When the copy number key 57 is depressed, the set copy number counter display 49 flashes. Then a numerical value entered through the ten keys 48 is counted by the set copy number counter which is installed in the microcomputer 104 and is displayed on the set copy number counter display 49. Again, the value inputted through the ten keys 48 may be changed by depressing the clear/stop key 61 and, then, the ten keys 48.

The input key 58 is adapted to enter, in a multi-job mode, the contents of the set document number counter and set copy number counter into a random access memory (RAM) of the microcomputer 104.

The confirm key 66 is used to display for confirmation purpose the content of entered job in a multi-job mode. For example, assuming that the content being displayed is that of the first job (set number of documents and set number of copies), depression of the confirm key 66 will increment the displayed number of cases from "1" to "2" and cause the content of the second job to be read out of the RAM and displayed. Further, when the ten keys 48 are depressed to enter the number of a desired case, or job, with the confirm key 66 kept depressed, the entered value will appear on the case number display 54; when the the confirm key 66 is released, the content of the desired job will be displayed.

The residual confirm key 67 is used to display the number of documents and that of copies which can be entered in a multi-job mode. Only when the key 67 is depressed, the set document number counter display 64 displays the number of documents which can be entered, while the set copy number counter display 49 displays the number of copies which can be entered.

The job cancel key 68 fulfills four different functions as follows.

The first function is clearing the content of an entered job. Specifically, after the content of a job of a case number to be cleared has been displayed by means of the placed number confirm key 66, the key 68 is depressed to clear the content of the job of the particular case number and the contents of the following jobs are sequentially shifted.

The second function of the key 68 is, after the start of a copying operation, interrupting the operation during the course of a job and cancelling that job. As the key 68 is depressed while a copying operation is interrupted, the executed job counter is incremented by one so that the following depression of the print key 47 will cause the next job or jobs to be executed.

The third function of the key 68 is, after execution of all the jobs, clearing executed document number counters and copy number execution counters associated with all the jobs. When the key 68 is depressed after the execution of all the jobs, the executed document number counters and executed copy number counters associated with all the jobs are cleared. In this case, the set document number counters and set copy number counters associated with all the jobs are not cleared.

The fourth function of the key 68 is turning off the document number unequal display 69 after the latter has been turned on before execution of a copying operation, and turning off the display 69 after it has been turned on subsequently to a copying operation and, at the same time, incrementing the executed job counter by one.

The RAM of the microcomputer 104 is provided with a flag FG11 for detecting turn-on of the multi-job key 52, a flag FG12 indicative of a multi-job mode, a flag FG21 for detecting turn-on of the document number key 56, a flag FG22 showing whether document number data can be accepted, a flag FG31 for detecting turn-on of the copy number key 57, a flag FG32 showing whether copy number data can be accepted, a memory CTJBPT showing the case number of a particular job being displayed, a memory CTJBTC indicative of the largest case number of entered jobs, a memory CTJBPC indicative of the number of jobs which have been executed, a flag FG41 for detecting turn-on of the ten keys 48, a flag FG42 for detecting turn-on of the ten keys 48 while the placed numeral confirm key 65 is turned on, a flag FG51 for deciding whether the content of a job has been stored in a memory, a flag FG61 for detecting turn-on of the key 66, a memory CTCPZZ storing a residual of the number of copies, a memory CTORZZ storing a residual of the number of documents, a flag FG91 for detecting turn-on of the job cancel key 68, a flag FG111 for illuminating the print key 47 in red and, at the same time, inhibiting a copying operation when no document has been set or when the cover for the belt 2*c* (also functioning to press a document against the glass platen) has been opened, a flag FG112 for illuminating the print key 47 in red and inhibiting a copying operation when no document O has been set or when a job has been completed, a copy interrupt flag FG121 which is set upon interruption of a copying operation, a sort mode flag FG131 indicative of a sort mode, a stack mode flag FG132 indicative of a stack mode, a copy start flag FG132 for instructing the start of a copying operation, a flag FG151 indicative of the end of increment of the CTJBPC, a flag FG161 for detecting turn-on of the buzzer 109, an ADF mode flag AFG11 indicative of a document feed mode effected by the ADF 2 associated with the table 2*a* (hereinafter referred to as an ADF mode), an SADF mode flag SAFG12 indicative of a mode in which a manually inserted document O is fed from the table 20 by the SADF 20'(hereinafter referred to as an SADF mode), a document under-feed flag AFG13 showing that a feed operation in an ADF mode or an SADF mode is under way, a timing pulse counter TPC for counting output pulses of the encoder 19, a flag AFG21 for sensing the division papers d, a flag AFG22 for sensing the opening d1 of the partition sheets d, etc.

The RAM of the microcomputer 107 is provided with a flag SFG11 for detecting that papers P have been discharged into the bins 3*e* in the sorter 3, etc.

Figures 10, 10A:
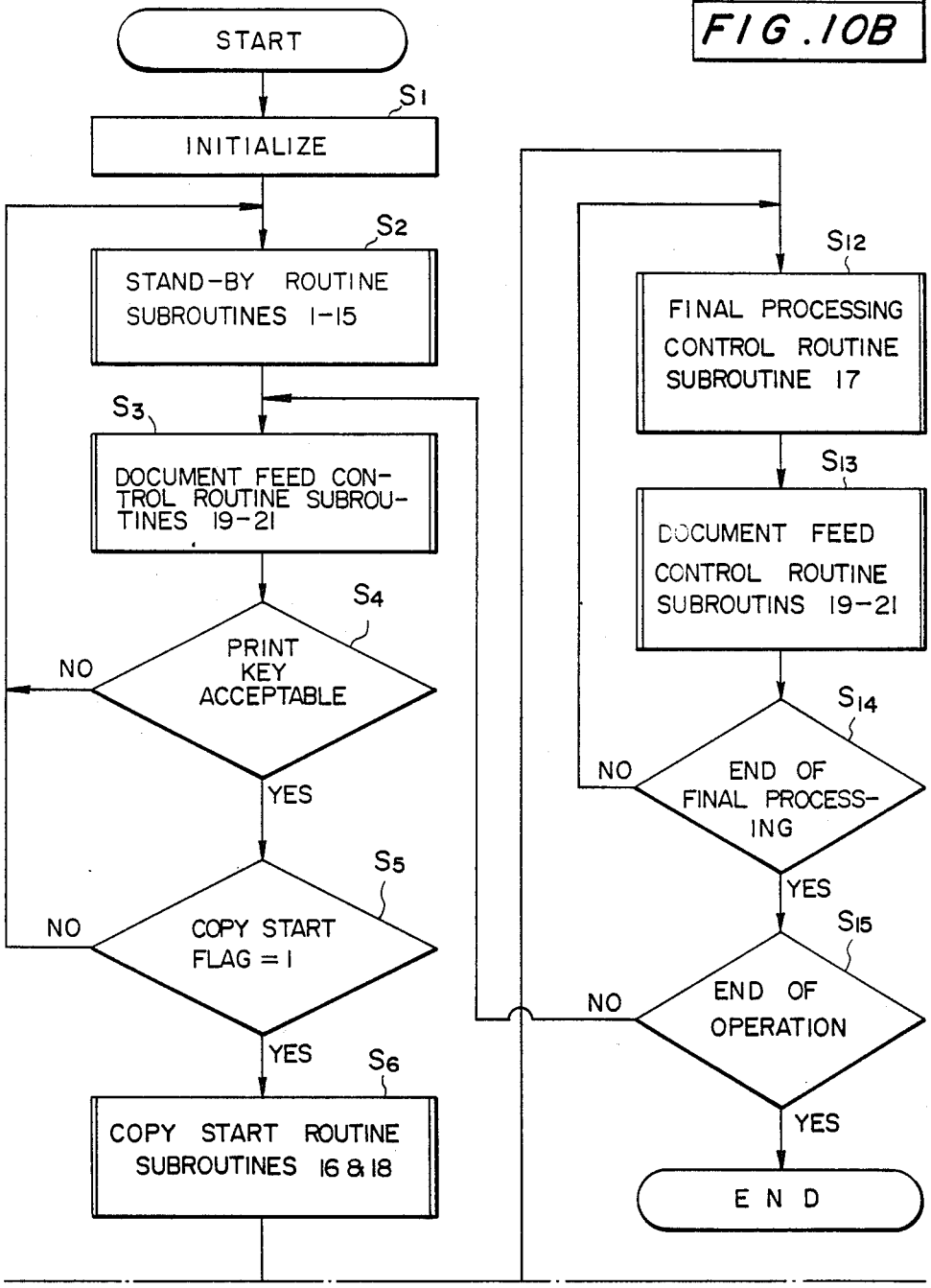
FIGS. 10-34 are flowcharts demonstrating operations of the copier of FIG. 1.
Figure 10B:
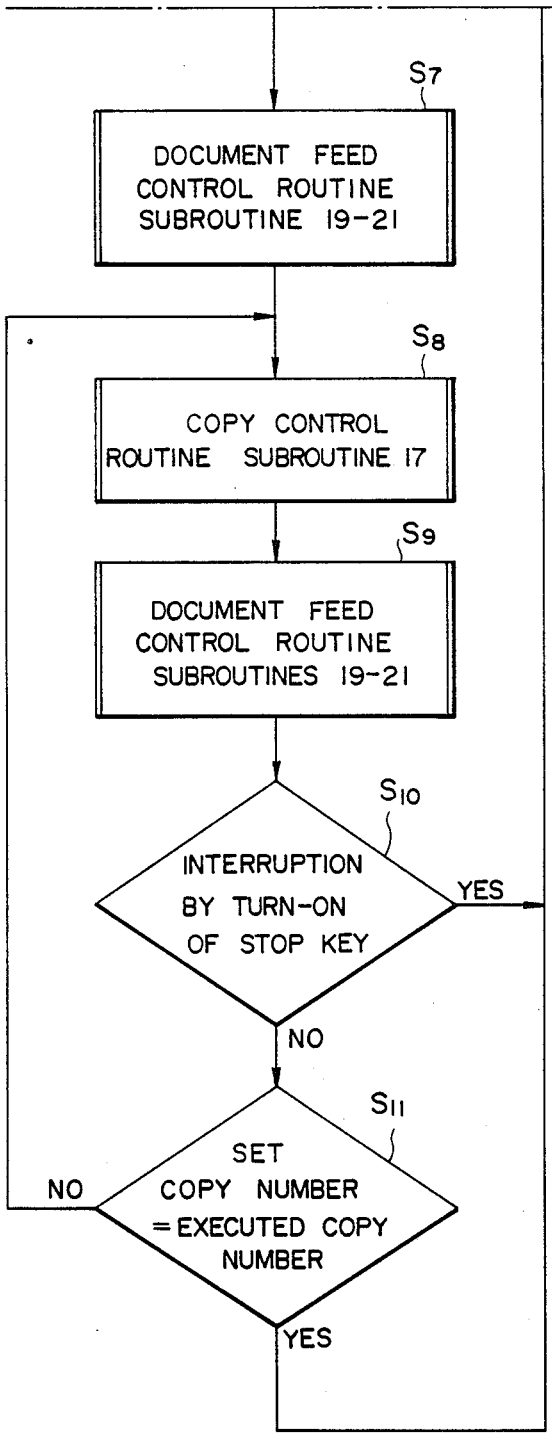

Referring to FIG. 10, the operations of the copier 1, ADF 2 and SADF 20' are shown in a flowchart. As the power key 45 is turned on, initialization occurs at a step $S_1$. Specifically, at the step $S_1$, the input interface and output interface 105 of the microcomputer 104 are cleared. The step $S_1$ is followed by a step $S_2$, i.e., stand-by routine which is made up of subroutines 1–15. The standby routine is followed by a control routine as represented by a step $S_3$ which comprises subroutines 19–21. At a step $S_4$, whether the print key 47 is ready to accept is determined and, at the next step $S_5$, whether the copy start flag FG141 is a ONE is determined. If the print key 47 is not ready to accept or if the copy start flag FG141 is not a ONE, the procedure returns to the step $S_2$. If the copy start flag FG141 is a ONE as decided at the step $S_5$, a copy start routine as represented by a step $S_6$ is performed. The copy start routine comprises subroutines 16 and 18. After a step $S_7$ which is a document feed control routine, a step $S_8$ is performed for a copy control routine, which comprises a subroutine 17. At a step $S_{10}$ which follows a step $S_9$, a document feed control routine, whether an interruption due to depression of a stop key has occurred is determined. If not, the operation advances to a step $S_{11}$ to see if the set number of copies for one document is equal to the executed number of copies. If the two numbers do not compare equal at the step $S_{11}$, the operation returns to the step $S_8$.

If an interruption due to turn-on of the stop key has been found at the step $S_{10}$ or the two numbers have compared equal at the step $S_{11}$, a final processing routine is performed as represented by a step $S_{12}$. The final processing routine comprises a subroutine 17.

At a step $S_{14}$ which follows a step $S_{13}$, a document feed control routine, whether the final processing has been completed is checked and, if not, the operation returns to the step $S_{12}$. If it has been completed, whether the end of operation has been reached is determined at a step $S_{15}$. If it has not, the operation returns to the step $S_3$.

Figure 11:
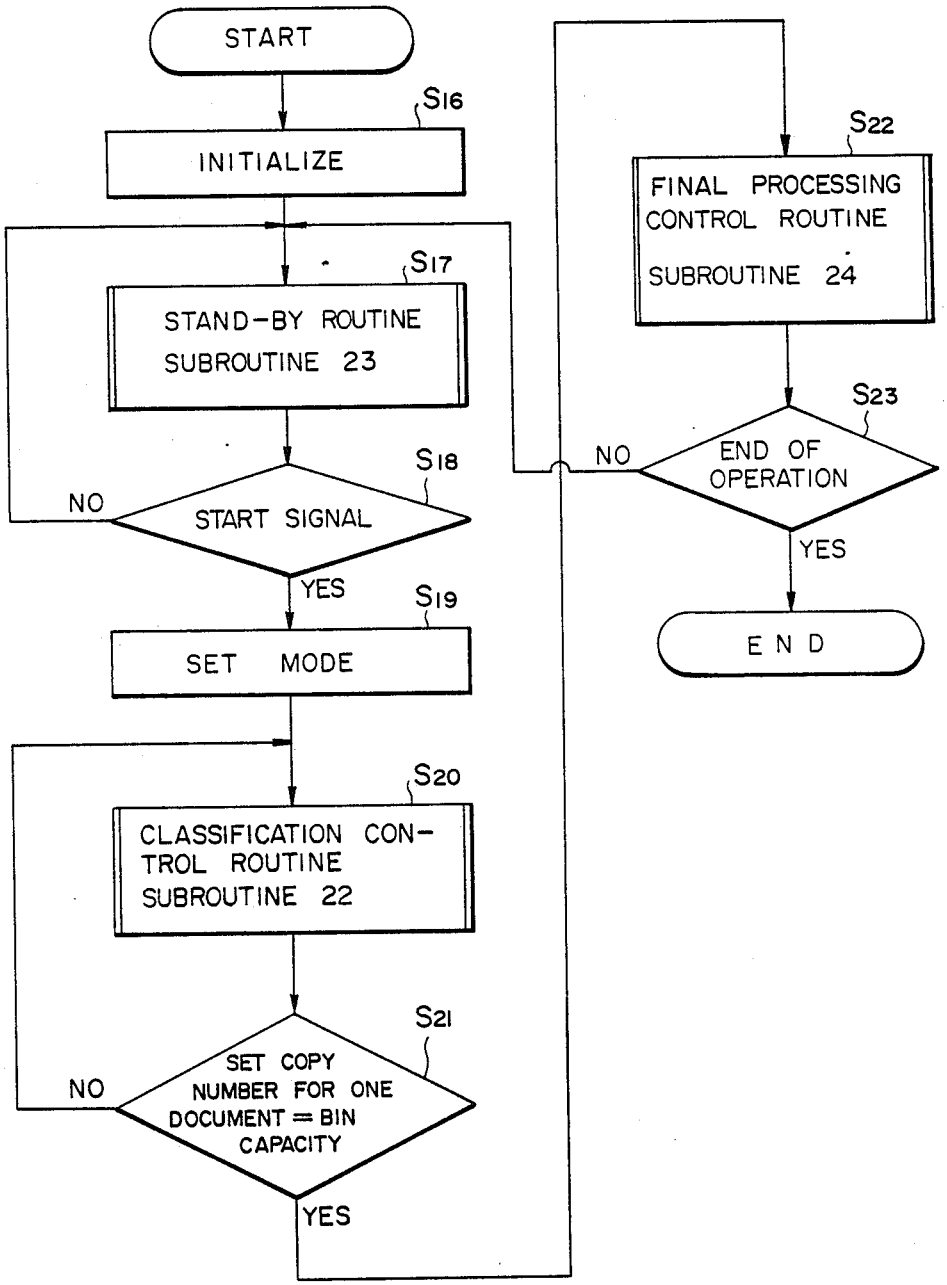

Referring to FIG. 11, the main routine of a flow which demonstrates the operation of the sorter 3 is shown. As the power key 45 is turned on, initialization occurs at a step $S_{16}$ so that the input interface circuit 106 and output interface circuit 108 of the microcomputer 107 are cleared. This is followed by a stand-by routine at a step $S_{17}$, which comprises a subroutine 23. Then, at a step $S_{18}$, presence/absence of a start signal is checked and, if absent, the operation returns to the step $S_{17}$. If a start signal has been found at the step $S_{18}$, either a sort mode or a stack mode is selected at a step $S_{19}$. The step $S_{19}$ is followed by a step $S_{20}$ for a classification control routine, which comprises a subroutine 22. Then, at a step $S_{21}$, whether the set number of copies for one document is equal to the number stored in the bins is determined. If not, the operation returns to the step $S_{20}$. If they compare equal, a final processing control routine is performed at a step $S_{22}$. The final processing control routine comprises a subroutine 24. Then, at a step $S_{23}$, whether the operation has ended is determined and, if not, the procedure returns to the step $S_{17}$.

Referring to FIGS. 12–34, subroutines associated with the main routines of the flow discussed above are shown.

Figure 12:
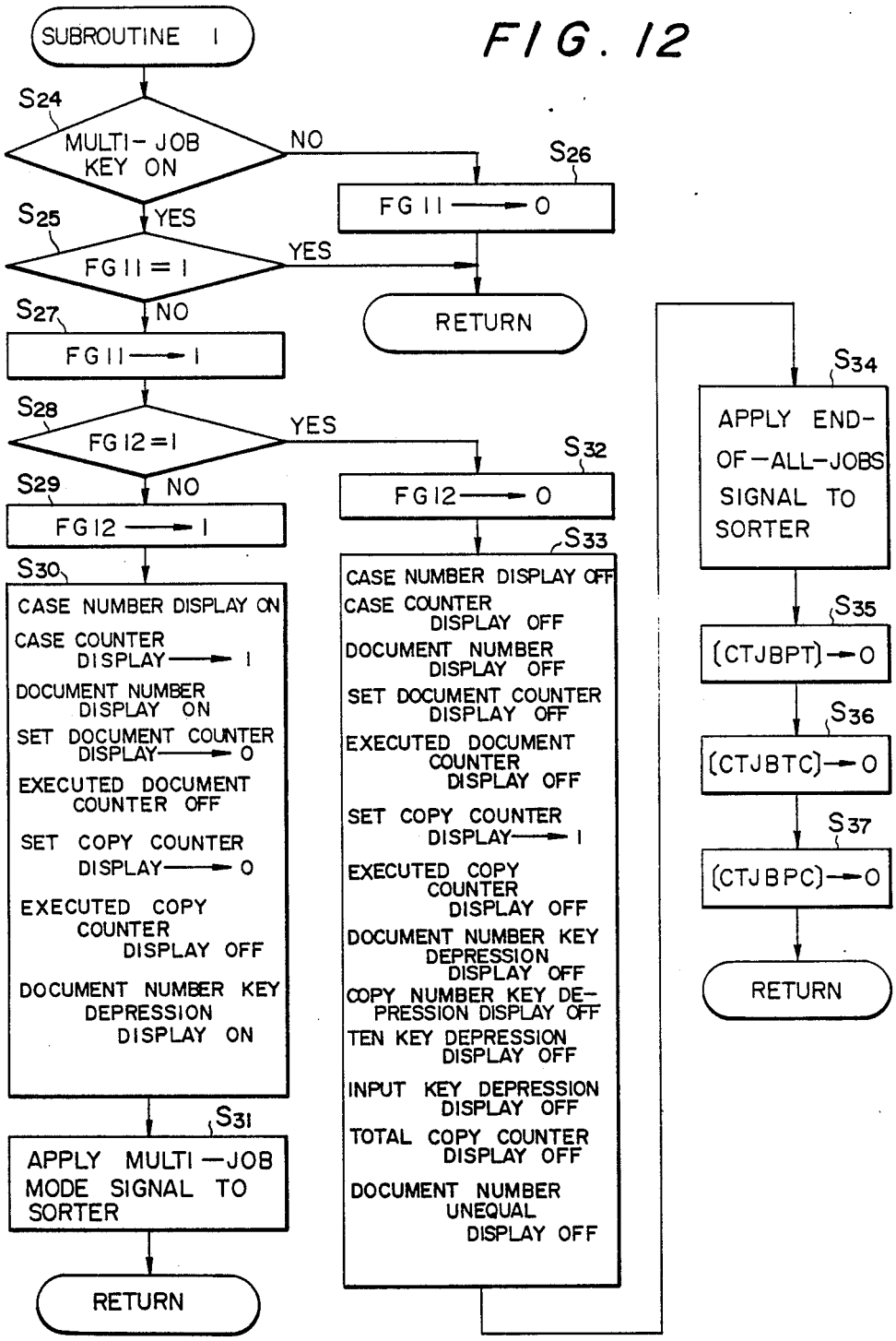

In FIG. 12, the subroutine 1 is shown which is included in the stand-by routine of the step $S_2$ and adapted for setting or resetting a multi-job mode. First, at a step $S_{24}$, whether the multi-job key 52 has been turned on is determined and, if it has, whether FG11=ONE is checked at a step $S_{25}$. If the key 52 has not been turned-on, the flag FG11 is turned to a ZERO and, then, the main routine is resumed (step $S_{26}$). If FG11=ONE at the step $S_{25}$, the operation also returns to the main routine. If FG11=ONE does not hold at the step $S_{25}$, the flag FG11 is turned to a ONE and, then, whether FG12=ONE is determined. If not, that is, in a multi-job mode, the flag FG12 is turned to a ONE (steps $S_{27}$–$S_{29}$) whereupon a step $S_{30}$ is performed. At the step $S_{30}$, the case number display 54 is turned on, the case counter display 55 is incremented to "1", the document number display 64 is turned on, the set document number counter display 64 is decremented to "0", the executed document number counter display 65 is turned off, the set copy number counter display 49 is decremented to "0", the executed copy number counter display 50 is turned off, and the document number key depression displays 59*a* and 59*b* are turned on. Then, at a step $S_{31}$, a multi-job mode signal is applied to the sorter 3 to return the operation to the main routine.

If FG 12=ONE at the step $S_{28}$, meaning that the mode is not a multi-job mode, the flag FG12 is turned to ZERO at a step $S_{32}$ which is followed by a step $S_{33}$. At this step $S_{33}$, the case number display 4, case number counter display 55, document number display 63, set document number counter display 64 and executed number counter display 65 are turned off, "1" is loaded in the set copy number counter display 49, and the executed copy number counter display 50, document number key depression displays 59*a* and 59*b*, copy number key depression displays 60*a* and 60*b*, ten keys depression display 62, input key depression displays 61*a* and 61*b*, total copy number display 70 and document number unequal display 69 are turned off. Thereafter, at a step $S_{34}$, an end-of-all-jobs signal indicative of the end of all the jobs is applied to the sorter 3, "0" is loaded in the CTJBPT, CTJBTC and CTJBPC (steps $S_{35}$–$S_{37}$), and the operation returns to the main routine.

Figures 13, 13A:
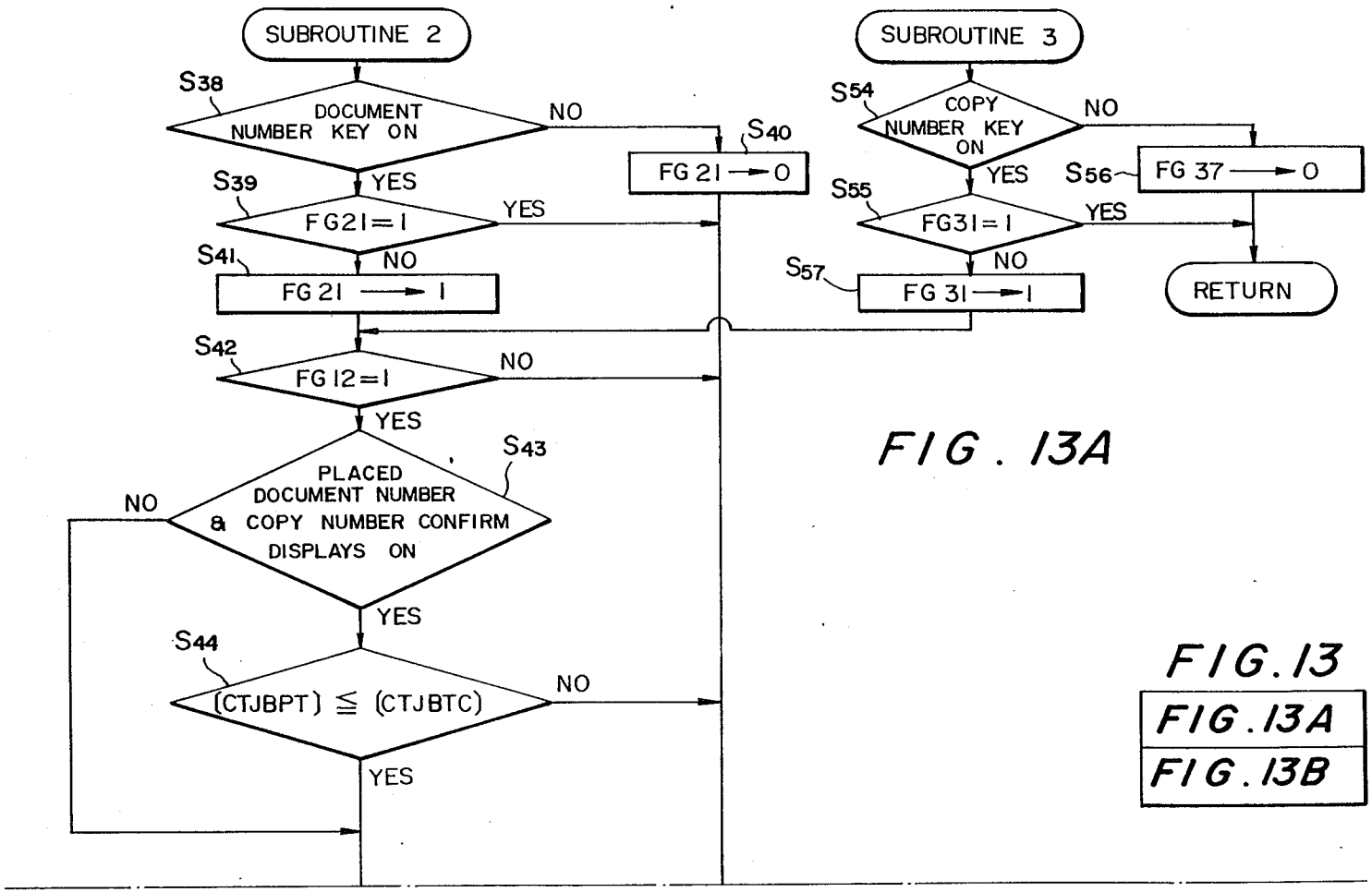
Figure 13B:
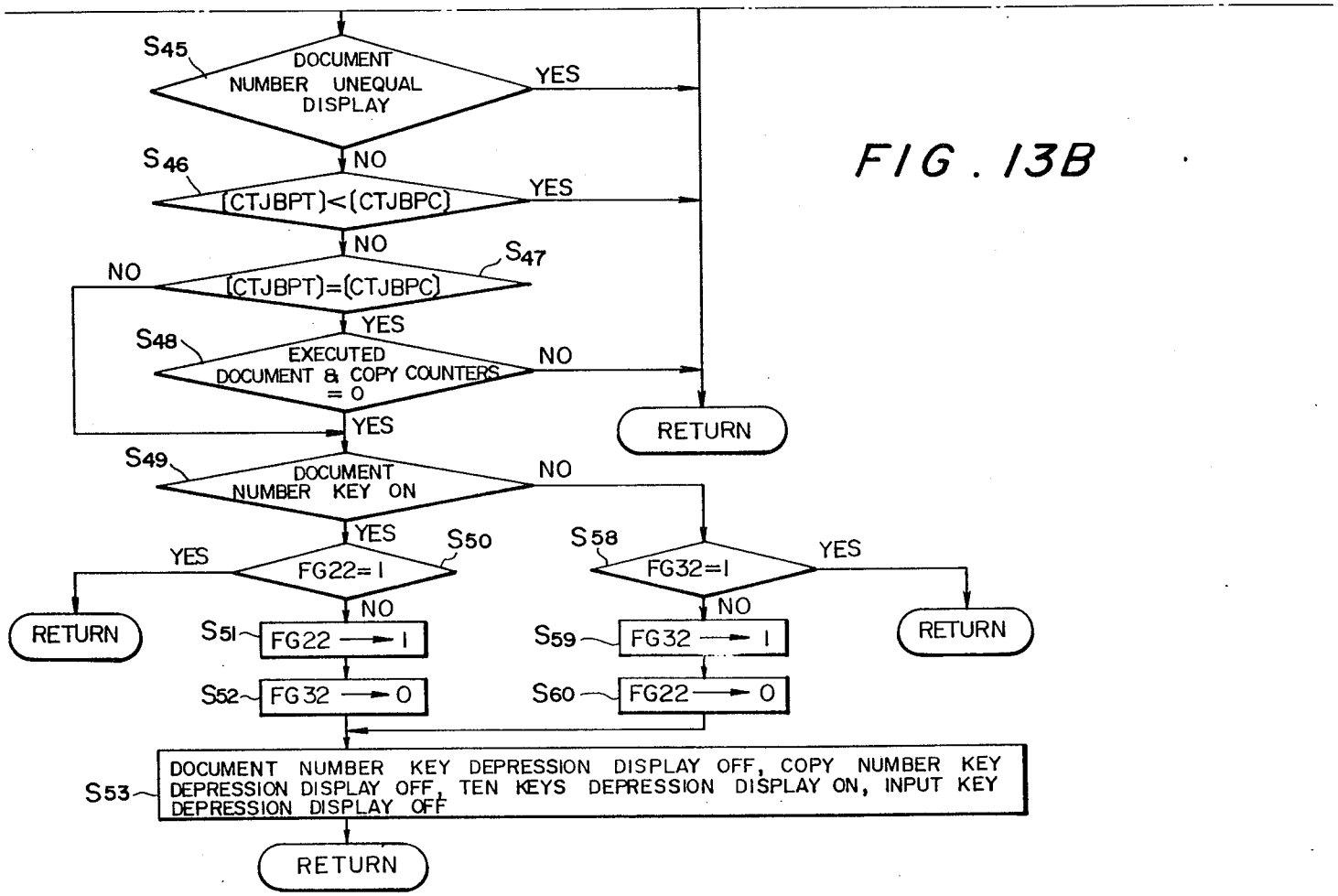

In FIG. 13, the subroutines 2 and 3 are shown which are included in the stand-by routine of the step $S_2$ and adapted to accept the document number key 56 and the copy number key 67, respectively. First, at a step $S_{38}$, whether the document number key 56 has been turned on is determined and, if it has, then whether FG21=ONE is determined at a step $S_{39}$. If the key 56 has not been turned on, the flag FG21 is turned to a ZERO at a step $S_{40}$ so that the operation returns to the main routine.

If not FG21=ONE as determined at the step $S_{39}$, the flag FG21 is turned to a ONE at a step $S_{41}$ and, at a step $S_{42}$, whether FG12=ONE is decided. If not, meaning a mode other than a multi-job mode, the main routine is resumed. If FG12=ONE, meaning a multi-job mode, whether the document number confirm display 71 and copy number confirm display 72 have been turned on is checked at a step $S_{43}$. If they have, whether [CTJBPT]≦[CTJBTC] is checked at a step $S_{44}$. [CTJBPT] represents the case number of a job currently displayed, while [CTJBTC] represents the largest case number which has been entered. If the displays 71 and 72 have been turned on, no more data than those already entered can be entered and only the modifications to the entered job data can be accepted. Hence, if [CTJBPT]≦[CTJBTC] does not hold, the operation returns to the main routine.

If the displays 71 and 72 have not been turned on as decided at the step $S_{43}$ or if [CTJBPT]≦[CTJBTC] as decided at the step $S_{44}$, whether the document number unequal display 69 has been turned on is determined at a step $S_{45}$ and, if it has, the main routine is resumed. If the display 69 has not been turned on, whether [CTJBPT]<[CTJBPC] is determined at a step $S_{46}$. Here, [CTJBPC] represents the number of jobs which have been executed. Since it is unnecessary to enter data for those jobs which have been executed, the operation returns to the main routine if [CTJBPT]<[CTJBPC]. If not [CTJBPT]<[CTJBPC], whether [CTJBPT]=[CTJBPC] is decided. If not, the job has not been executed yet and, therefore, entry of the set document number is accepted. If [CTJBPT]=[CTJBPC], whether the exected document number counter and the copy number counter are each "0" is decided at a step $S_{48}$ and if, not, then the operation returns to the main routine because the copying operation has already been started. If the executed document number counter and executed copy number counter are each "0", the set document number is accepted because the copying operation has not been started yet.

At a step $S_{49}$, whether the document number key 56 has been turned on is decided and, if it has, then whether FG22=ONE is checked (step $S_{50}$). If so, the operation returns to the main routine because the document number key 56 has already been depressed. If not FG22=ONE, the flag FG22 is turned to a ONE and the flag FG23 to a ZERO, whereafter the ten key depression display 62 is turned on and the document number key depression displays 59*a* and 59*b*, copy number key depression displays 60*a* and 60*b* and input key depression displays 61*a* and 61*b* are turned off (steps $S_{51}$–$S_{53}$).

The subroutine 3, on the other hand, starts with deciding whether the copy number key 57 has been turned on, at a step $S_{54}$. If it has, whether FG31=ONE is checked at a step $S_{55}$. If the key 57 has not been turned on, the flag FG31 is turned to a ZERO at a step $S_{56}$ and, then, the operation returns to the main routine. If FG31=ONE as decided at the step $S_{55}$, the main routine is resumed. If not FG31=ONE, the flag FG31 is turned to a ONE at a step $S_{57}$ whereupon the operation advances to a step $S_{42}$. This is followed by the steps $S_{43}$–$S_{49}$ as in the previously described subroutine 2. Since the key 56 has not been turned on at the step $S_{49}$, a step $S_{58}$ is performed to see if FG32=ONE. If FG32=ONE, the operation returns to the main routine. If not, the flag FG32 is turned to a ONE and the flag FG22 to a ZERO (steps $S_{59}$ and $S_{60}$), followed by the step $S_{53}$.

Figures 14, 14A:
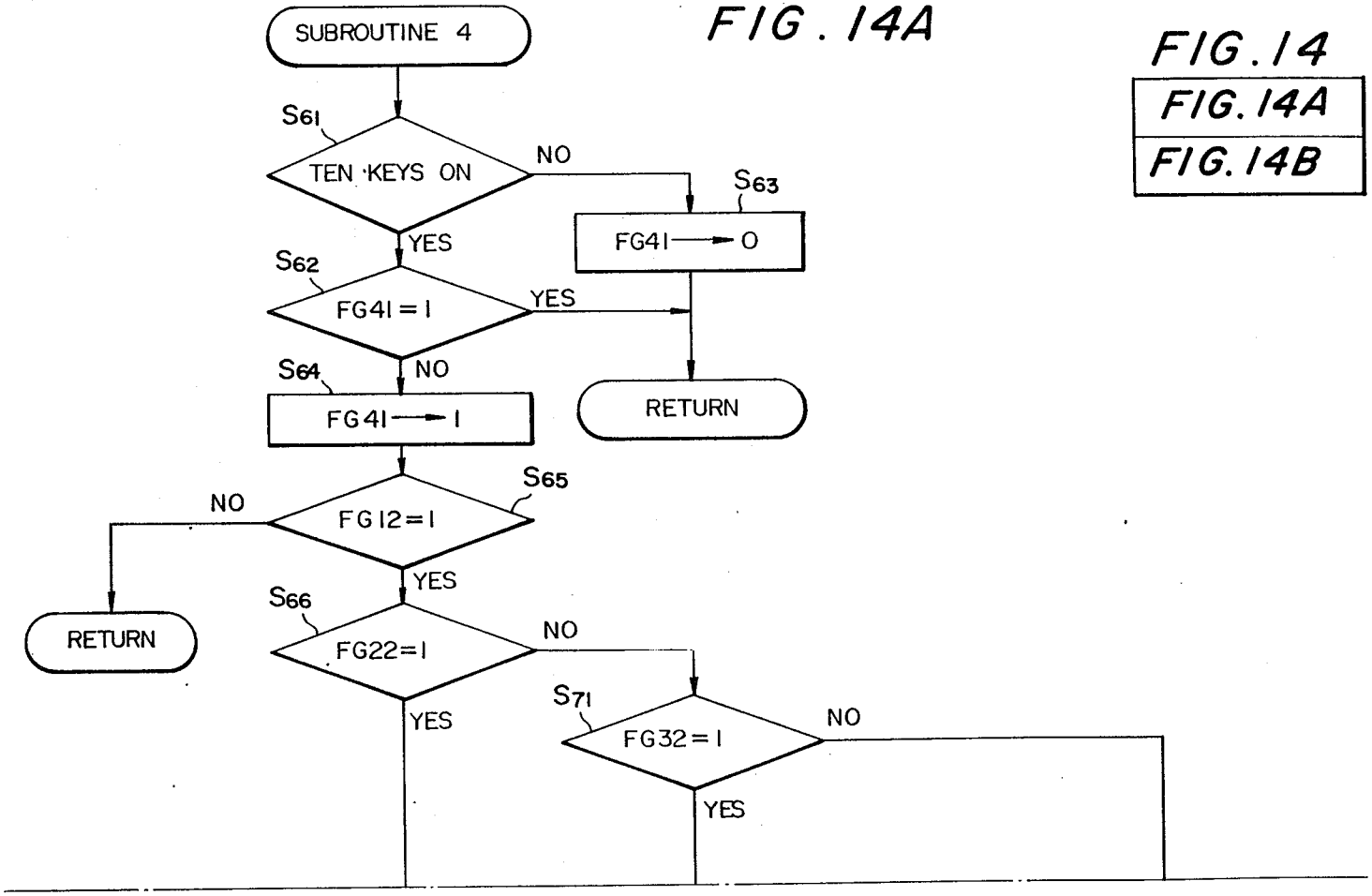
Figure 14B:
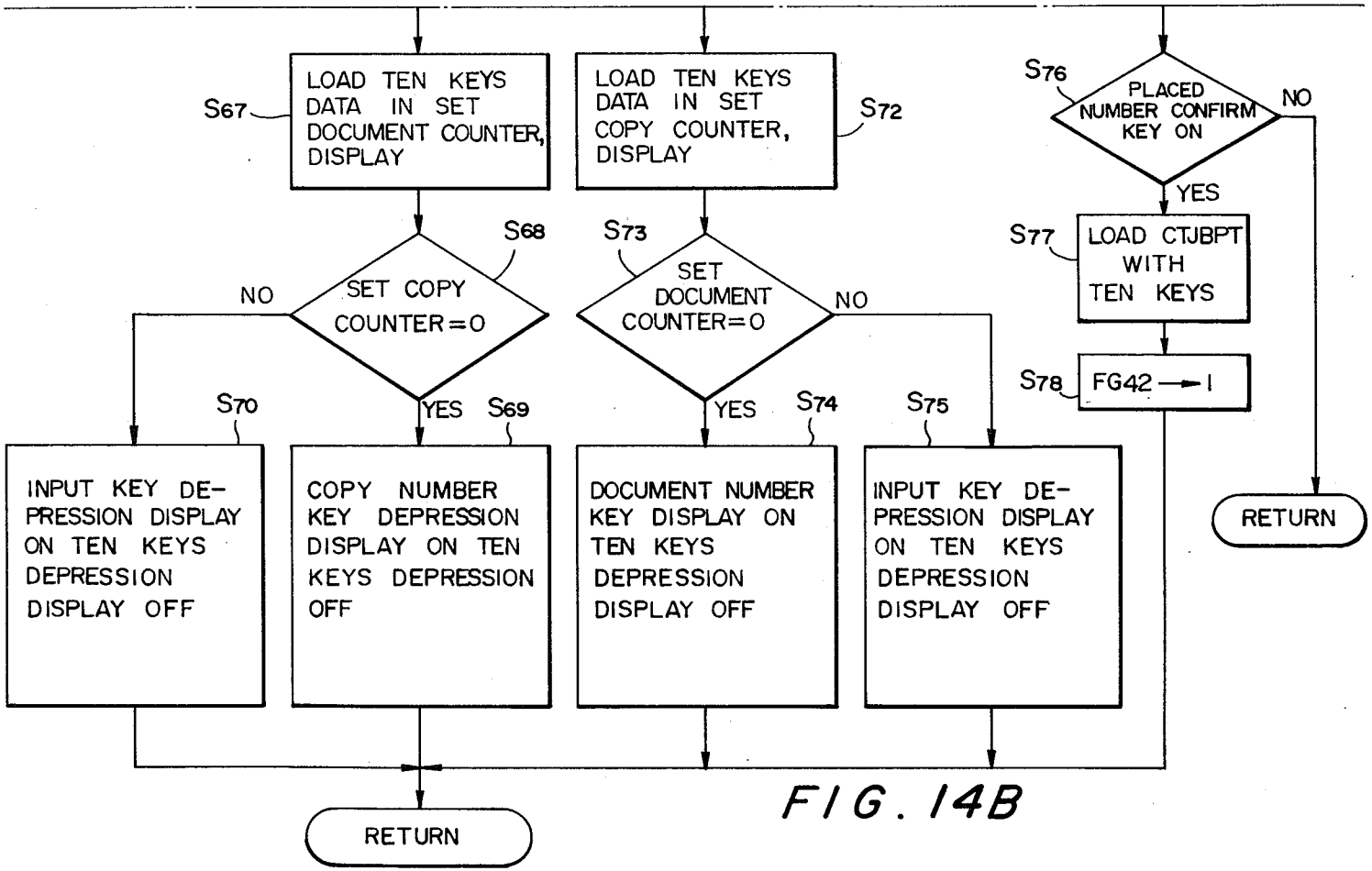

Referring to FIG. 14, the subroutine 4 is shown which is included in the stand-by routine of the step $S_2$ and adapted to accept the ten keys 48. The subroutine 4 starts with seeing if the ten keys 48 have been turned on, at a step 61. If they have, whether FG41=ONE is decided at a step $S_{62}$. If they have not been turned on, the flag FG41 is turned to a ZERO at a step $S_{63}$ and, then, the operation returns to the main routine. If FG41=ONE, the operation also returns to the main routine.

If not FG41=ONE as decided at the step 62, the flag FG41 is turned to a ONE and whether FG12=ONE is decided (steps $S_{64}$ and $S_{65}$). If not FG12=ONE, meaning a mode other than a multi-job mode, the operation returns to the main routine. If FG12=ONE, whether FG22=ONE is checked and, if so, data entered through the ten keys 48 is entered into the set document number counter and displayed (steps $S_{65}$–$S_{67}$). Then, at a step $S_{68}$, whether [set copy number counter]=0 is decided and, if so, the copy number key depression displays 60*a* and 60*b* are turned on and the ten keys depression display 62 is turned off (step $S_{69}$), whereupon the operation returns to the main routine. If not [set copy number counter]=0, the input key depression displays 61*a* and 61*b* are turned on and the ten keys depression display 62 is turned off (step $S_{70}$) and, then, the operation returns to the main routine.

If not FG22=ONE as decided at the step $S_{66}$, whether FG32=ONE is decided at a step $S_{71}$. If FG32=ONE, data associated with the ten keys 48 is entered into the set copy number counter and displayed and whether [set document number counter]=0 is determined (steps $S_{72}$ and $S_{73}$). If [set document number counter]=0, the document number key depression displays 59*a* and 59*b* are turned on and the ten keys depression display 62 is turned off (step $S_{74}$), whereupon the operation returns to the main routine. If not [set document number counter]=0, the input key depression displays 61*a* and 61*b* are turned on and the ten keys depression display 62 are turned off (step $S_{75}$), followed by the main routine.

If not FG32=ONE as decided at the step $S_{71}$, whether the confirm key 66 has been turned on is determined at a step $S_{76}$ and, if not, the operation returns to the main routine. If it has been turned on, data associated with the ten keys 48 is entered into the CTJBPT to turn the flag FG42 to a ONE (steps $S_{77}$ and $S_{78}$), followed by the main routine.

Figure 15B:
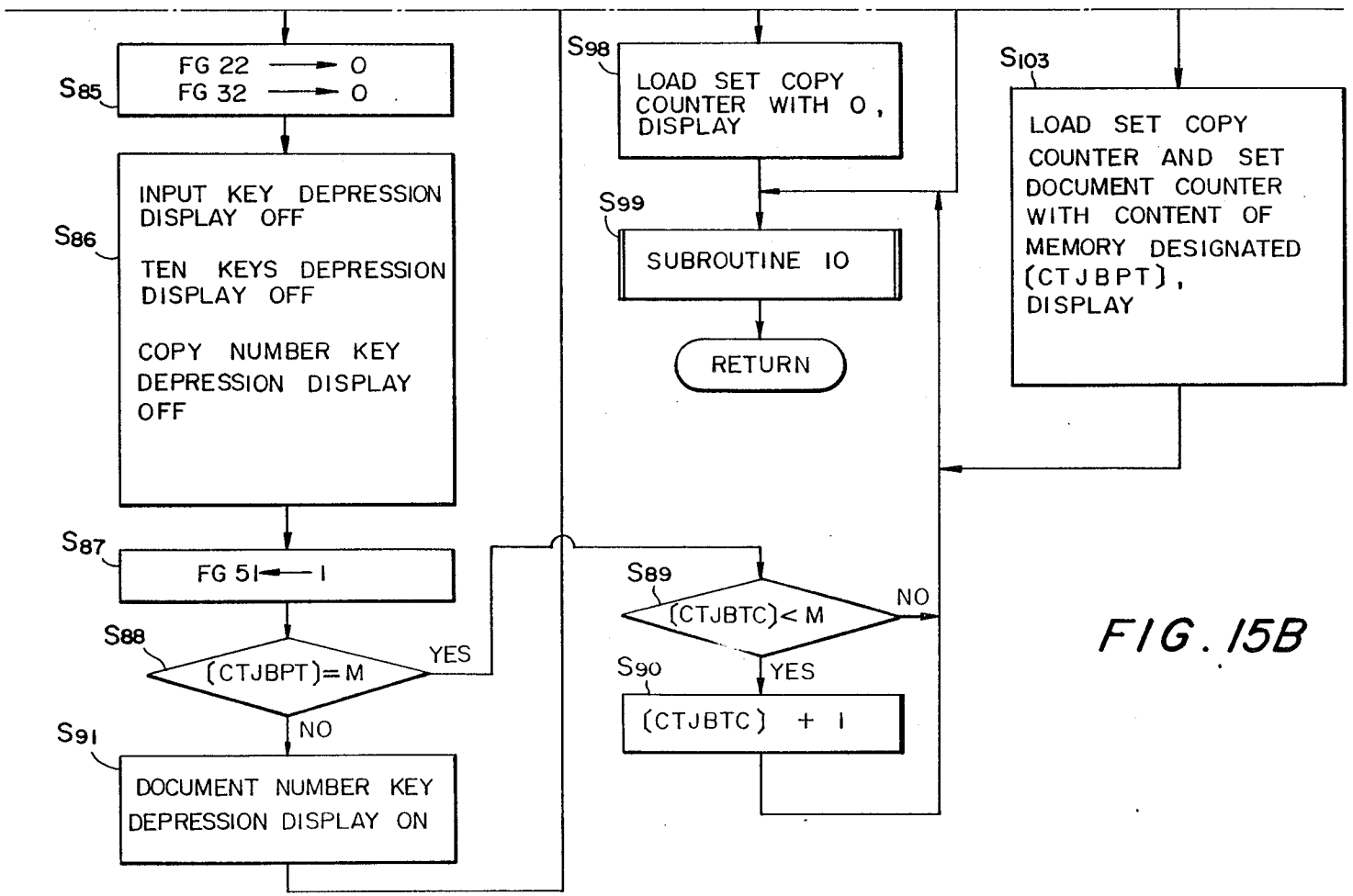

Referring to FIG. 15, the subroutine 5 is shown which is included in the stand-by routine of the step $S_2$ and adapted to accept the input key 58. The subroutine starts with determining whether the input key 58 has been turned on at a step $S_{79}$. If not, the operation returns to the main routine. If it has been turned on, whether FG22=ONE is checked and, if so, whether [set copy number counter]=0 is decided (steps $S_{80}$ and $S_{81}$). If not FG22=ONE, whether FG32=ONE is checked at a step $S_{82}$ and, if so, the step $S_{81}$ follows; if not, the main routine is resumed.

If [set copy number counter]=0 does not hold as decided at the step $S_{81}$, whether [set document number counter]=0 is checked at a step $S_{83}$. If [set copy number counter]=0 or if [set document number counter]=0, the operation returns to the main routine.

If not [set copy number counter]=0 and [set document number counter]=0, the count of the set copy number counter and that of the set document number counter are loaded in a memory which is designated by [CTJBPT] and displayed (step $S_{84}$). Then, the flags FG22 and FG32 are each turned to a ZERO and the input key depression displays 61*a* and 61*b*, ten keys depression display 62 and copy number key depression displays 60*a* and 60*b* are turned off (steps $S_{85}$ and $S_{86}$). This is followed by turning the flag FG51 to a ONE and, then, checking whether [CTJBPT]=M (steps $S_{87}$ and $S_{88}$). Here, M represents the largest case number which can be entered in a multi-job mode. If [CTJBPT]=M, whether [CTJBTC]<M is decided (step $S_{89}$). If not, that is, if the largest case number entered is greater than M, no more job data can be entered so that the operation returns to the main routine by way of the subroutine 10 at a step $S_{99}$. If [CTJBTC]<M as decided at the step $S_{89}$, meaning that job data can be entered, [CTJBTC] is incremented by one at a step $S_{90}$ whereafter the operation returns to the main routine through the subroutine 10.

If not [CTJBPT]=M as determined at the step $S_{88}$, meaning a condition wherein available job case areas still exist, the document number key depression displays 59*a* and 59*b* are turned on and, then, whether [CTJBPT]>[CTJBTC] is checked (steps $S_{91}$ and $S_{92}$). This is to decide whether the job being displayed has already been entered. If [CTJBPT]>[CTJBTC], meaning that the job being displayed has not been entered yet, the value of the CTJBPT is entered into the CTJBTC and then whether the document number confirm display 71 or the copy number confirm display 72 has been turned on is decided by way of the subroutine 7 (steps $S_{93}$–$S_{95}$).

If not the display 71 or 72 has not been turned on, meaning a condition wherein jobs can be entered, [CTJBPT] is incremented by one, "0" is loaded in the set document number counter and displayed, and "0" is loaded in the set copy number counter and displayed, whereafter the operation returns to the main routine through the subroutine 10 (steps $S_{96}$–$S_{99}$). If the display 71 or 72 has been turned on as decided at the step $S_{95}$, implying that a job cannot be entered, the operation returns to the main routine through the subroutine 10.

If not [CTJBPT]>[CTJBTC] as decided at the step $S_{92}$, meaning that the job being displayed has already been entered, whether the display 71 or 72 has been turned on is decided through the subroutine 7 (steps $S_{100}$ and $S_{101}$). If either the display 71 or the display 72 has been turned on, meaning that no job can be entered, the operation returns to the subroutine via the subroutine 10 of the step $S_{99}$. If the display 71 or 72 has not been turned on, [CTJBPT] is incremented by one at a step $S_{102}$, then a content of the memory which is designated by the resulting [CTJBPT] is loaded in the set copy number counter and the set document number counter and displayed, and then the operation returns to the main routine by way of the subroutine 10.

As described above, when the input key 58 is turned on, not only the data associated with a job being displayed is entered into the memory but also preparation is made to allow data associated with the next job to be entered.

Figures 16, 16A:
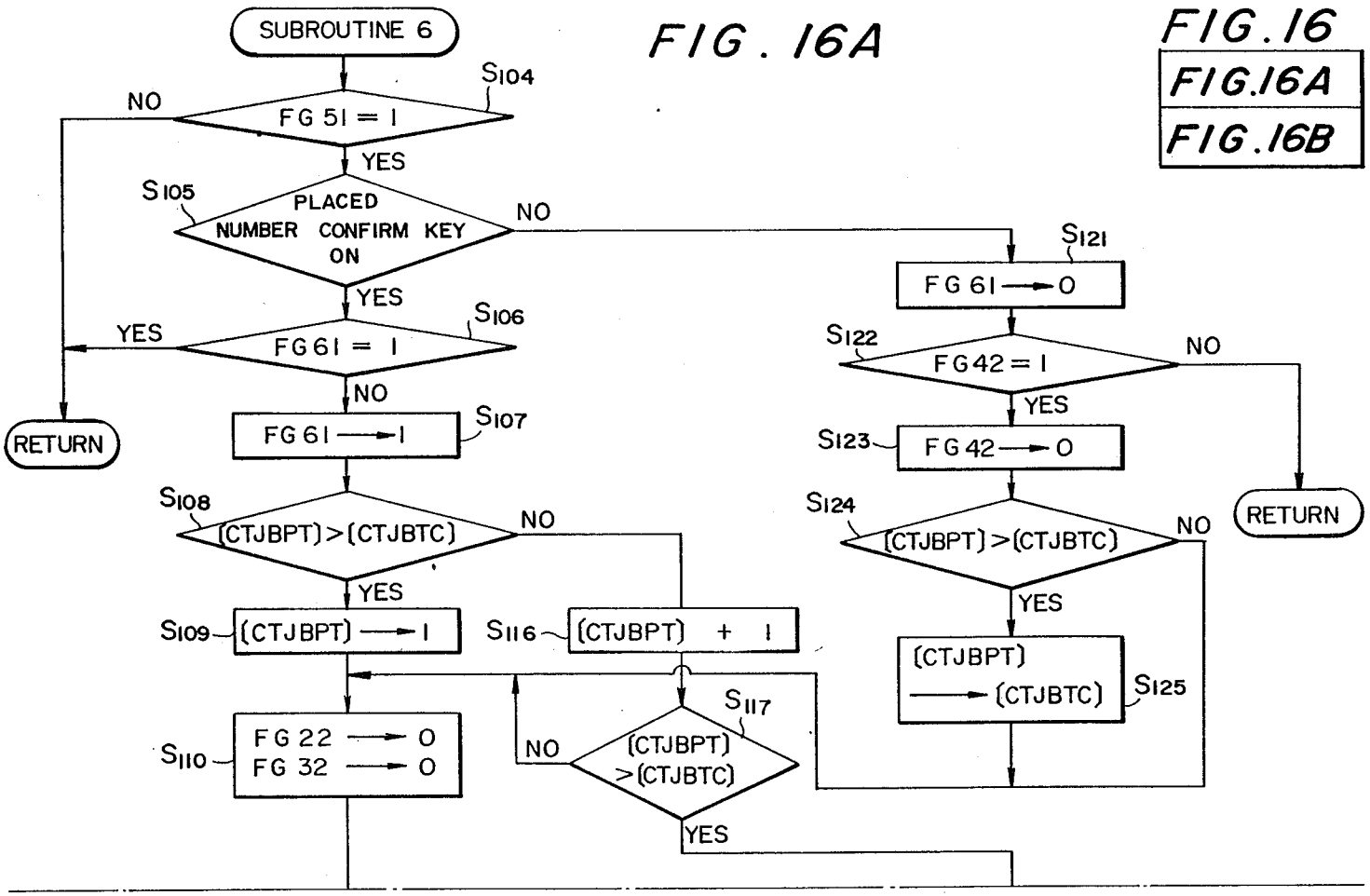
Figure 16B:
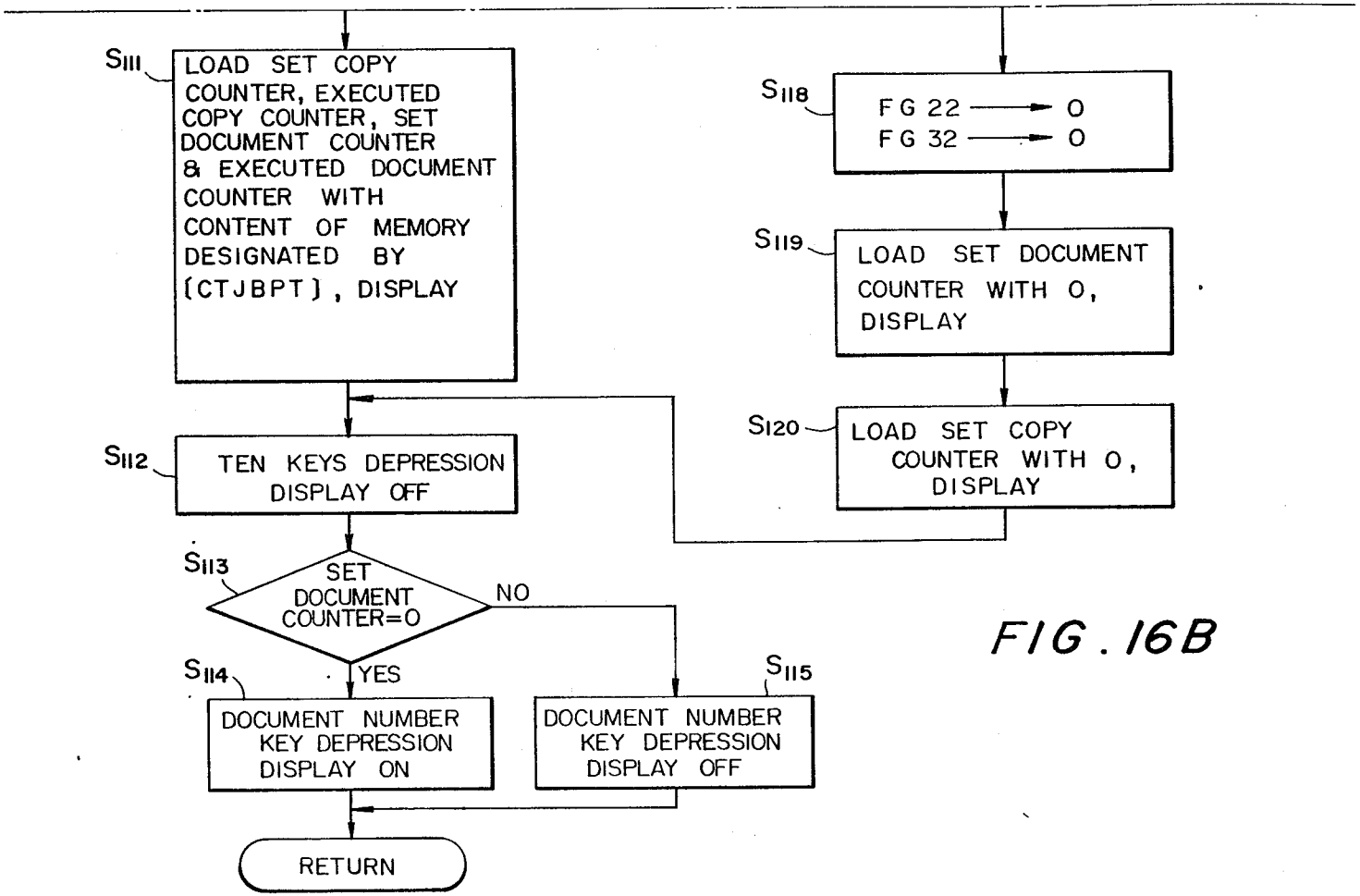

Referring to FIG. 16, the subroutine 6 is shown which is included in the stand-by routine of the step $S_2$ and adapted to accept the placed numeral confirm key 66. First, at a step $S_{104}$, whether FG51=ONE, that is, whether any job has already been entered is determined. If not, it is meaningless to turn on the key 66 and, hence, the operation returns to the main routine. If FG51=ONE, whether the key 66 has been turned on is determined and, if so, whether FG61=ONE is decided (steps $S_{105}$ and $S_{106}$). If FG61=ONE, the operation returns to the main routine. If not FG61=ONE, FG61 is turned to a ONE and, then, whether [CTJBPT]>[CTJBTC] is checked (steps $S_{107}$ and $S_{108}$). This is to see if the job being displayed has been entered. If [CTJBPT]>[CTJBTC], since the job being displayed has not been entered and, therefore, the next job has not been entered either, [CTJBPT] is incremented by one (step $S_{109}$). At the subsequent step $S_{110}$, the flags FG22 and FG32 are each turned to a ZERO and, at a step $S_{111}$, the content of a memory which is designated by [CTJBPT] is loaded in the set copy counter, executed copy counter, set document counter and executed document counter and displayed. This is followed by a step $S_{112}$ at which the ten keys depression display 62, input key depression displays 61*a* and 61*b* and and copy number key depression displays 60*a* and 60*b* are turned off. Then, at a step $S_{113}$, whether [set document number counter]=0 is determined. If so, the document number key depression displays 59*a* and 59*b* are turned on (step $S_{114}$) and, if not [set document number counter]=0, the displays 59*a* and 59*b* are turned off (step $S_{115}$), followed by the main routine.

If not [CTJBPT]>[CTJBTC] as decided at the step $S_{108}$, meaning that the job being displayed has previously been entered, [CTJBPT] is incremented by one at a step $S_{116}$ and, at a step $S_{117}$, whether [CTJBPT]>[CTJBTC] is decided. If not, the content of a memory designated by [CTJBPT] is entered into the set copy number counter, executed copy number counter, set document number counter and executed document number counter and displayed at the step $S_{111}$ via the step $S_{110}$. If [CTJBPT]>[CTJBPC] as decided at the step $S_{117}$, the flags FG22 and FG32 are each turned to a ZERO, "0" is loaded in the set document number counter and displayed, and "0" is loaded in the set copy number counter and displayed (steps $S_{118}$–$S_{120}$), followed by a step $S_{112}$.

If the placed numeral confirm key 66 has not been turned on as decided at the step $S_{105}$, the flag FG61 is turned to a ZERO and, then, whether FG42=ONE is checked (steps $S_{121}$ and $S_{122}$). If FG42=ONE, meaning that the ten keys 48 have been turned on while the confirm key 66 has been depressed, the flag FG42 is turned to a ZERO and then whether [CTJBPT]>[CTJBTC] is determined (steps $S_{123}$ and $S_{124}$). In this case, [CTJBPT] represents a value which has been entered through the ten keys 48. If [CTJBPT]>[CTJBTC] at the step $S_{124}$, showing that the job being displayed has not been entered, the value of the CTJBTC is loaded in the CTJBPT (step $S_{125}$), that is, [CTJBTP] is incremented to the largest case number entered. Thereafter, at the step $S_{111}$ subsequent to the step $S_{110}$, the a content of a memory designated by the resulting [CTJBPT] is loaded in the set copy number counter, executed copy number counter, set document number counter and executed document number counter and displayed. If not [CTJBPT]>[CTJBTC] at the step $S_{124}$, showing that the job being displayed has already been entered, the content of a memory designated by [CTJBPT] is entered into the set copy number counter, executed copy number counter, set document number counter and executed document number counter and displayed at the step $S_{111}$ via the step $S_{110}$.

Figures 17, 17A:
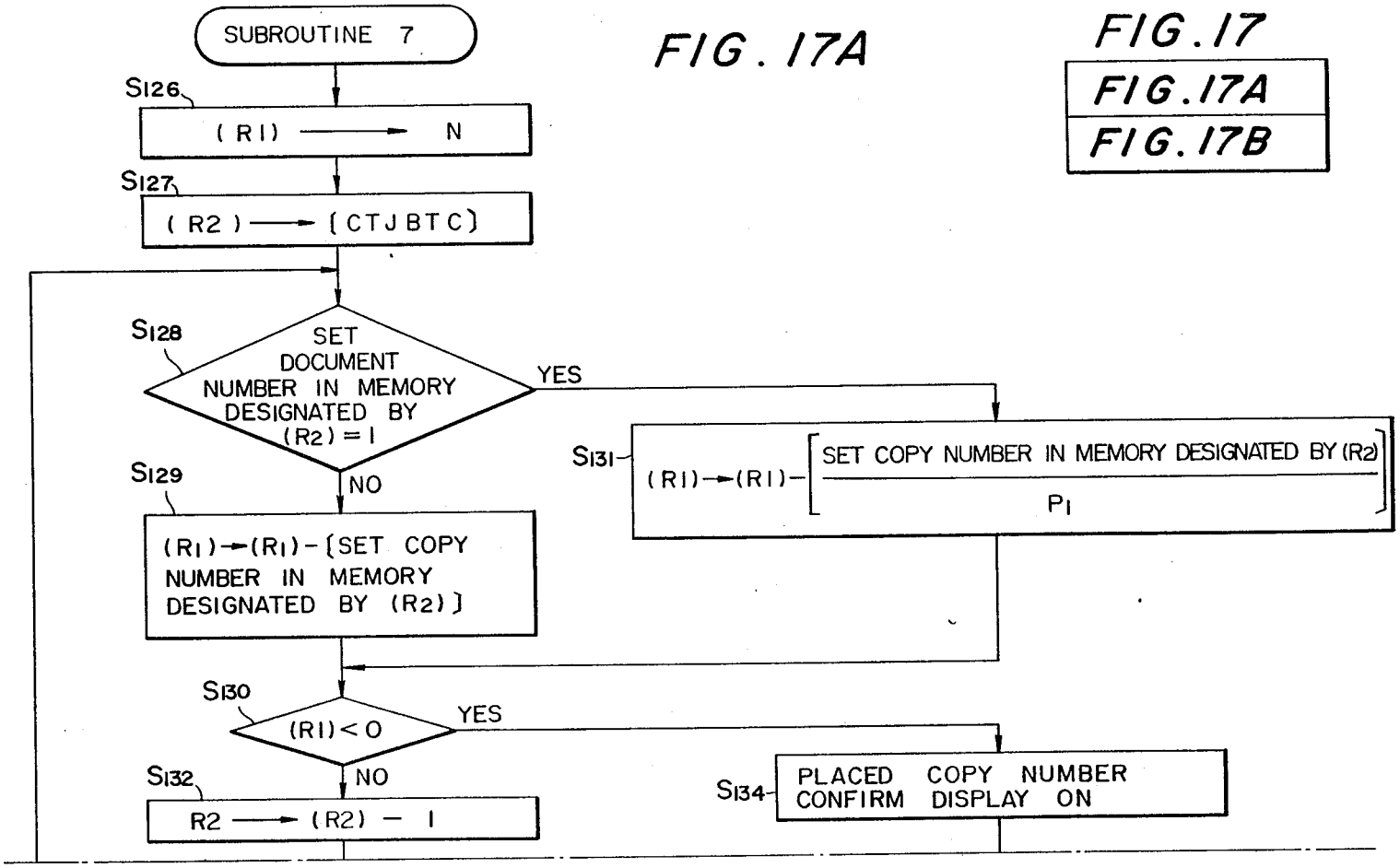
Figure 17B:
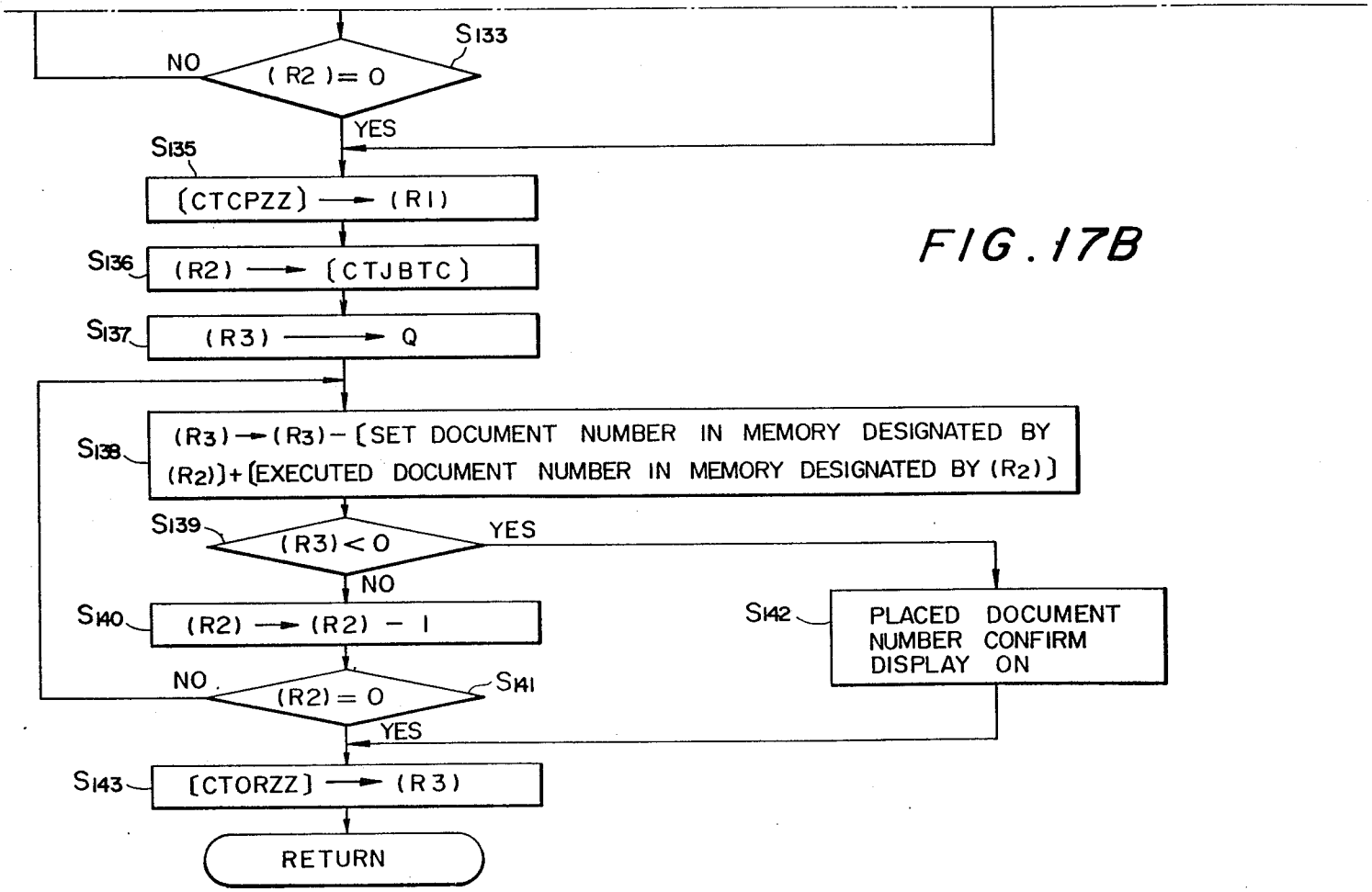

Referring to FIG. 17, the subroutine 7 is shown which is included in the stand-by routine of the step $S_2$ and adapted to calculate a residual of the set copy number which can be accommodated in the bins 3*e* and a residual of set document number which can be stacked on the table 2*a*. In the subroutine 7, elements labeled $R_1$, $R_2$ and $R_3$ are working registers. The subroutine 7 starts with a step $S_{126}$ for entering N into the register $R_1$, where N is the maximum number of bins 3*e* arranged in the sorter 3. Next, at a step $S_{127}$, [CTJBTC] is loaded in the register $R_2$, that is, the value stored in the register $R_2$ serves as the largest case number entered. Then, at a step $S_{128}$, whether the set document number in a memory which is designated by [$R_2$] is "1" is decided. If not, the mode is determined to be a sort mode so that, at a step $S_{129}$, a difference provided by ($R_1$)−[set copy number in a memory designated by ($R_2$)] is loaded in the register $R_1$ and, at the subsequent step $S_{130}$, whether ($R_1$)<0 is decided.

If the set document number is "1" as decided at the step $S_{128}$, the mode is determined to be a stack mode so that, at a step $S_{131}$, a difference provided by ($R_1$)−[set copy number in a memory designated by ($R_2$)/$p_1$] is loaded in the register $R_1$, followed by a step $S_{130}$ for determining whether ($R_1$)<0. Here, $p_1$ represents the maximum number of papers P which can be stored in each bin 3*e* of the sorter 3; concerning the calculation of the set copy number in a memory designated by ($R_2$)/$p_1$, fractions are raised to unit. If not ($R_1$)<0 at the step $S_{130}$, ($R_2$) is decremented by one and the result is loaded in the register $R_2$ to see if ($R_2$)=0 (steps $S_{132}$ and $S_{133}$). If not ($R_2$)=0, the operation returns to the step $S_{128}$. If ($R_1$)<0 as decided at the step $S_{130}$, the set copy number residual is zero so that the placed copy number confirm display 72 is turned on (step $S_{134}$). If ($R_2$)=0 at the step $S_{133}$ or after the step $S_{134}$, the value in the register $R_1$ is loaded in the CTCPZZ (step $S_{135}$). Loaded in the CTCPZZ is a set copy number residual, i.e. bin residual in the sorter 3.

A set document number residual is calculated as follows. At a step $S_{136}$, a value of the CTJBTC is loaded in the register $R_2$ and, at a step $S_{137}$, Q is loaded in the register $R_3$, where Q is the maximum number of documents O which may be loaded on the table 2*a*. Then, at a step $S_{138}$, a value provided by ($R_3$)−[set document number in a memory designated by ($R_2$)]+[executed document number designated by ($R_2$)] is loaded in the register $R_3$. At the subsequent step $S_{139}$, whether ($R_3$)<0 is determined and, if not, ($R_2$) is decremented by one and the result is loaded in the register $R_2$ and then whether ($R_2$)=0 is determined (steps 140 an 141). If not ($R_2$)=0 at the step $S_{141}$, the operation returns to the step $S_{138}$. If ($R_3$)<0 at the step $S_{139}$, meaning that the set document number residual is zero, the placed document number confirm display 71 is turned on at a step $S_{142}$. If ($R_2$)=0 at the step $S_{141}$ or after the step $S_{142}$, the value of the register $R_3$ is loaded in the CTORZZ (step $S_{143}$) and, then, the operation returns to the main routine. The CTORZZ therefore is loaded with a set document number residual.

Figure 18:
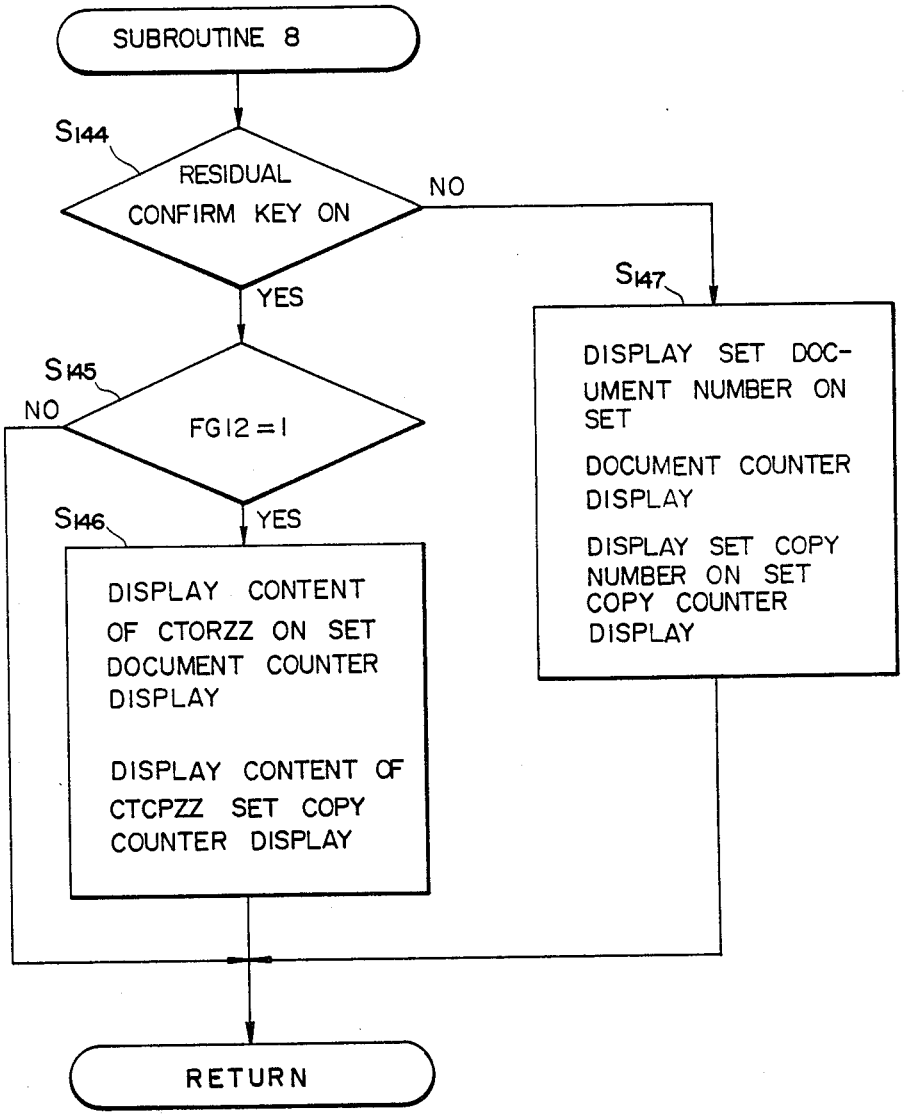

Referring to FIG. 18, the subroutine 8 is shown which is included in the stand-by routine of the step $S_2$ and adapted to accept the residual confirm key 67. First, whether the residual confirm key 67 has been turned on is determined at a step $S_{144}$ and, if so, whether FG12=ONE is determined (step 145). If not FG12=ONE, the operation returns to the main routine because the confirmation of a residual is meaningless. If FG12=ONE, the content of the CTORZZ is displayed by the set document number counter display 64 (step $S_{146}$), followed by a return to the main routine. If the key 67 has not been turned on as decided at the step $S_{144}$, the display 64 displays a set document number and the set copy number counter display 49, a set copy number. This is followed by the main routine.

Figures 19, 19A:
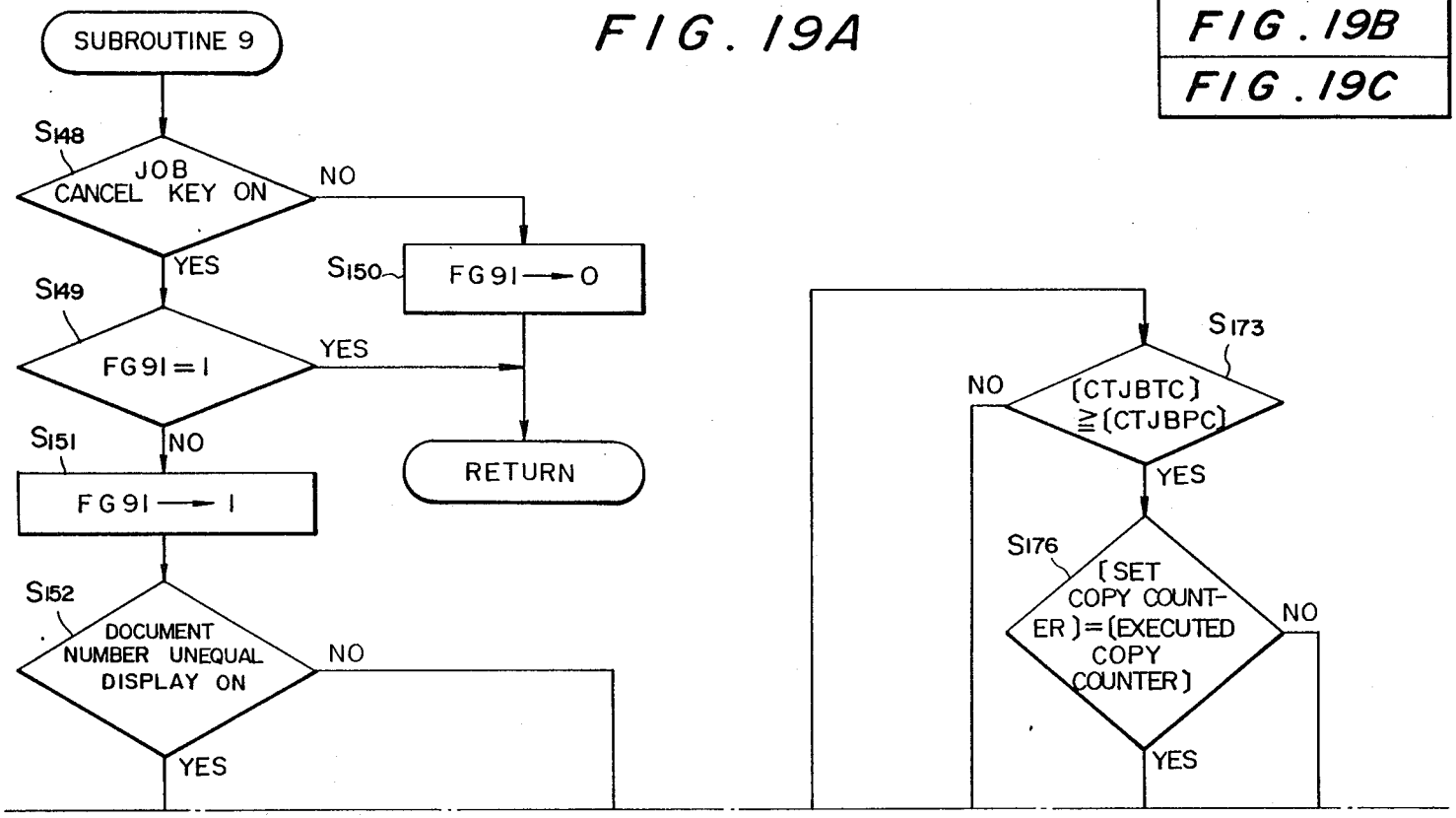
Figure 19B:
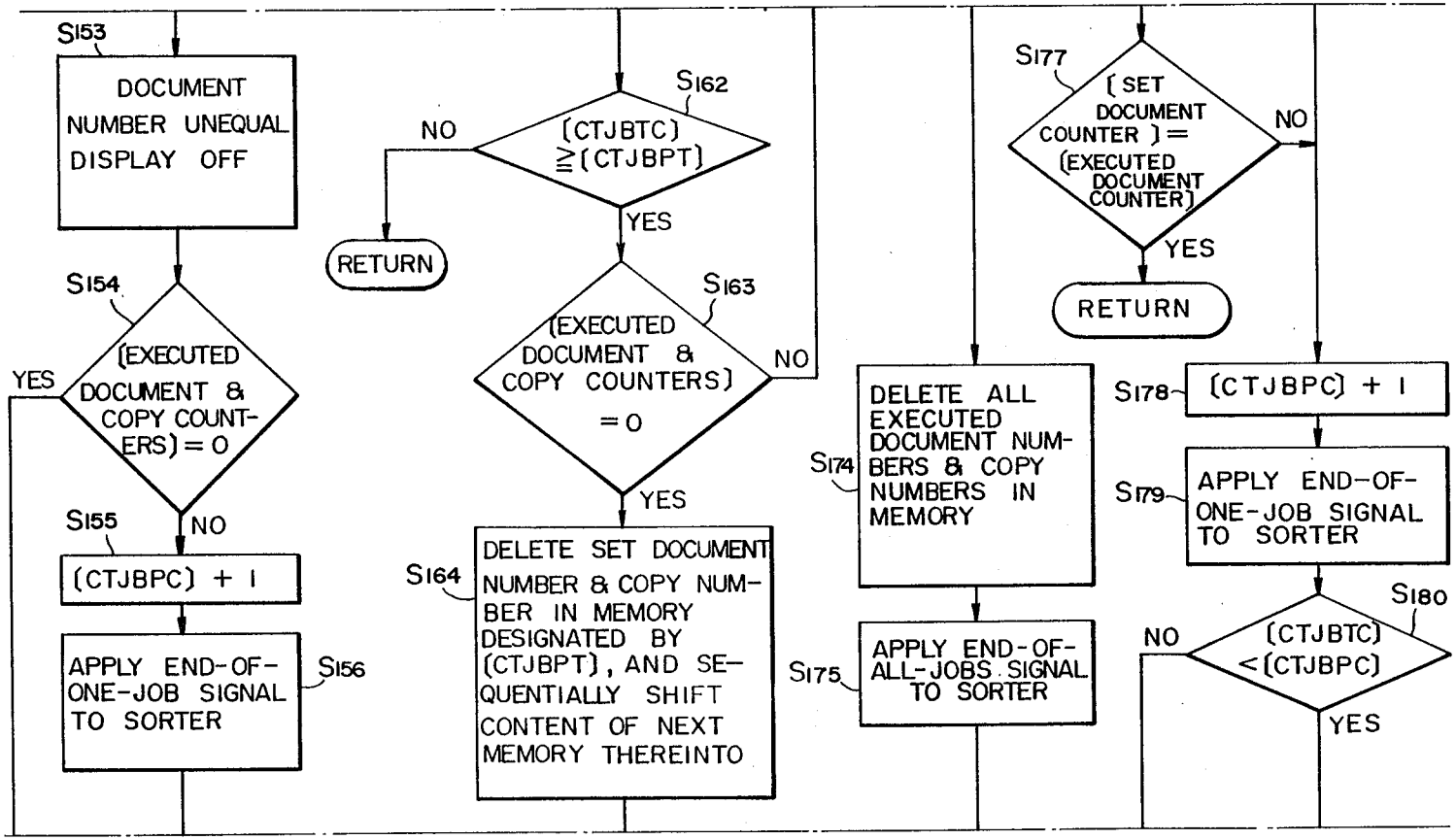
Figure 19C:
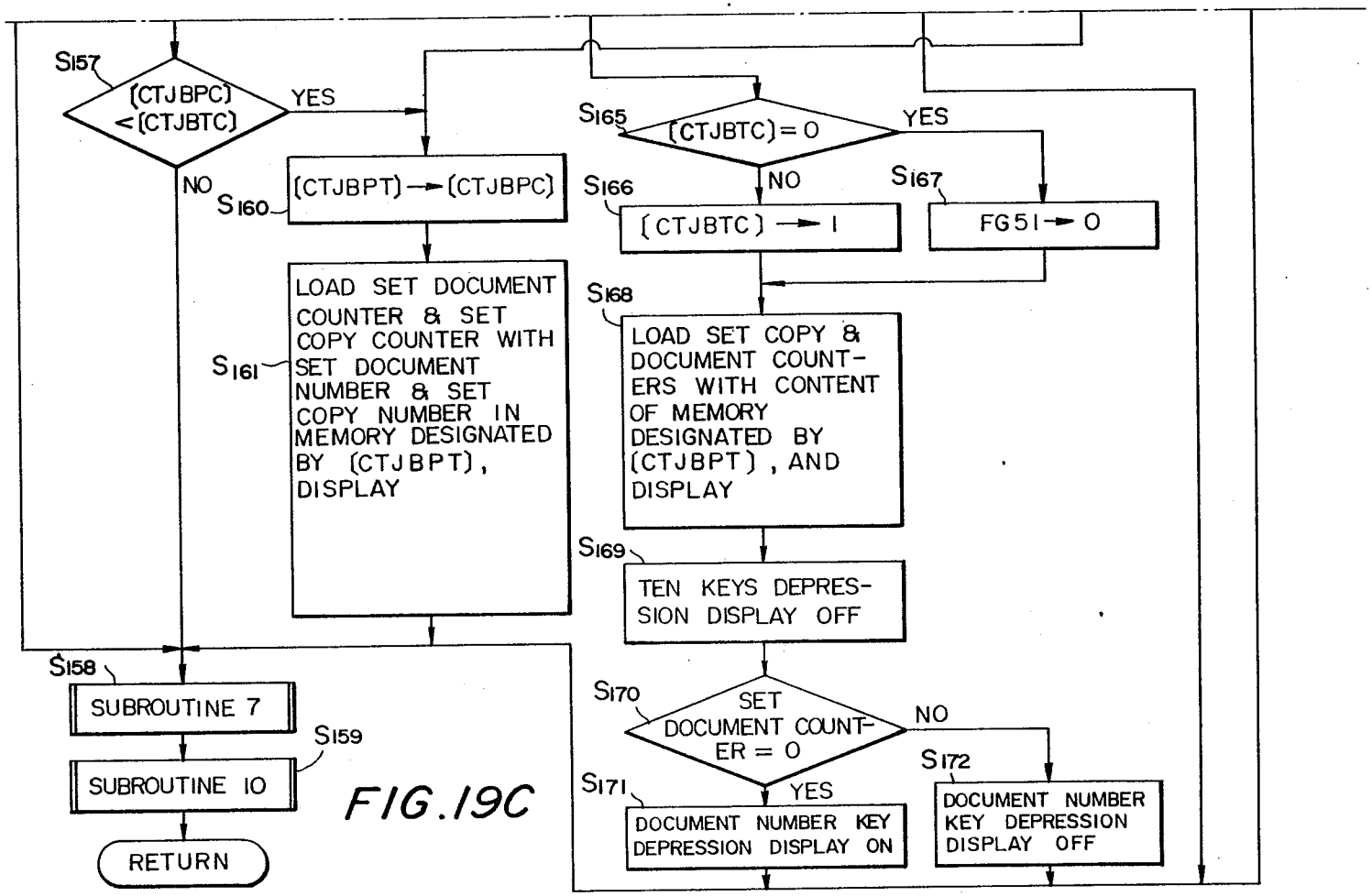

Referring to FIG. 19, the subroutine 9 is shown which is included in the stand-by routine of the step $S_2$ and adapted to accept the job cancel key 68. The subroutine 9 starts with determining whether the job cancel key 68 has been turned on, at a step $S_{148}$. If so, whether FG=ONE is decided (step $S_{149}$). If the key 68 has not been turned on, the flag FG91 is turned to a ZERO (step $S_{150}$) and then the operation returns to the main routine. If FG91=ONE at the step $S_{149}$, the operation also returns to the main routine.

If not FG91=ONE at the step $S_{149}$, the flag FG91 is turned to a ONE and, then, whether the document number unequal display 69 has been turned on is checked (steps $S_{151}$ and $S_{152}$). If the display 69 has been turned on, it is turned off and, then, whether the executed document number counter and executed copy number counter are each "0" is determined, that is, whether the job being displayed has not been executed yet is determined (steps $S_{153}$ and $S_{154}$). If the two counters are "0" at the step $S_{154}$, meaning that the job being displayed has not been executed yet, the operation returns to the main routine through the subroutine 7 at the step $S_{158}$ and the subroutine 10 at the step $S_{159}$.

If the counters are not "0" as decided at the step $S_{154}$, meaning that the job being displayed has already been executed, execution of that job is omitted. At the subsequent step $S_{155}$, [CTJBPC] is incremented by one and, thereafter, an end-of-one-job signal is applied to the sorter 3.

Thereafter, at a step $S_{157}$, whether [CTJBPC]<[CTJBTC] is checked. If so, it is seen that the number of jobs which have been executed is greater than the largest number entered, that is, no job is left. Then, the operation returns to the main routine by way of the subroutine 7 at a step $S_{158}$ and the subroutine 10 at a step $S_{159}$. If [CTJBPC]<[CTJBTC], meaning that the number of jobs actually executed is smaller than the largest number entered, the value of the CTJBPC is entered into the CTJBPT (step 160), then a set document number and a set copy number stored in a memory which is designated by [CTJBPT] are loaded, respectively, in the set document number counter and the set copy number counter and displayed (step $S_{161}$), and then the operation returns to the main routine via the subroutine at the step $S_{158}$ and the subroutine 10 at the step $S_{159}$.

If the display 69 has not been turned on at the step $S_{152}$, whether [CTJBTC]≧[CTJBPT] is determined at a step $S_{162}$. If not, the operation returns to the main routine because the job being displayed has not been entered. If [CTJBTC]>[CTJBPT] at the step $S_{162}$, meaning that the job being displayed has been entered, whether the counts of the executed document counter and executed copy counter are both "0" is determined, that is, whether the job being displayed has not been executed yet is determined (step $S_{163}$). If so, that is, if the job being displayed has not been executed, a set document number and a set copy number in a memory which is designated by [CTJBPT] are deleted, while data stored in the next memory are sequentially shifted to that deleted memory (step $S_{164}$) to prevent the latter from remaining empty.

Then, at a step $S_{165}$, whether [CTJBTC]=0 is checked. If not, [CTJBTC] is decremented by one at a step $S_{166}$. If [CTJBTC]=0, the flag FG51 is turned to a ONE and, then, the content of a memory designated by [CTJBPT] is loaded in the set copy counter and set document counter and displayed (step $S_{168}$). Subsequently, the ten keys depression display 62, input key depression displays 61*a* and 61*b* and copy number key depression displays 60*a* and 60*b* are turned off (step $S_{169}$) to see if [set document counter]=0 (step $S_{170}$). If so, the document number key depression displays 59*a* and 59*b* are turned on at a step $S_{171}$ and, if not, the document number key depression displays 59*a* and 59*b* are turned off at a step $S_{172}$ whereupon the operation returns to the main routine via the subroutine 7 at the step $S_{158}$ and subroutine 10 at the step $S_{159}$.

If [CTJBTC]≧[CTJBPT] as decided at the step $S_{162}$ and the counts of the counters are not "0" as decided at the step $S_{163}$, whether [CTJBTC]≧[CTJBPC] is checked at a step $S_{173}$. If not, it is seen that all the jobs entered have been executed. Hence, at a step $S_{174}$, the executed document numbers and executed copy numbers in all the memories associated with jobs are deleted. Then, at a step $S_{175}$, an end-of-all-jobs signal indicative of the end of all the entered jobs is applied to the sorter. Thereafter, the operation returns to the main routine by way of the subroutine 7 at the step $S_{158}$ and the subroutine 10 at the step $S_{159}$. It will be noted that the set document numbers and set copy numbers associated with jobs are not deleted at the step $S_{174}$ for the purpose of eliminating the need for repeated entry of data in the event of execution of multiple jobs having the same pattern.

If [CTJBTC]≧[CTJBPC] as decided at the step $S_{173}$, whether [set copy counter]=[executed copy counter] is determined at a step $S_{176}$. If so, whether [set document counter]=[executed document counter] is decided at a step $S_{177}$. If so, one of the jobs which has the largest number has already been executed and, therefore, cannot be cancelled. As a result, the operation returns to the main routine. If not "set copy counter]=[executed copy counter] decided at the step $S_{176}$ and if not [set document counter]=[executed document counter] as decided at the step $S_{177}$, [CTJBPC] is incremented by one at a step $S_{178}$ to cancel the job under way. Then, at a step $S_{179}$, an end-of-one-job signal is applied to the sorter 3, and then whether [CTJBTC]<[CTJBPC] is determined at a step $S_{180}$. If not, meaning that there is some job which has been entered but not unexecuted, the value of the CTJBPC is loaded in the CTJPBT at the step $S_{160}$ and a set document number and a set copy number in a memory designated by [CTJBPT] are loaded, respectively, in the set document counter and the set copy counter and displayed at the step $S_{161}$. If [CTJBTC]<[CTJBPC] as decided at the step $S_{180}$, implying that the entered jobs have been executed, the operation returns to the main routine by way of the subroutine 7 at the step $S_{158}$ and the subroutine 10 at the step $S_{159}$.

Figure 20:
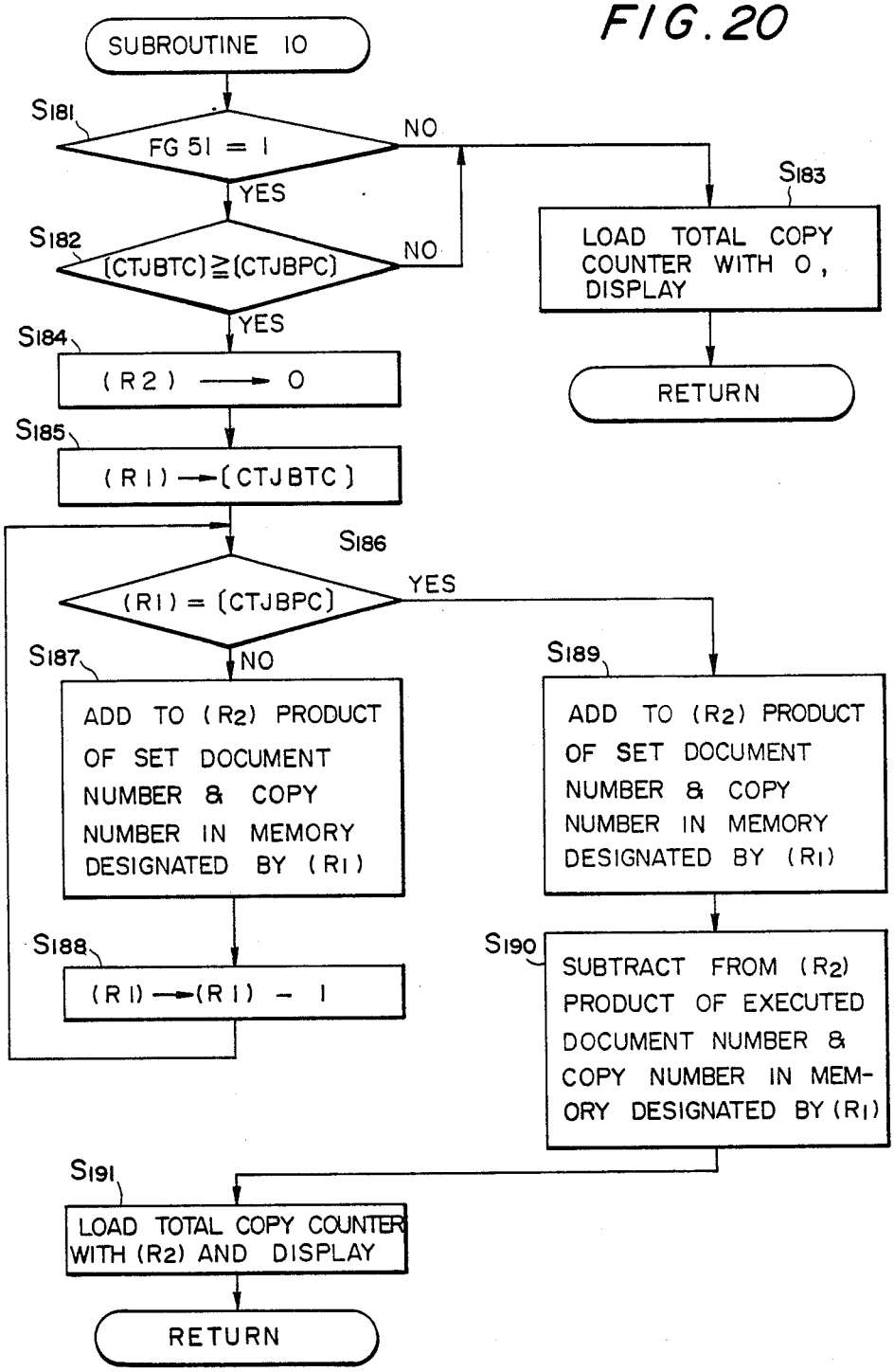

Referring to FIG. 20, the subroutine 10 is shown which is included in the stand-by routine of the step $S_2$ and adapted to count and display the total number of copies. First, at a step $S_{181}$, whether FG51=ONE is checked and, if so, whether [CTJBTC]≧[CTJBPC] is determined at a step $S_{182}$. If not FG51=ONE at the step $S_{181}$ and if not [CTJBTC]≧[CTJBPC] at the step $S_{182}$, that is, when all the entered jobs have been executed, "0" is loaded in the total copy counter and displayed at a step $S_{183}$. This is followed by the main routine.

If [CTJBTC]≧[CTJBPC] at the step $S_{182}$, the register $R_2$ is turned to "0", then the value of the CTJBTC is loaded in the register $R_1$, and then whether ($R_1$)=[CTJBPC] is determined (steps $S_{184}$–$S_{186}$). If not, at a step $S_{187}$, a product of a set document number and a set copy number designated by ($R_1$) is added to ($R_2$) and, at the following step $S_{188}$, a value provided by decrementing ($R_1$) by one is loaded in the register $R_1$, the procedure then returning to the step $S_{186}$. The sequence of events $S_{186}$–$S_{188}$ is repeated until ($R_1$)=[CTJBPC] holds at the step $S_{186}$. Then, at a step $S_{189}$, a product of a set document number and a set copy number designated by ($R_1$) is added to ($R_2$) and, at a step $S_{190}$, a product of an executed document number and an executed copy number in a memory designated by ($R_1$) is subtracted from ($R_2$) and, at a step $S_{191}$, the resulting ($R_2$) is loaded in the total copy counter and displayed. This returns the operation to the main routine.

Figure 21:
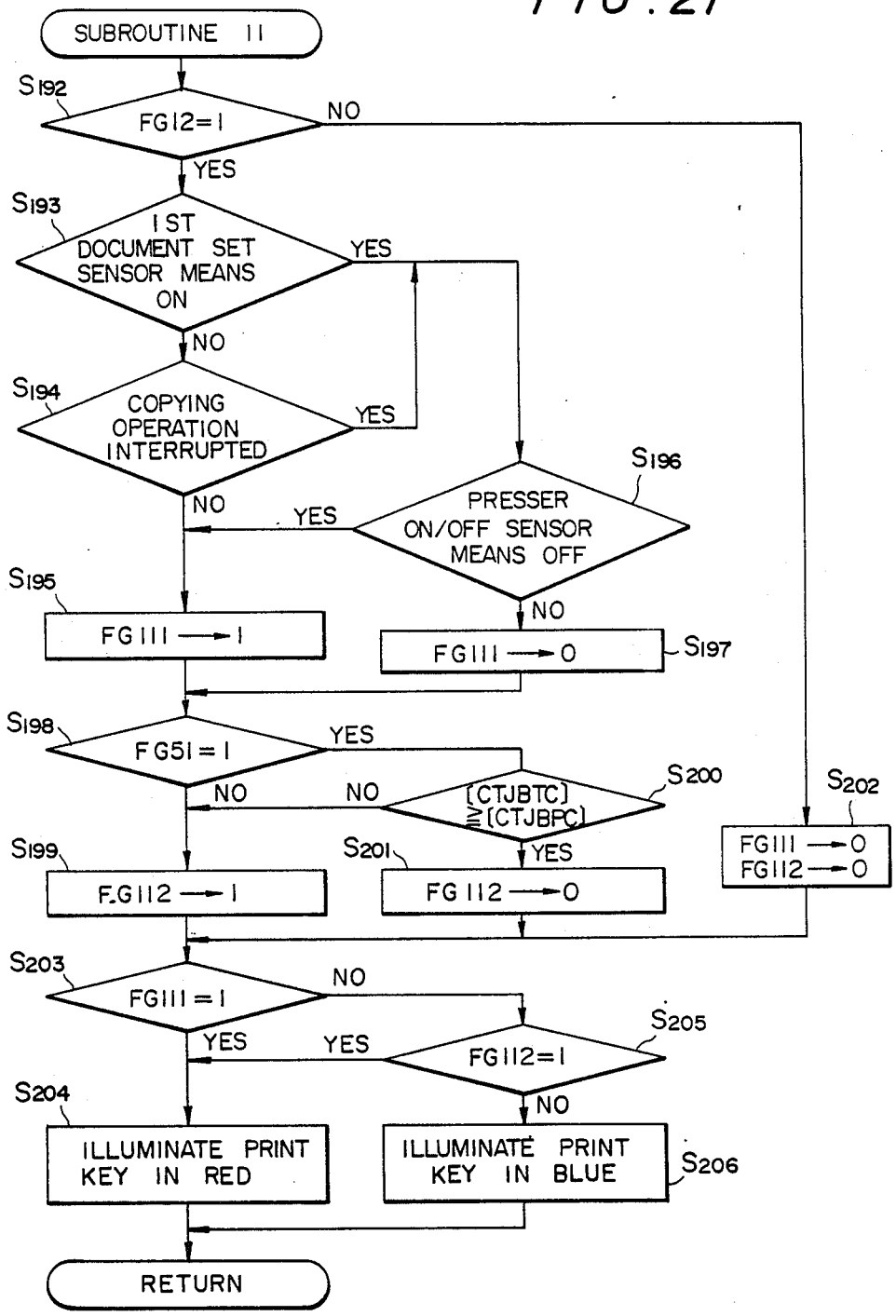

Referring to FIG. 21, the subroutine 11 is shown which is adapted to decide in a multi-job mode whether conditions for starting copying are fulfilled and, if not, inhibiting copying while displaying the result of the decision. The subroutine 11 starts with determining whether FG12=ONE, at a step $S_{192}$. If so, at a step $S_{193}$, whether the first document set sensor means 24 is "on" is determined. If it is not "on", whether a copying operation has been interrupted is checked at a step $S_{194}$. If it has not been interrupted, FG111 is turned to a ONE (step $S_{195}$). The decision concerning the interruption of a copying operation may be implemented with checking whether set copy number=executed copy number or whether stop flag=ONE. The stop $S_{195}$ has significance in that in the case of interruption of a copying operation with the last document the print key 47 is prevented from being illuminated in red despite that the first document set sensor means 24 will then be turned off. The words "interruption of a copying operation" refers to a condition wherein a copying operation is interruted with a document O laid on the glass platen 7*a* and with an executed copy number which is short of the set copy number.

If the first document set sensor means 24 is "on" at the step $S_{193}$ and the copying operation has been interrupted at the step $S_{194}$, whether the presser plate open/close sensor means 30 is "off" is determined (step $S_{196}$). If it is "off", the flag FG111 is turned to a ONE at a step $S_{195}$; if it is "on", the flag FG111 is turned to a ZERO at a step $S_{197}$, followed by a step $S_{198}$.

At the step $S_{198}$, whether FG51=ONE is checked and, if not, the flag FG112 is turned to a ONE at a step $S_{199}$. If FG51=ONE, whether [CTJBTC]≧[CTJBPC] is determined at a step $S_{200}$. If not [CTJBTC]≧[CTJBPC], implying that the entered jobs have been executed, the flag 112 is turned to a ONE at the step $S_{199}$. If [CTJBTC]≧[CTJBPC], showing that there is some job which has been left unexecuted, the flag FG112 is turned to a ZERO at a step $S_{201}$. If not FG12=ONE at the step $S_{192}$, the flags FG111 and FG112 are each turned to a ZERO at a step $S_{202}$.

At a step $S_{203}$, whether FG111=ONE is checked and, if so, the print key 47 is illuminated in red at a step $S_{204}$ to show that copying is inhibited and the operation returns to the main routine. If not FG111=ONE as decided at the step $S_{203}$, whether FG112=ONE is checked at a step 205. If FG112=ONE, the print key 47 is illuminated in red at the step $S_{204}$. If not FG112=ONE, the print key 47 is illuminated in green at a step $S_{206}$ to show that copying is permitted.

Figure 22:
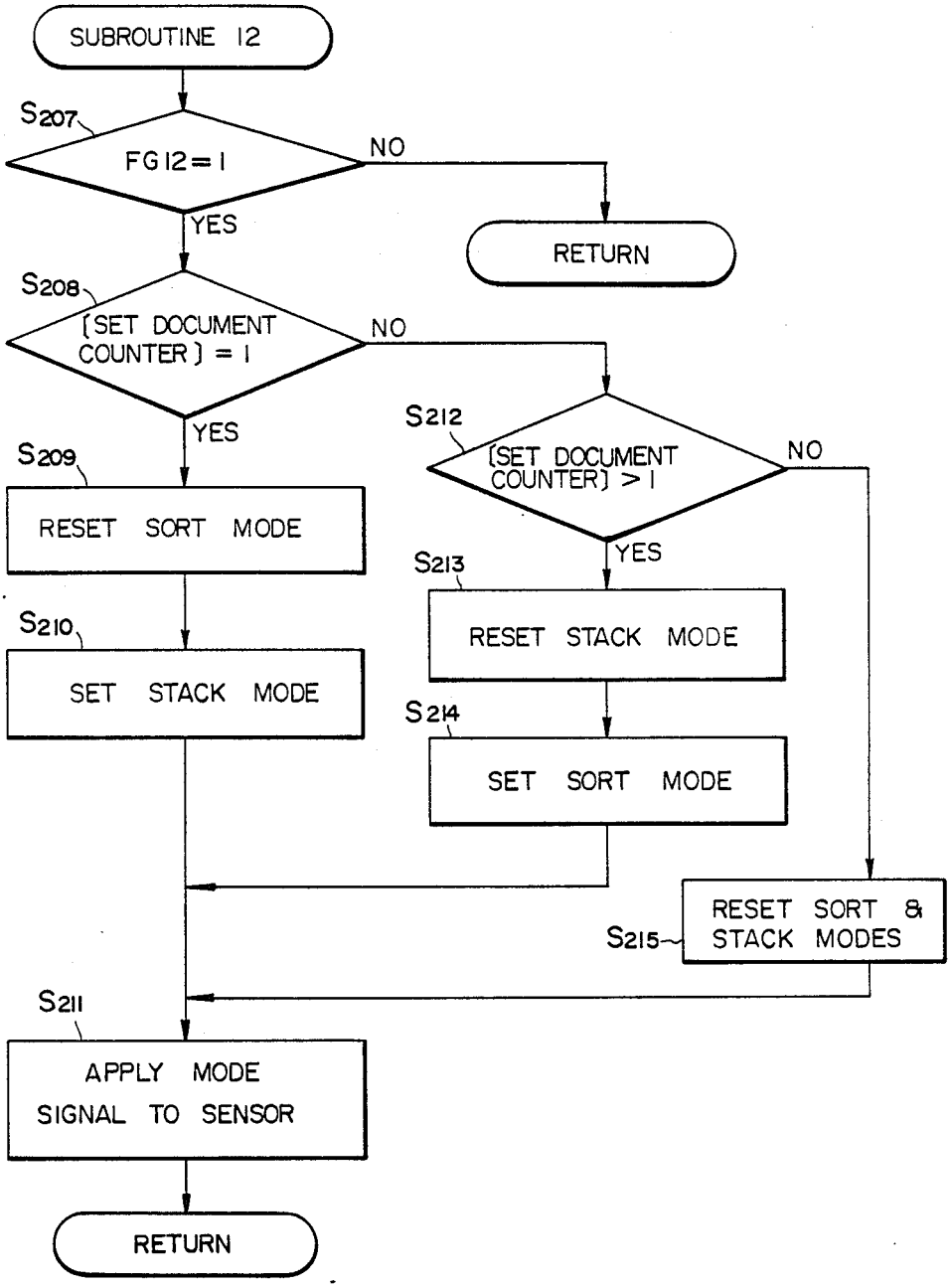

Referring to FIG. 22, the subroutine 12 is shown which is included in the stand-by routine of the step $S_2$ and adapted to automatically set up a sort mode or a stack mode in the event of a multi-job mode responsive to a set document number. First, at a step $S_{207}$, whether FG12=ONE is checked. If not FG12=ONE, showing that the mode is not a multi-job mode, the operation returns to the main routine. If FG12=ONE, whether [set document counter]=1 is decided, a sort mode is reset (that is, the flag FG131 is turned to a ZERO) and a stack mode is set (that is, the flag FG132 is turned to a ONE) and then a mode signal is applied to the sorter 3 (steps $S_{209}$–$S_{211}$), and then the operation returns to the main routine.

If not [set document counter]=1 as decided at the step $S_{208}$, whether [set document counter]>1 is determined at a step $S_{212}$. If [set document counter]>1, a stack mode is reset (that is, the flag FG132 is turned to a ZERO) and, instead, a sort mode is set (that is, the flag FG131 is turned to a ONE) and, then, a mode signal is applied to the sorter 3 (steps 213, 214 and 211). If not [set document counter]>1 as decided at the step $S_{212}$, meaning that the entered number of documents is zero, both the sort mode and stack mode are reset and a mode signal is applied to the sorter 3 (steps 215 and 211).

Figure 23:
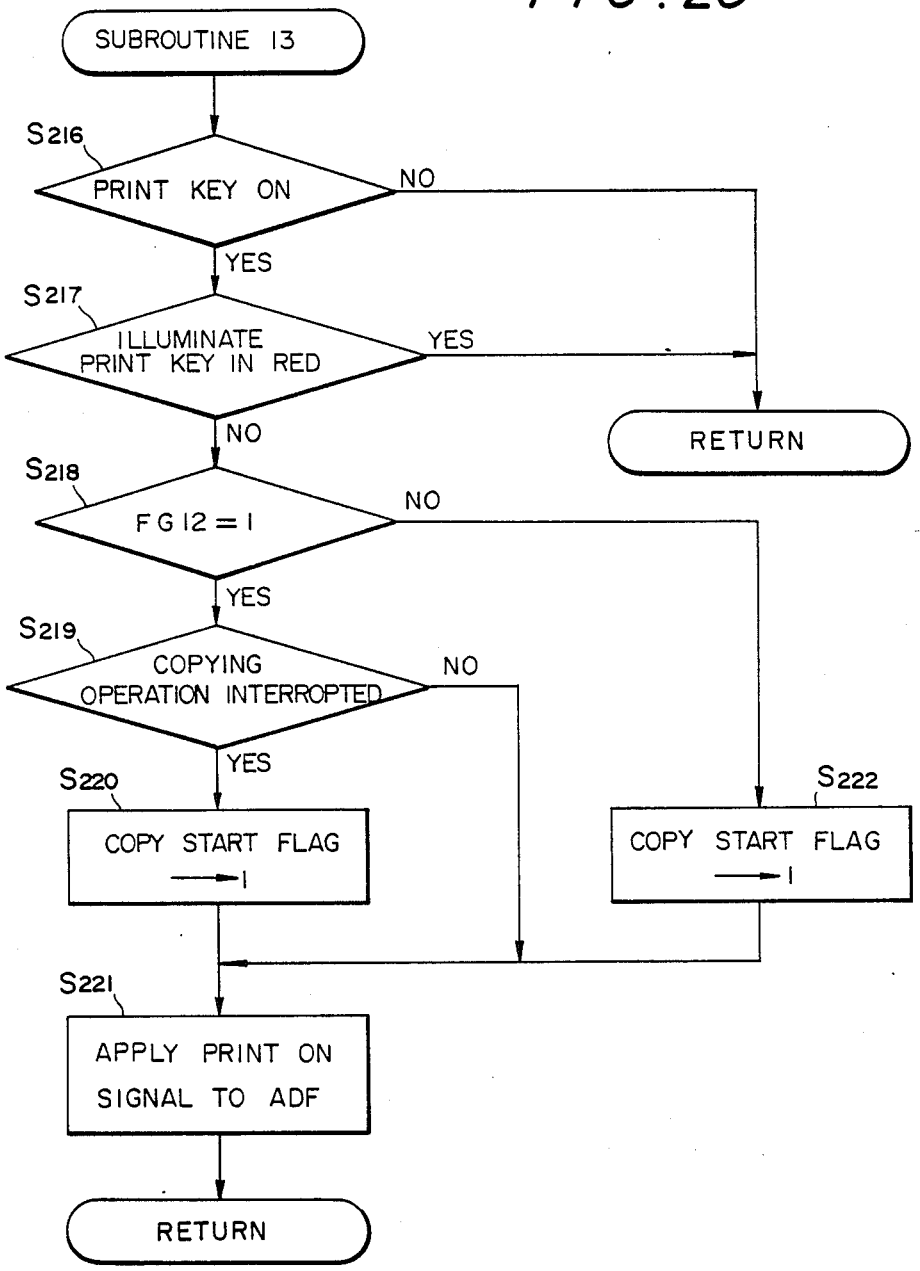

Referring to FIG. 23, the subroutine 13 is shown which is included in the stand-by routine of the step $S_2$ and adapted to accept the print key 47. The subroutine 13 begins with determining whether the print key 47 has been turned on, at a step $S_{216}$. If it has been turned on, whether it is illuminated in red is determined at a step $S_{217}$. If the key 47 has not been turned on as decided at the step $S_{216}$ or if is not illuminated in red as decided at the step $S_{217}$, the operation returns to the main routine.

If the print key 47 is not illuminated in red, that is, if it is illuminated in green, whether FG12=ONE is determined at a step $S_{218}$. If FG12=ONE, whether a copying operation has been interrupted is decided at a step $S_{219}$. If so, the copy start flag FG141 is turned to a ONE and an ON signal is delivered to the ADF 2 (steps $S_{220}$ and $S_{221}$) and, then, the operation returns to the main routine. If no copy interruption is decided at the step $S_{219}$, the copy start flag FG141 is not turned to a ONE and, instead, a print ON signal is applied to the ADF 2 at the step $S_{221}$. If not FG12=ONE at the step $S_{218}$, implying that the mode is other than a multi-job mode, the copy start flag FG141 is turned to a ONE and, then, a print ON signal is applied to the ADF2 (steps $S_{222}$ and $S_{221}$).

If no copy interruption is decided at the step $S_{219}$, a print ON signal is applied to the ADF 2 at the step $S_{221}$ and, as will be described, the ADF 2 is turned on responsive to the ON signal to feed a document O or a division paper d. Only when the object under feed is decided to be a document O is a copy start signal applied to the copier 1 to turn the copy start flag FG141 to a ONE; in the case of a division paper, a copy start signal is not delivered. If a copying operation has been interrupted as determined at the step $S_{219}$, meaning that a document O is present on the glass platen 7*a*, the copy start flag 47 is turned to a ONE as soon a the print key 47 is turned on.

Figure 24B:
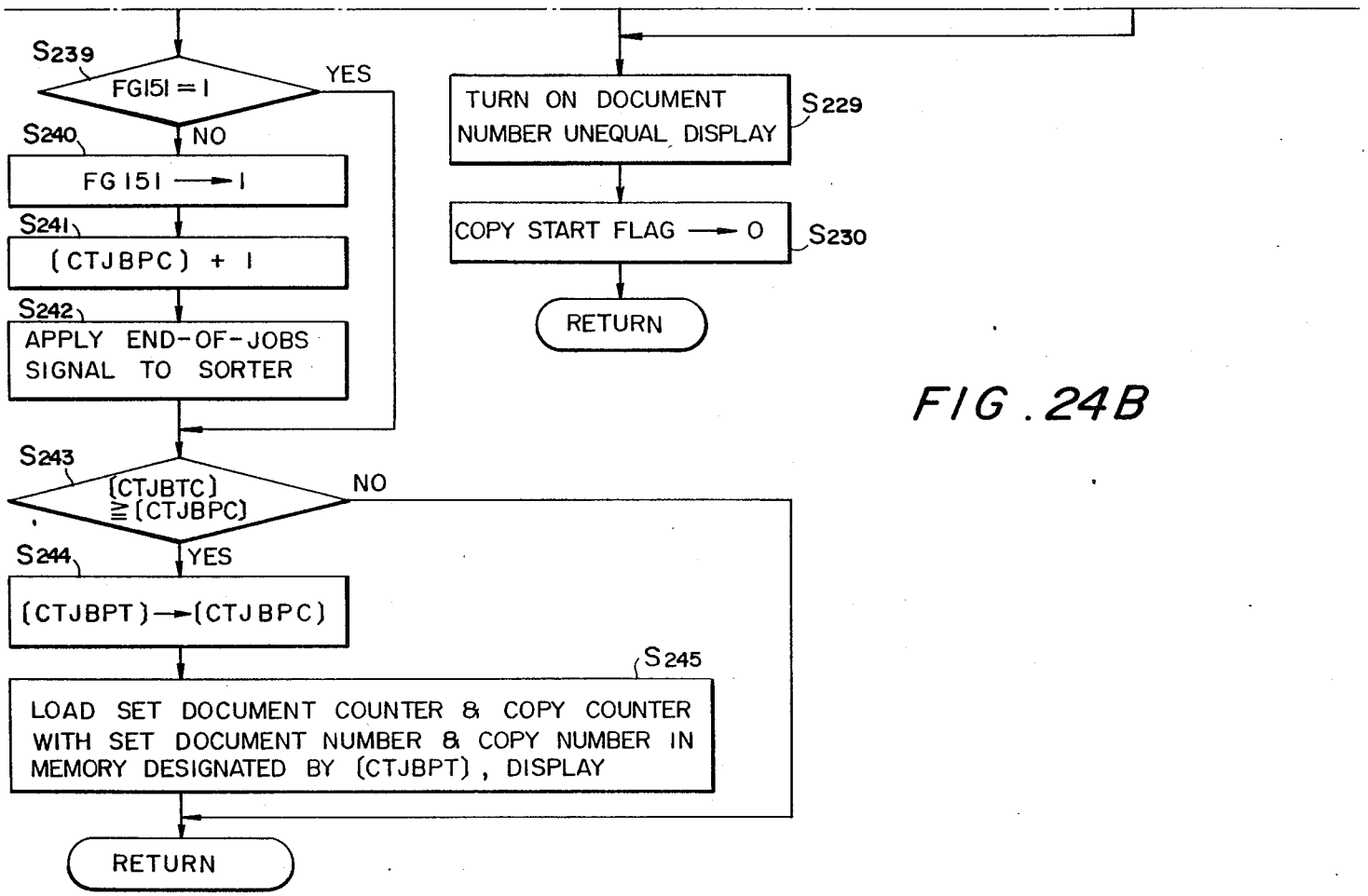

Referring to FIG. 24, the subroutine 14 is shown which is included in the stand-by routine of the step $S_2$ and adapted to process the copy start signal from the ADF 2 and the signal from the division paper sensor means 25. First, at a step $S_{223}$, whether FG12=ONE is determined and, if so, whether FG141=ONE is checked at a step $S_{224}$. If not FG141=ONE presence/absence of a division paper detection signal is determined at a step $S_{225}$.

If a division paper detection signal has been found at the step $S_{225}$, the buzzer 109 is energized and the detection signal is reset and, then, [set document counter]=[executed document counter] is determined (steps $S_{226}$–$S_{228}$). If not [set document counter]=[executed document counter], the document number unequal display 69 is turned on at a step $S_{229}$, then the copy start flag FG141 is turned to a ZERO at a step $S_{230}$, and then the operation returns to the main routine. It will be noted that the unequal display 69 is turned on at the step $S_{229}$ after the consecutive steps $S_{223}$–$S_{228}$ when a division paper d is reached while some of the documents O laid on the table 2*a* are not copied for the following reasons: (1) the number of documents O loaded in the ADF 2 is smaller than the entered number of documents, (2) although the number of documents O loaded in the ADF 2 is the same as the entered number, a plurality of them are fed at the same time laid one above another, and (3) the entered number of documents is greater than the number of documents actually loaded in the ADF 2.

If copy start flag=ONE has been decided at the step $S_{224}$ or if a division paper detection signal has not been found at the step $S_{225}$, presence/absence of a copy start signal from the ADF 2 is determined at a step $S_{231}$. If it is present, [set document counter]=[executed document counter] is checked and, if they compare equal, the copy start signal from the ADF 2 is reset (steps $S_{232}$ and $S_{233}$). This is followed by a step $S_{229}$ for turning on the unequal display 69. The unequal display 69 will be turned on in any of the following situations: (4) the number of documents O loaded in the ADF 2 is greater than the entered number, and (5) the entered number of documents is smaller than the number of documents actually loaded in the ADF 2.

If not FG12=ONE as decided as the step $S_{223}$, presence/absence of a copy start signal from the ADF 2 is determined at a step $S_{234}$. If it is present or if the set document counter and the executed document counter have not compared equal at the step $S_{232}$, the copy start flag FG141 is turned to a ONE at a step $S_{235}$ and, then, the operation returns to the main routine.

If the copy start signal is absent at the step $S_{231}$, whether FG151=ONE is determined at a step $S_{236}$. If not, whether the document is the final paper is determined at a step $S_{237}$. If FG151=ONE at the step $S_{236}$ or if the document is not the final paper at the step $S_{237}$, the operation returns to the main routine. If the document is the final paper at the step $S_{237}$, whether [set document counter]=[executed document counter] is determined at a step $S_{238}$. If not, the document number unequal display 69 is turned on at the step $S_{229}$. Such turn-on of the display 69 results from any of the situations (1)–(3) previously stated.

If [set document counter]=[executed document counter] at the step $S_{228}$ or $S_{238}$, whether FG151=ONE is determined at a step $S_{239}$. If not, the flag FG151 is turned to a ONE, [CTJBPC] is incremented by one, and an end-of-one-job signal is applied to the sorter 3, whereafter whether [CTJBTC]>[CTJBPC] is checked (steps $S_{240}$–$S_{243}$). If FG151=ONE at the step $S_{239}$, the operation advances to a step $S_{243}$.

If [CTJBTC]≧[CTJBPC] at the step $S_{243}$, meaning that there is a job left unexecuted, the value of the CTJPBC is entered into the CTJBPT at a step $S_{244}$ and, then, a set document number and a set copy number stored in a memory which is designated by [CTJBPT] are loaded, respectively, in the set document counter and the set copy counter and displayed at a step $S_{245}$. Thereafter, the operation returns to the main routine. If not [CTJBTC]≧[CTJBPC] at the step $S_{243}$, implying that entered jobs have been executed, the operation returns to the main routine.

Figure 25:
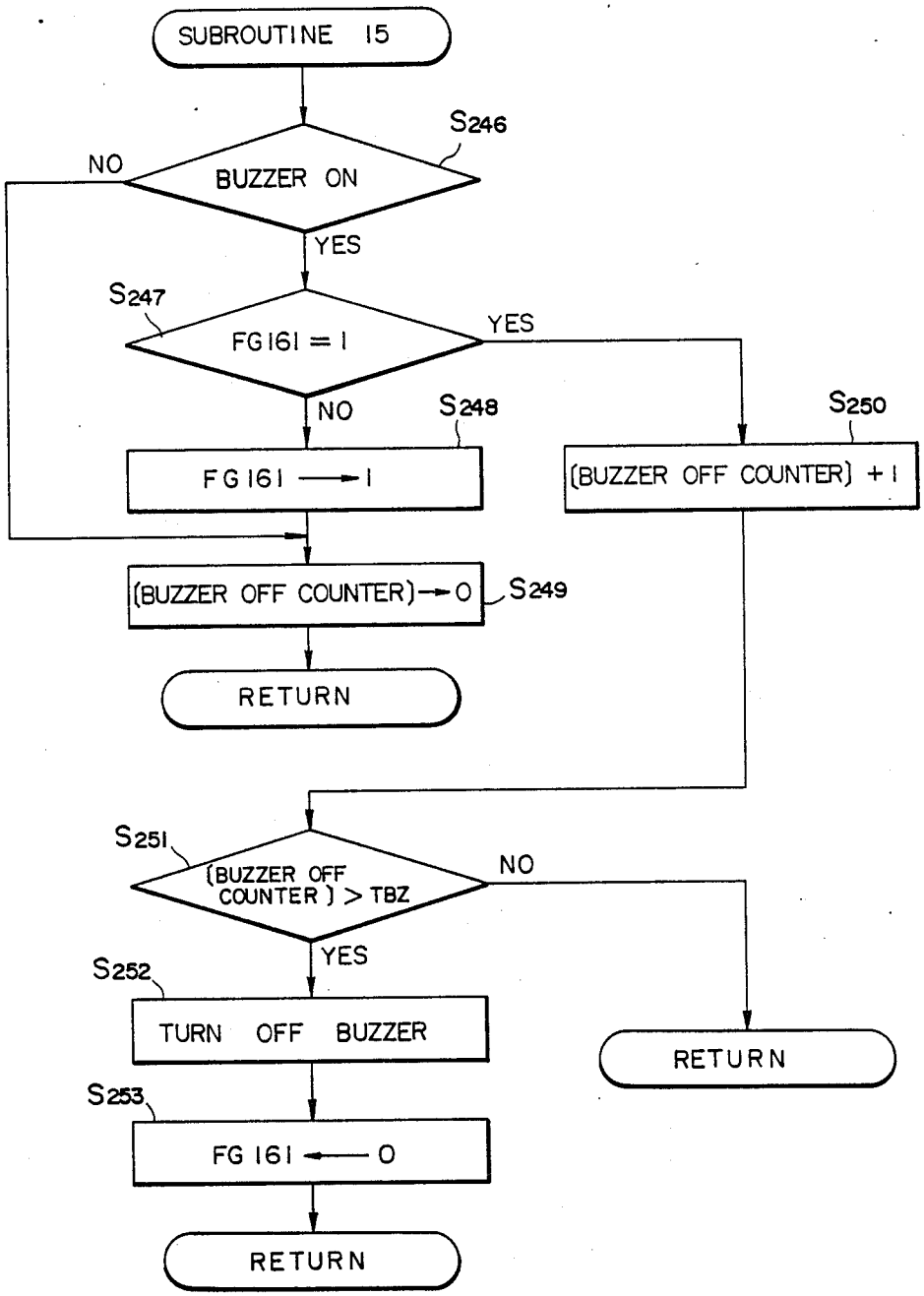

Referring to FIG. 25, the subroutine 15 is shown which is included in the stand-by routine of the step $S_2$ and adapted to deenergize the buzzer 109 after a predetermined period of time. First, at a step $S_{246}$, whether the buzzer 109 is "on" is determined. If so, whether FG161=ONE is determined at a step $S_{247}$. Since FG161=ONE does not hold at first, the flag FG161 is turned to a ONE at a step $S_{248}$, then a buzzer OFF counter is cleared to zero at a step $S_{249}$, and then the operation returns to the main routine. If the buzzer 109 is not "on" at the step $S_{246}$, the buzzer OFF counter is cleared to zero at a step $S_{249}$, followed by the main routine.

If FG161=ONE at the step $S_{247}$, [buzzer OFF counter] is incremented by one at a step $S_{250}$ and, then, whether [buzzer OFF counter]>TBZ is checked at a step $S_{251}$, where TBZ is a period of time for which the buzzer 109 remains "on" at the step $S_{226}$. If not [buzzer OFF counter]>TBZ at the step $S_{251}$, the operation returns to the main routine. While the buzzer 109 is energized, timing pulses are applied at a step $S_{250}$ to the buzzer OFF counter at predetermined intervals. When [buzzer OFF counter]>TBZ is determined at a step $S_{251}$, the buzzer 109 is deenergized and then the flag FG161 is turned to a ZERO (steps $S_{252}$ and $S_{253}$), then the operation returning to the main routine.

Figure 26:
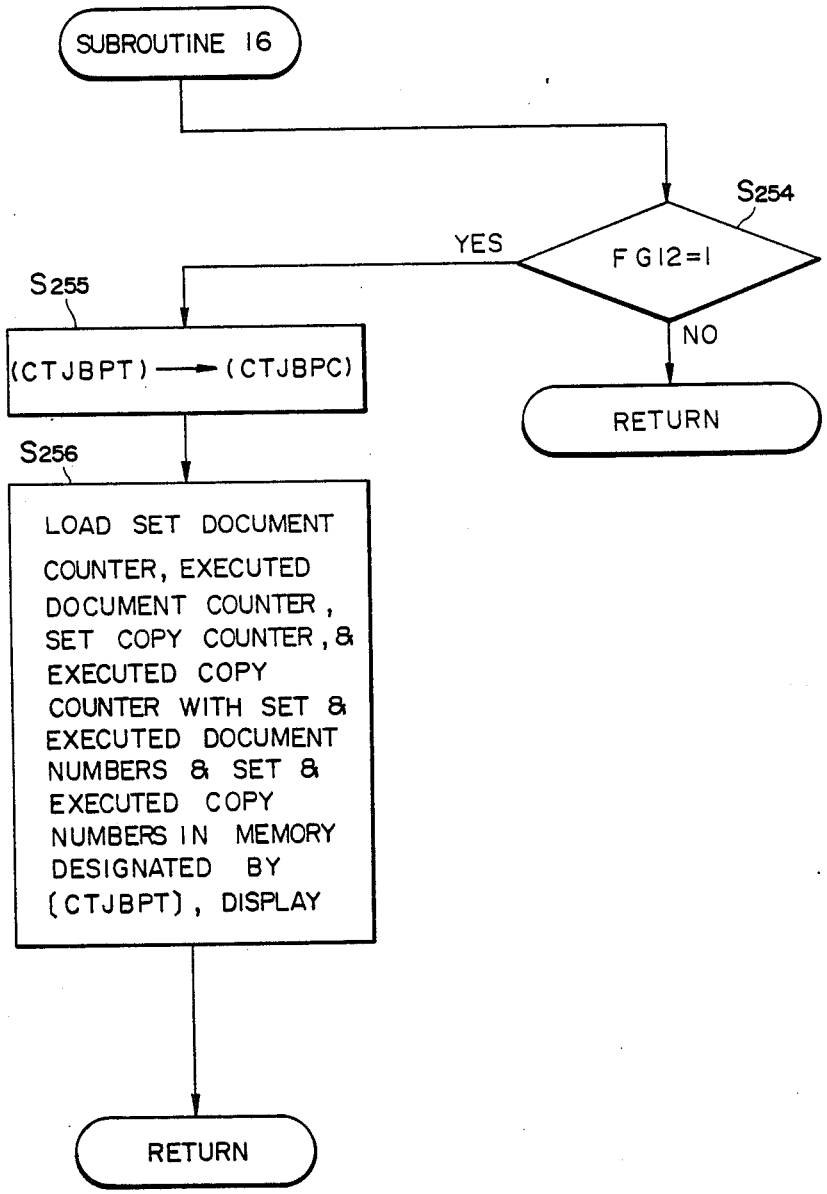

Referring to FIG. 26, the subroutine 16 is shown which is included in the copy start routine of the step $S_6$ and adapted to switch the content of a job at the time of copy start to a one which is to be executed. The subroutine 16 starts with determining whether FG12=ONE at a step $S_{254}$. If not, the operation returns to the main routine. If FG12=ONE, the value of the CTJBPC is loaded in the CTJPBT at a step $S_{255}$. At the subsequent step $S_{256}$, a set document number, an executed document number, a set copy number and an executed copy number stored in a memory which is designated by [CTJBPT] are loaded, respectively, in the set document counter, executed document counter, set copy counter and executed copy counter and displayed, the operation then returning to the main routine.

Figure 27:
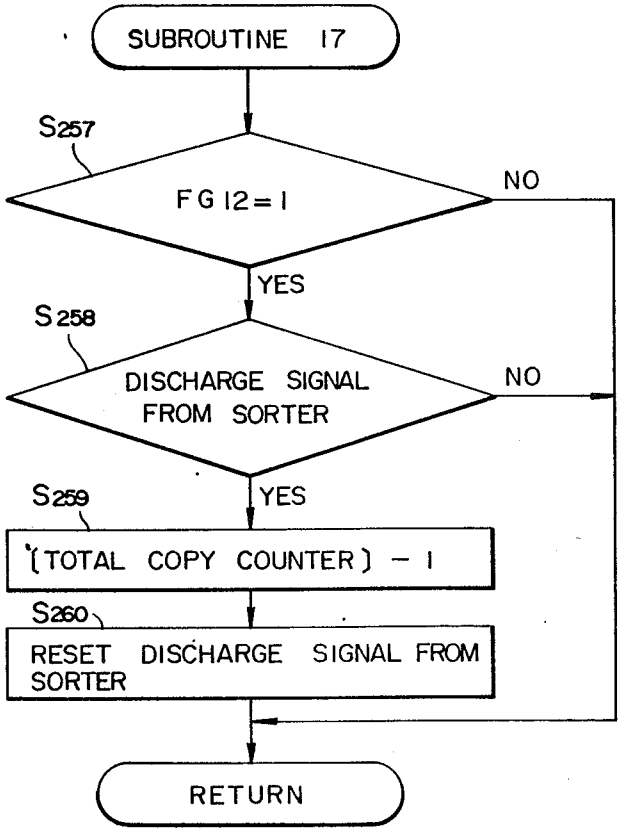

Referring to FIG. 27, the subroutine 17 is shown which is included in the copy control routine of the step $S_8$ and the final processing control routine of the step $S_{12}$ and adapted to decrement the total copy number every time a paper P is distributed to a bin 3*e* of the sorter 3. First, at a step $S_{257}$, whether FG12=ONE is determined. If so, presence/absence of a discharge signal from the sorter 3 is checked at a step $S_{258}$. If not FG12=ONE at the step $S_{257}$ or if a discharge signal from the sorter 3 is absent at the step $S_{258}$, the operation returns to the main routine. If a discharge signal from the sorter 3 is present at the step $S_{258}$, [total copy counter] is decremented by one at a step $S_{259}$. Then, after resetting the discharge signal from the sorter 3, the operation returns to the main routine.

Figure 28:
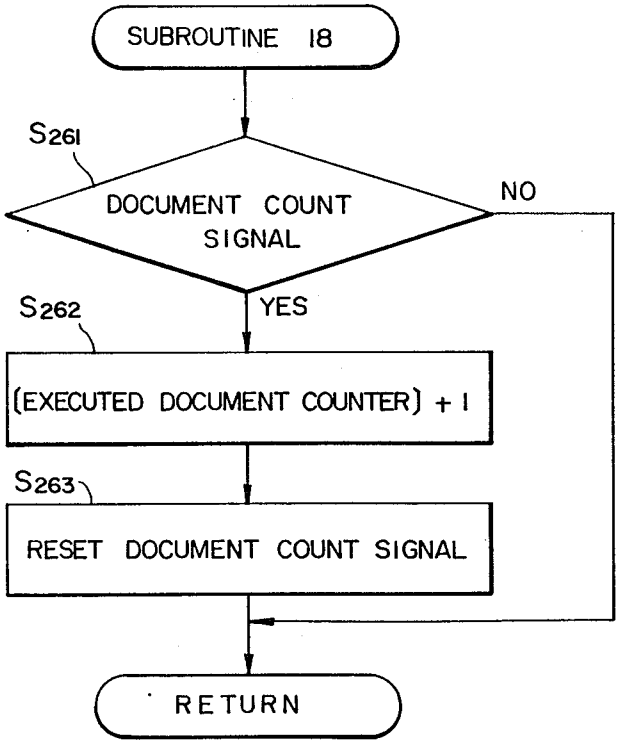

Referring to FIG. 28, the subroutine 18 is shown which is included in the copy start routine of the step $S_6$ and adapted to count executed documents O. The subroutine 18 begins with determining presence/absence of a document count signal at a step $S_{261}$. If the signal is absent, the operation returns to the main routine. If the signal is present, "executed document counter] is incremented by one at a step $S_{262}$, then the signal is reset at a step $S_{263}$, and then the operation returns to the main routine.

Figure 29:
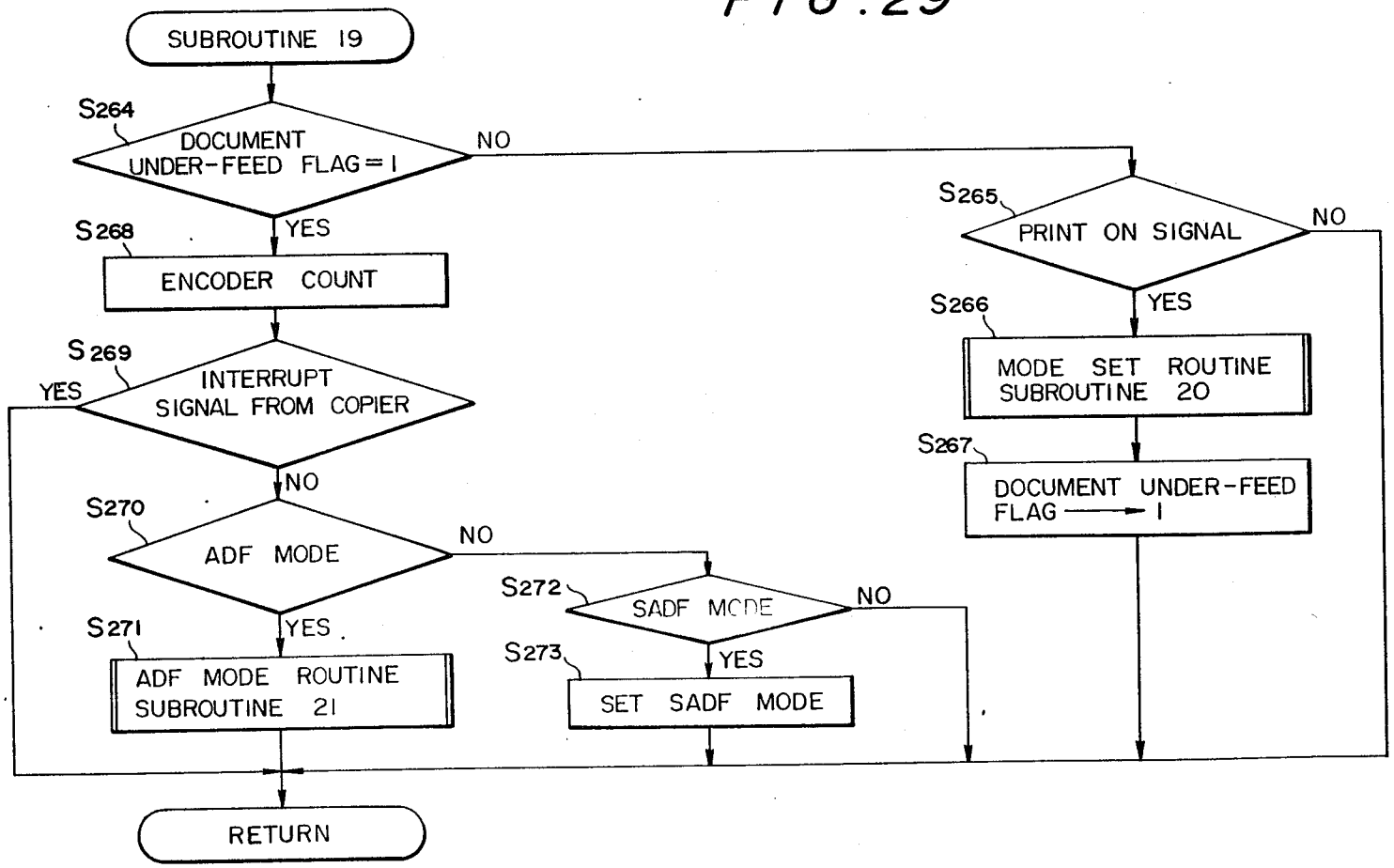

Referring to FIG. 29, the subroutine 19 is shown which is included in the document feed control routine of the steps $S_3$, $S_7$, $S_9$ and $S_{13}$ and adapted to control document feed. First, whether a document under-feed flag AFG13=ONE is checked and, if not, presence/absence of a print ON signal is checked at a step $S_{265}$. If a print ON signal is absent, the operation returns to the main routine. If it is present, the operation advances through a mode set routine at a step $S_{266}$ to a step $S_{267}$ for turning the flag AFG13 to a ONE. The operation then returns to the main routine.

If the flag AFG13=ONE at the step $S_{264}$, output pulses of the encoder 19 are counted at a step $S_{268}$, then presence/absence of an interrupt signal from the copier 1 is checked at a step $S_{269}$ and, if it is present, the operation returns to the main routine. If an interrupt signal from the copier 1 is absent at the step $S_{269}$, whether the mode is an ADF mode is determined. If so, the operation returns to the main routine by way of an ADF mode routine of a step $S_{271}$. If the mode is not an ADF mode as decided at the step $S_{270}$, whether the mode is an SADF mode is determined and, if not, the operation returns to the main routine. If the mode is an SADF mode, an SADF mode is set at a step $S_{273}$ and, then, the operation returns to the main routine.

Figure 30:
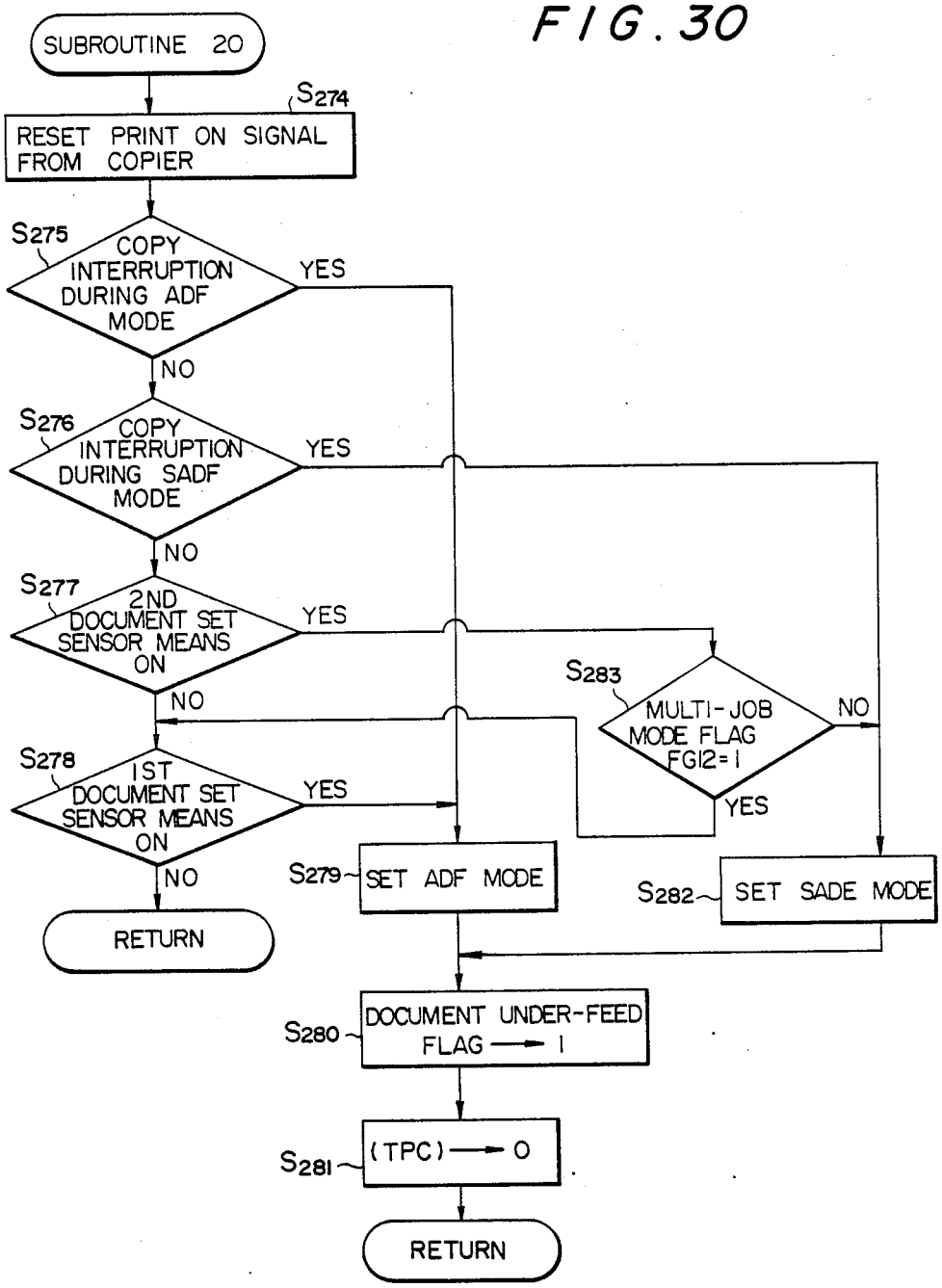

Referring to FIG. 30, the subroutine 20 is shown which is included in the document feed control routine of the steps $S_3$, $S_7$, $S_9$ and $S_{13}$ and adapted to set a document feed mode. First, at a step $S_{274}$, a print ON signal from the copier 1 is reset and, at a step $S_{275}$, whether copy interruption in an ADF mode has occurred is determined. If not, whether copy interruption in an SADF mode has occurred is determined at a step $S_{276}$. If not, whether the second document set sensor means 18 is "on" is checked at a step $S_{277}$. If not, whether the first document set sensor means 24 is "on" is determined at a step $S_{278}$. If not, the operation returns to the main routine.

If copy interruption in an ADF mode has been found at the step $S_{275}$ or if the first document set sensor means 24 has been found "on" at the step $S_{278}$, an ADF mode is set, the document under-feed flag AFG13 is turned to a ONE, and the timing pulse counter TPC associated with the encoder 19 is cleared to zero (steps $S_{279}$–$S_{281}$), the operation then returning to the main routine. If interruption in an SADF mode has been determined at the step $S_{276}$, an SADF mode is set and the operation advances to a step $S_{280}$. If the second document set sensor means 28 has been found "on" at the step $S_{277}$, whether the multi-job mode flag FG=ONE is checked at a step $S_{283}$. If so, whether the first document sensor means 24 is "on" is determined at a step $S_{278}$. If not FG12=ONE as decided at the step $S_{283}$, an SADF mode is set at a step $S_{282}$. It follows that when the second document set sensor means 28 responsive to documents O on the table 20 of the SADF 20' is "on" and the first document set sensor means 24 responsive to documents O on the ADF 2 is "on", an ADF mode is set if the mode is a multi-job mode and an SADF mode is set if it is not a multi-job mode.

Figures 31, 31A, 31B:
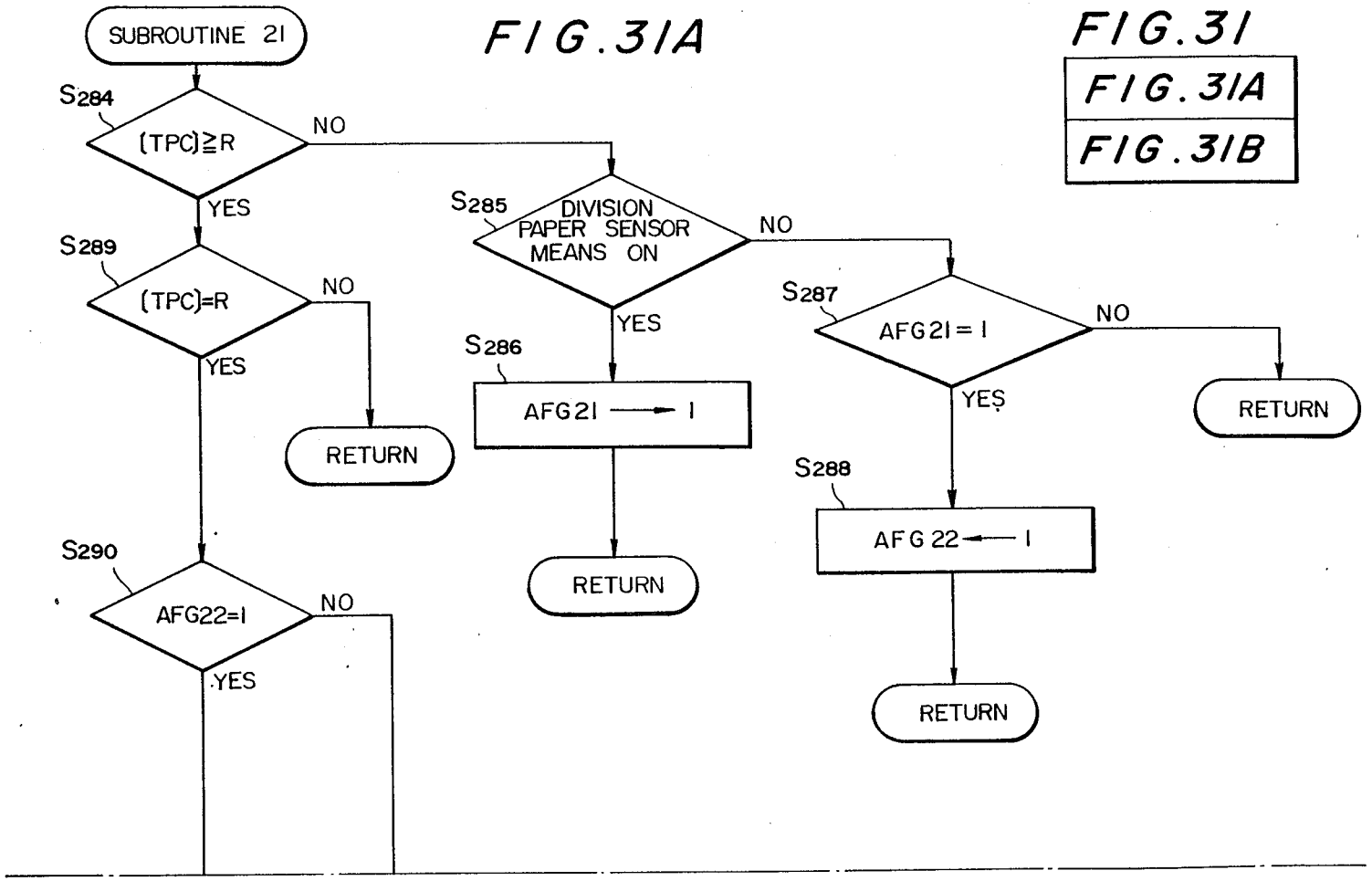
Figure 31B:
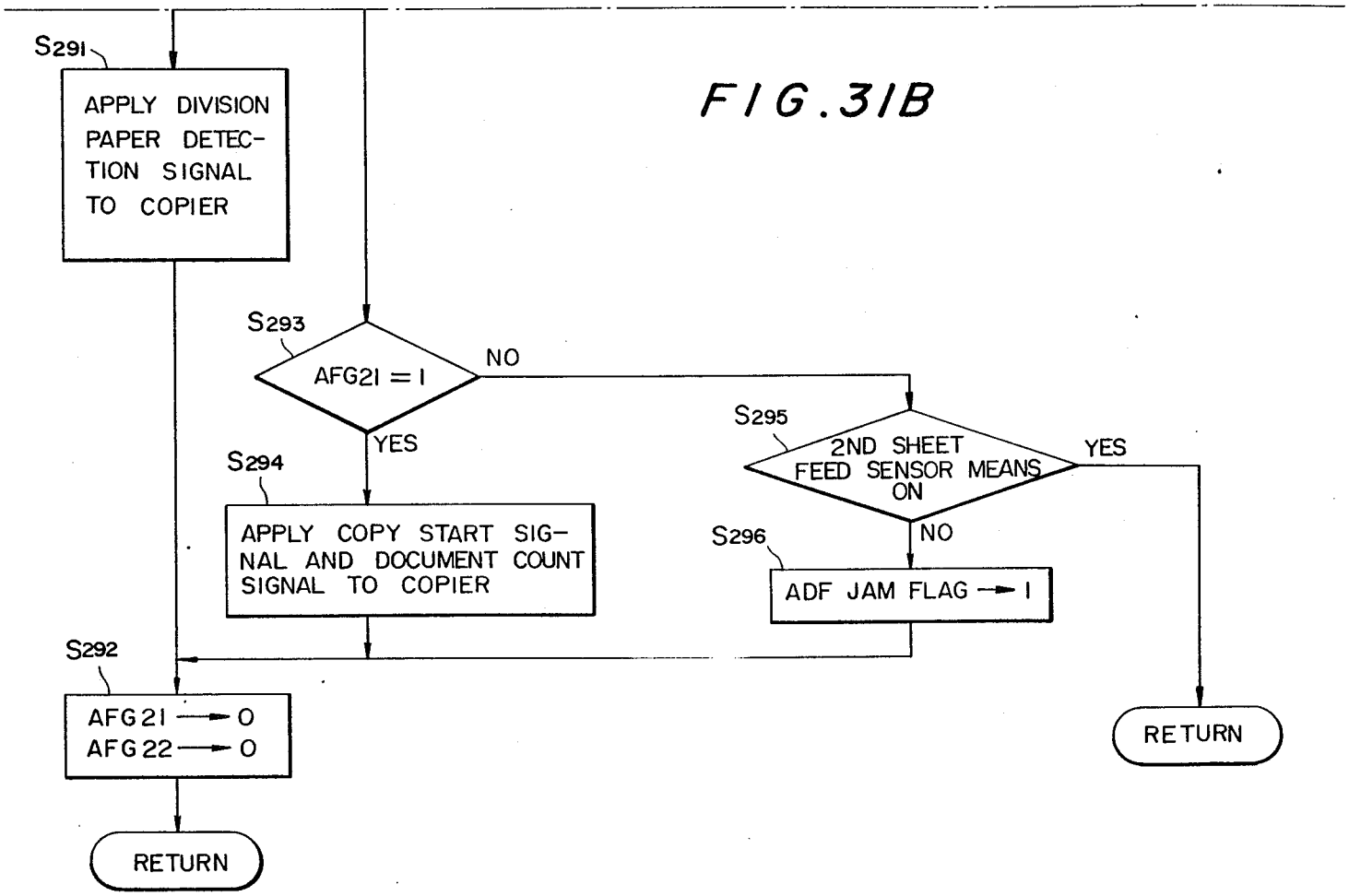

Referring to FIG. 31, the subroutine 21 is shown which is included in the document feed control routine of the steps $S_3$, $S_7$, $S_9$ and $S_{13}$ and adapted to deliver a division paper detection signal and a copy start signal to the copier 1. First, at a step $S_{284}$, whether [TPC]≧R is determined. Here, TPC represents the timing pulse counter for counting output pulses of the encoder 19, while R represents the number of pulses which, in the case where a division paper d is fed by the ADF 2, the encoder 19 generates from the instant when the division paper sensor means 25 senses the first opening d1 of the paper d after the start of feed to the instant when it senses the second opening d1.

If not [TPC]≧R at the step $S_{284}$, whether the sensor means 25 is "on" is determined at a step $S_{285}$. The sensor means 25 becomes "on" when sensed any one of the division papers d and the documents O. When the sensor means 25 becomes "on" at the step $S_{285}$, the flag AFG21 is turned to a ONE at a step $S_{286}$ whereafter the operation returns to the main routine. The flag AFG21 is adapted to sense a division paper d. Then, as the sensor means 25 becomes "off" at the step $S_{285}$, whether AFG21=ONE is checked at a step $S_{287}$. If so, that is, if the sensor means 25 has sensed an opening d1, the flag AFG22 adapted to sense an opening d1 of a division paper d is turned to a ONE and, then, the operation returns to the main routine. If not AFG21=ONE at the step $S_{287}$, showing that the sensor means 25 has not sensed a division paper d or a document O, the operation returns to the main routine.

If [TPC]≧R at the step $S_{284}$, whether [TPC]=R is checked at a step $S_{289}$. If so, whether AFG22=ONE is determined at a step $S_{290}$. If so, that is, if the ADF 2 is feeding a division paper d, a division paper detection signal is applied to the copier 1 at a step $S_{291}$ and, at the subsequent step $S_{292}$, the flags AFG21 and AFG22 are each turned to a ZERO, the operation then returning to the main routine. If not AFG22=ONE as decided at the step $S_{290}$, whether AFG21=ONE is determined at a step $S_{293}$. If so, meaning that the ADF 2 is feeding a document O, a copy start signal and a document count signal are delivered to the copier at a step $S_{294}$ and, then, the operation advances to a step $S_{292}$. If not AFG21=ONE as decided at the step $S_{293}$, whether the second sheet feed sensor means 27 is "on" is determined at a step $S_{295}$. If the sensor means 27 is not "on" as decided at the step $S_{295}$, showing that a division paper d or a document O has jammed, an ADF jam flag is turned to a ONE at a step $S_{296}$ and the operation advances to the step $S_{292}$. If the sensor means 27 is "on" as determined at the step $S_{295}$, the operation returns to the main routine.

Figure 32:
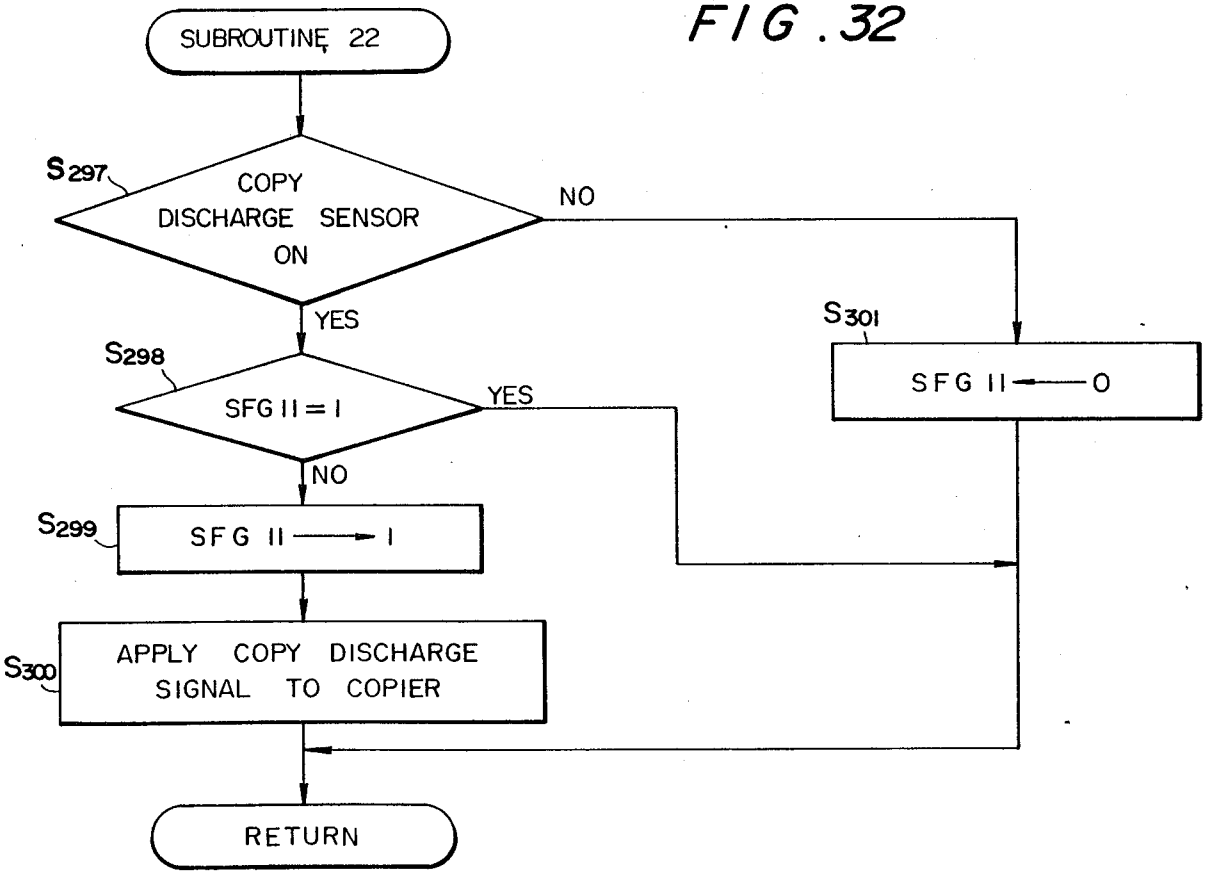

Referring to FIG. 32, the subroutine 22 is shown which is included in the classification control routine of the step $S_{20}$ and adapted to deliver a copy discharge signal to the copier when the copy discharge sensor 37 associated with the sorter 3 has become "on". First, at a step $S_{297}$, whether the copy discharge sensor 37 is "on" is determined. If so, whether the flag SFG11 responsive to an "on" condition of the copy discharge sensor 37 is a ONE is determined at a step $S_{298}$. If not, the flag SFG 11 is turned to a ONE and a copy discharge signal is delivered to the copier 1 (steps $S_{299}$ and $S_{300}$) and the operation returns to the main routine. If the copy discharge sensor 37 is not "on" at the step $S_{297}$, the flag SFG11 is turned to a ZERO at a step $S_{301}$ and the operation returns to the main routine. If SFG11=ONE is decided at the step $S_{298}$, the operation returns to the main routine.

Figure 33:
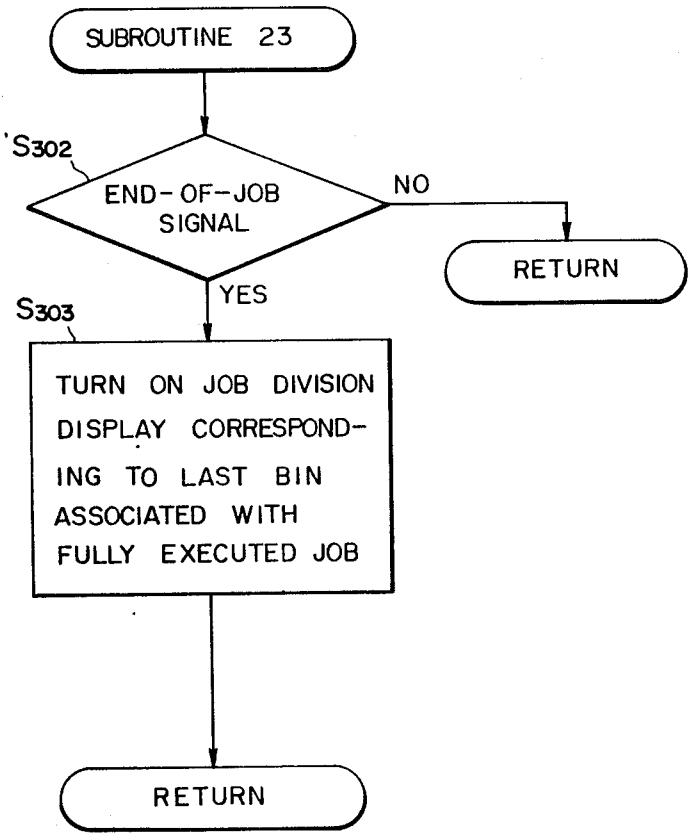

Referring to FIG. 33, the subroutine 23 is shown which is included in the stand-by routine of the step $S_{17}$ and adapted to control the job division display 39 responsive to and end-of-one-job signal from the copier 1. First, at a step $S_{302}$, presence/absence of an end-of-one-job signal is checked. If it is present, a particular job division display 39 corresponding to the last bin 3*e* which is associated with a job executed is turned on at a step $S_{303}$, then the processing returning to the main routine. If an end-of-one-job signal is absent at the step $S_{302}$, the operation returns to the main routine.

Figure 34:
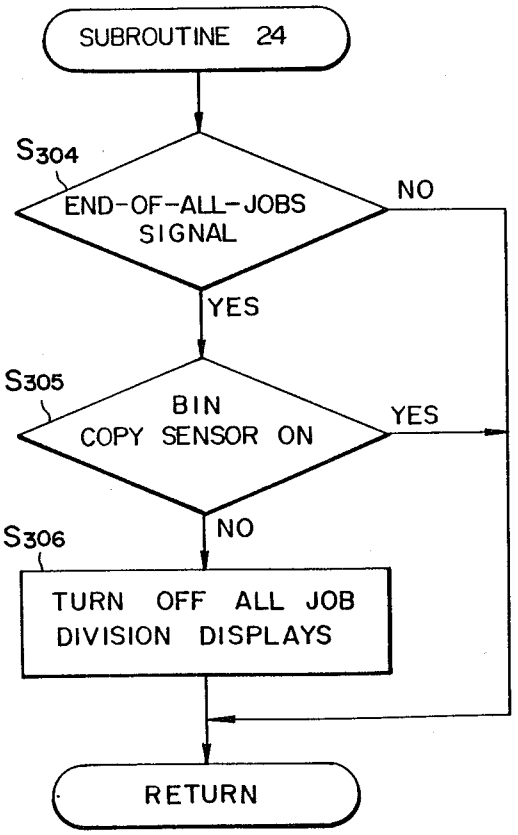

Referring to FIG. 34, the subroutine 24 is shown which is included in the final processing routine of the step $S_{22}$ and adapted to process an end-of-all-jobs signal from the copier 1. First, presence/absence of an end-of-all-jobs signal is checked at a step $S_{304}$. If it is present, whether the bin paper sensor 38 is "on" is determined at a step $S_{305}$. If not, all the job division displays 39 are turned off at a step $S_{306}$ and the operation returns to the main routine. The end-of-all-jobs signal appears when a multi-job mode is cancelled and when the job cancel key 68 is depressed. In this manner, even when a multi-job mode has been cancelled, the job division displays 39 are not turned off immediately but only after papers P have been removed from all the bins 3*e* of the sorter 3, thereby allowing one to see the division between jobs associated with the papers P. If an end-of-all-jobs signal is absent at the step $S_{304}$ or if the bin paper sensor 38 is "off" as decided at the step $S_{305}$, the operation returns to the main routine.

Particular embodiments of the present invention are schematically shown in FIGS. 35A–35I with the various means thereof arranged in differing sequences.

Figure 35A:
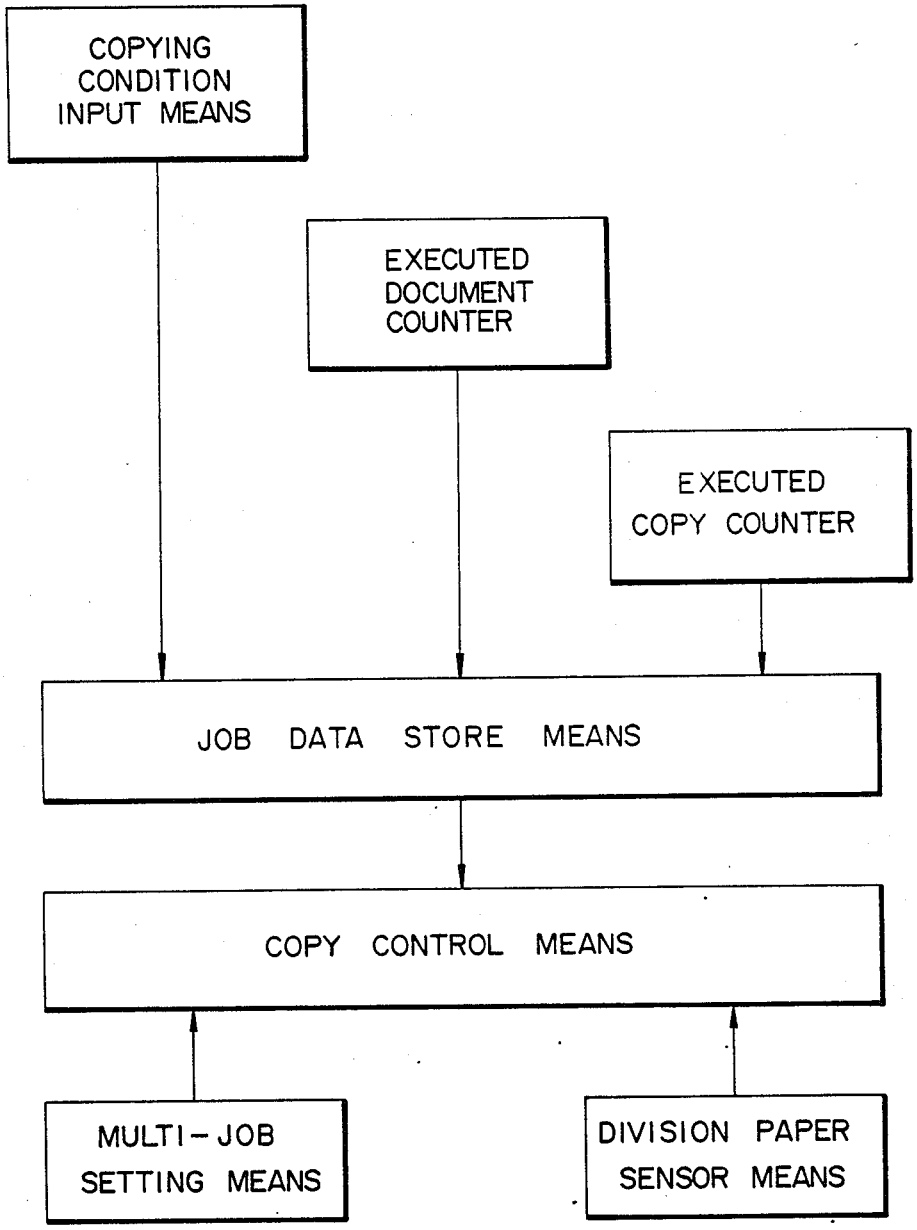
FIGS. 35A-35I are schematic block diagrams showing various embodiments of the present invention.
Figure 35B:
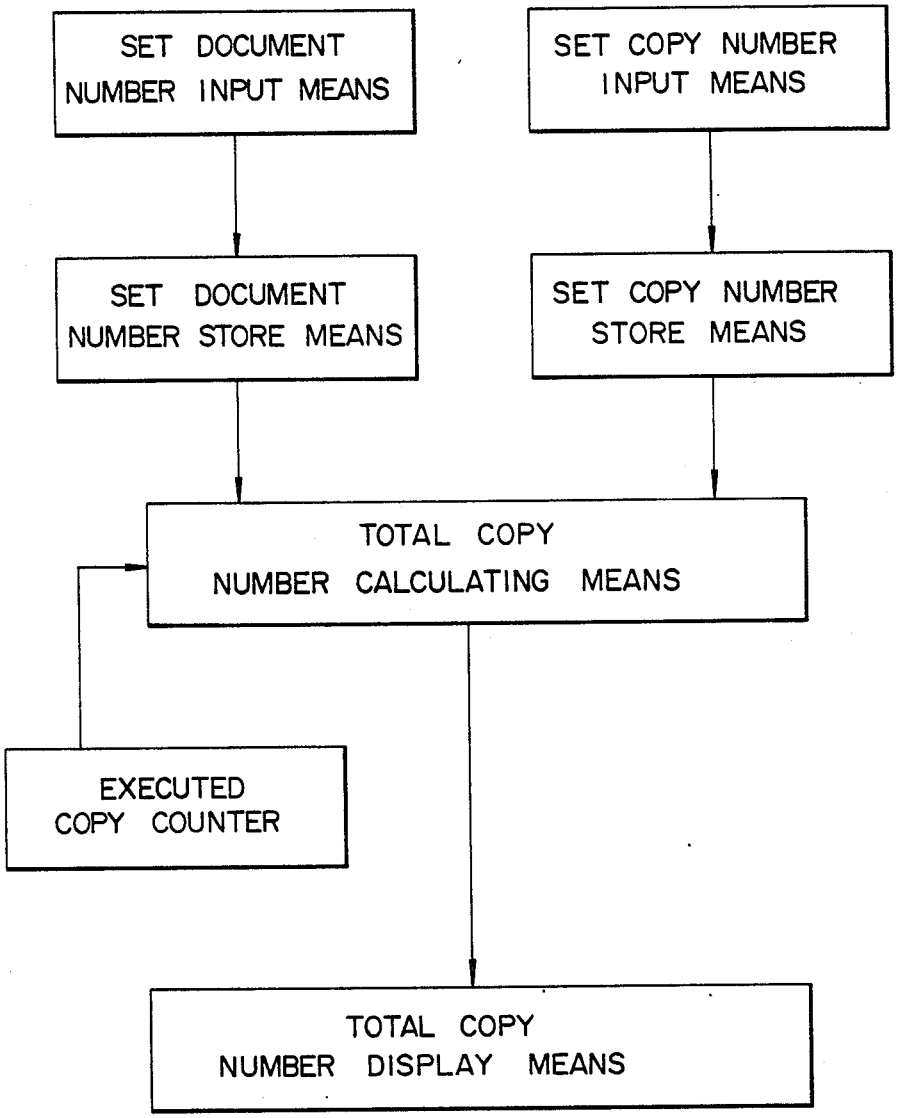
Figure 35C:
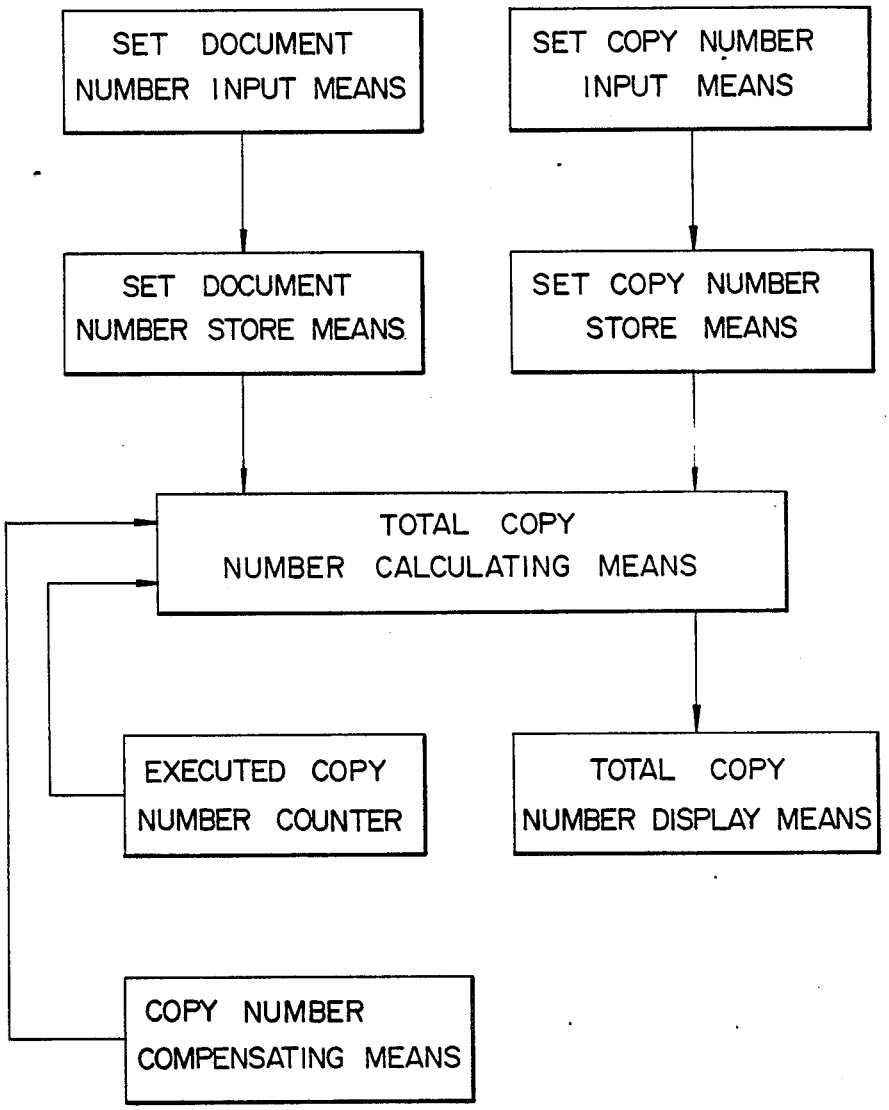
Figure 35D:
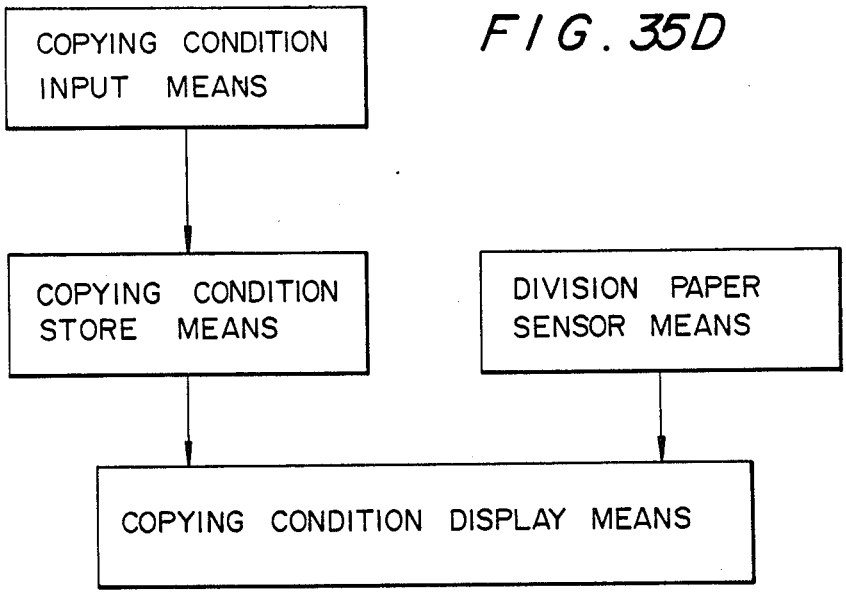
Figure 35E:
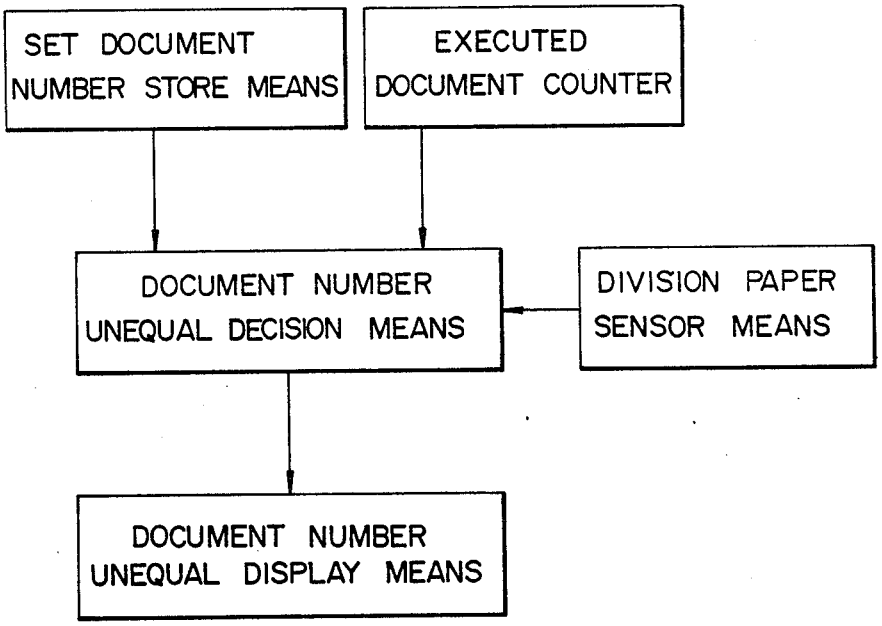
Figure 35F:
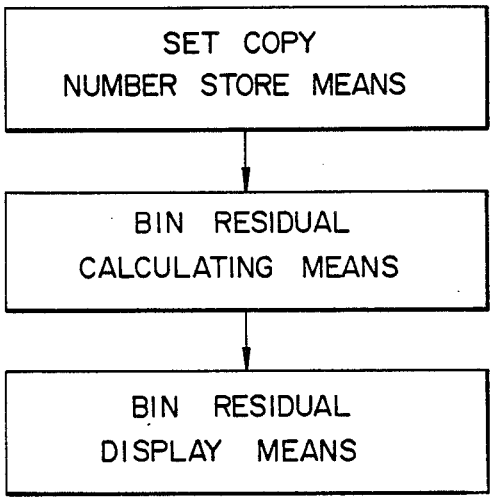
Figure 35G:
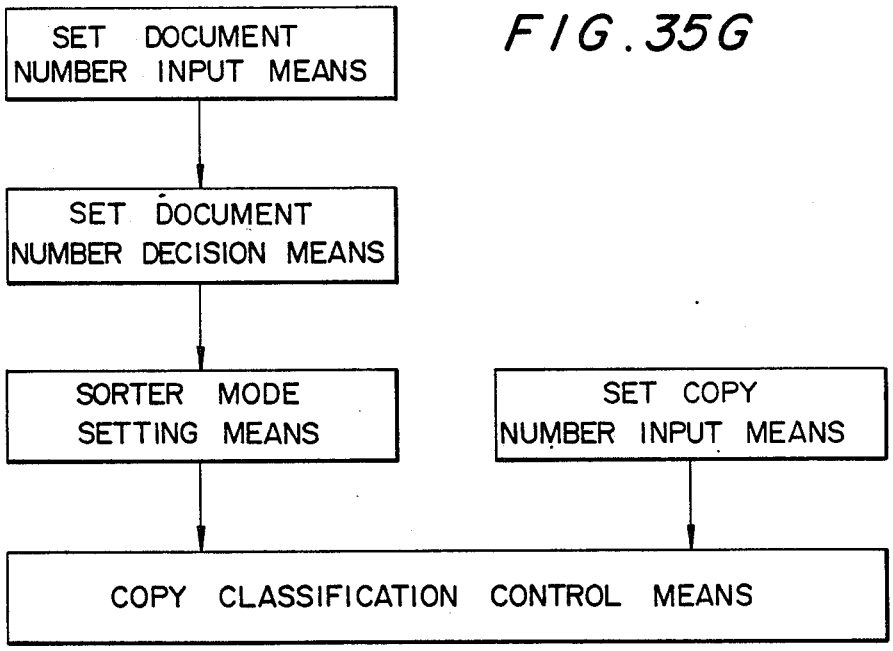
Figure 35H:
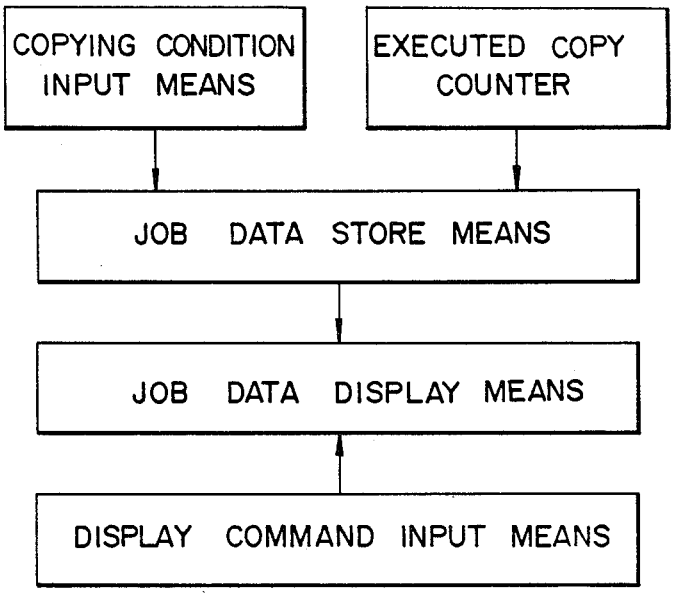
Figure 35I:
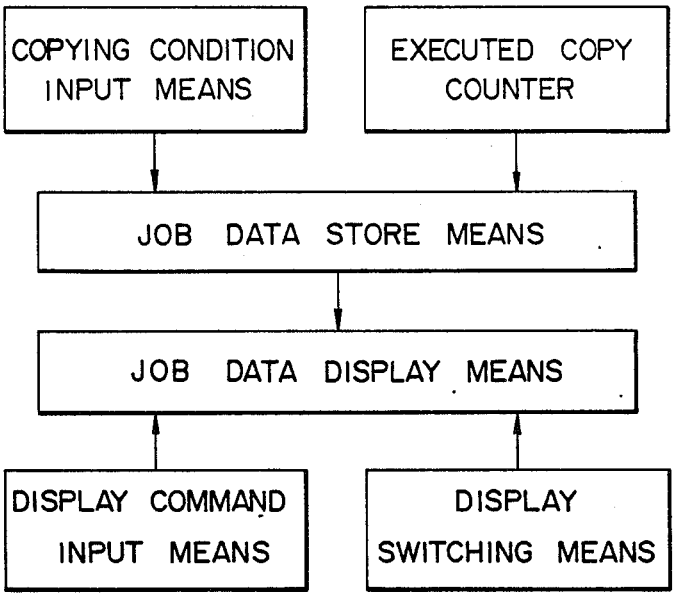

FIG. 35A illustrates an embodiment in accordance with the first aspect of the invention. The embodiment of FIG. 35B corresponds to the second aspect of the present invention. The embodiment of FIG. 35C corresponds to the third aspect of the present invention. The embodiment of FIG. 35D corresponds to the fourth aspect of the present invention. The embodiment of FIG. 35E corresponds to the fifth aspect of the present invention. The embodiment of FIG. 35F corresponds to the sixth aspect of the present invention. The embodiment of FIG. 35G corresponds to the seventh aspect of the present invention. The embodiment of FIG. 35H corresponds to the eighth aspect of the present invention. The embodiment of FIG. 35I corresponds to the ninth aspect of the present invention, the above aspects all being described in the summary of the invention.

While a single sorter 3 has been shown and described as being associated with the copier 1, such is only illustrative and two more more such sorters may be associated with the copier 1. In such a case, at the step $S_{126}$ of the subroutine 7 shown in FIG. 17, N which is the maximum number of bins in the sorter will be varied in accordance with the number of sorters and the number of bins which are built in each sorter.

It will be understood from the foregoing description that the present invention accomplishes various unprecedented advantages as enumerated below.

(1) In an electronic copier equipped with an automatic document feeder and a sorter, a plurality of groups of documents which differ in copying condition from each other can be copied continuously.

(2) A plurality of groups of documents which differ in copying condition from each other can be copied continuously and, in addition, the total number of copies before execution can be calculated and displayed.

(3) In an electronic copier capable of continuously copying a plurality of groups of documents which differ in copying condition, after a certain document group has been copied, copying conditions associated with the next document group to be copied can be displayed.

(4) A plurality of groups of documents which differ in copying condition can be copied continuously and, in addition, whether a set copy number provided by set document number store means which is adapted to store the numbers of documents entered condition by condition is equal to the number of documents actually fed can be decided and a result of the decision can be displayed.

(5) A plurality of groups of documents which differ in copying condition from each other can be copied continuously and, in addition, the residual number of bins available in the sorter can be calculated and displayed.

(6) Either a stack mode or a sort mode can be automatically set up depending upon whether the set number of documents entered is one.

(7) In an electronic copier capable of selectively setting up a multi-job mode for continuously copying a plurality of groups of documents which differ in copying condition, desired job data can be displayed on a single display means and, in response to a copy start signal, job data associated with any document group which is to be copied can be displayed on a single display means.

Various modifications will become possible for those skilled in the art after receiving the teachings of the present disclosure without departing from the scope thereof.

What is claimed is:

1. An electronic copier equipped with an automatic document feeder and a sorter, comprising:

multi-job mode setting means for selectively activating a multi-job mode command in which a plurality of groups of documents which differ in copying conditions from each other are copied without operator intervention;

copying condition inputting means for inputting, before the copying of any document of any group, copying conditions respectively associated with each of the plurality of groups of documents;

an executed document couter for counting documents which have been copied;

an executed copy counter for counting papers, or copies, which are discharged after copying;

job data store means for storing all of the copying conditions entered in advance through the copying condition inputting means, a count of the executed document counter, and a count of the executed copy counter;

division paper sensing means for sensing a division paper which is interposed between the documents whereby to divide the documents by group; and copy control means responsive to the state of the multi-job mode setting means, to job data for all the jobs as stored in the job data store means and to a detection signal applied from the division paper sensing means, said copy control means controlling the copier for copying, without operator intervention, the plurality of groups of documents according to the pre-set copying conditions for each group.

2. An electronic copier equipped with an automatic document feeder and a sorter and capable of selectively operating in a multi-job mode for copying without operator intervention a plurality of groups of documents which differ in copying condition from each other, comprising:

set document number inputting means for inputting, before the copying of any document of any group, numbers of documents in each group in a multi-job mode;

set document number store means for storing all the set document numbers for the respective groups as entered through said set document number inputting means;

set copy number inputting means for inputting, before the copying of any document of any group, numbers of copies of the documents to be provided for each group;

set copy number store means for storing all the set copy numbers for the respective groups entered through said set copy number inputting means;

an executed copy counter for counting papers of each respective group which have been discharged;

total copy number calculating means for calculating a total number of copies of each group which have not been executed based on the set document numbers stored in the set document number store means, set copy numbers stored in the set copy number store means, and executed copy number stored in the executed copy counter; and total copy number display means for displaying a total number of copies not executed, as provided by said total copy number calculating means.

3. An electronic copier equipped with an automatic document feeder and a sorter and capable of selectively operating in a multi-job mode for copying without operator intervention a plurality of groups of documents which differ in copying condition from each other, comprising:

set document number inputting means for inputting, before the copying of any document of any group, numbers of documents in each group in a multi-job mode;

set document number store means for storing all the set document numbers for the respective groups as entered through said set document number inputting means;

set copy number inputting means for inputting, before the copying of any document of any group, numbers of copies of the documents to be provided for each group;

set copy number store means for storing all the set copy numbers for the respective groups entered through said set copy number inputting means;

an executed copy counter for counting papers of each respective group which have been discharged;

total copy number calculating means for calculating a total number of copies which have not been executed based on the set document numbers stored in the set document number store means, set copy numbers stored in the set copy number store means, and executed copy number stored in the executed copy number counter;

copy number compensating means for storing the number of documents not yet executed and the number of copies not yet made upon interruption by an intervening copying operation wherein, after completion of the intervening operation, those documents in a group of the same copying condition and under execution which have not been copied may be fully copied; and total copy number display means for displaying a total number of copies not provided by said total copy number calculating means.

4. An electronic copier equipped with an automatic document feeder and a sorter and capable of copying without operator intervention a plurality of groups of documents which differ in copying condition from each other, comprising:

copying condition inputting means for inputting, before the copying of any document of any group, copying conditions respectively associated with each of the plurality of groups of documents;

copying condition store means for storing all the copying conditions which are entered through said copying condition inputting means;

division paper sensing means for sensing a division paper which is interposed between the documents to divide the documents by group; and copying condition display means responsive to said division paper sensing means for reading from said copying condition store means the copying condition associated with that group of documents which is to be copied next and for displaying said copying condition.

5. An electronic copier equipped with an automatic document feeder and a sorter and capable of copying without operator intervention a plurality of groups of documents which differ in copying condition from each other, comprising:

set document number store means for storing, before the copying of any document of any group, numbers of documents which are to be entered, copying condition by copying condition;

an executed document counter for counting, copying condition by copying condition, the documents which are fed by the automatic document feeder;

division paper sensing means for sensing a division paper which is interposed between the documents to divide the documents by copying condition;

document number equal/unequal decision means responsive to said division paper sensing means for deciding whether a set document number stored in the set document number store means for a given copying condition is equal to an executed document number provided by the executed document counter for the same copying condition; and document number equal/unequal display means for displaying a result of the decision performed by said document number equal/unequal decision means.

6. An electronic copier equipped with an automatic document feeder and a sorter and capable of selectively operating in a multi-job mode for copying without operator intervention a plurality of groups of documents which differ in copying condition from each other, comprising:

set copy numbver store means for receiving and storing a set number of copies to be provided;

residual bin number calculating means for calculating a number of bins in the sorter to be used from a set copy number which is stored in said set copy number store means and subtracting the number of bins to be used from a maximum number of bins of the sorter, thereby calculating a residual number of bins in the sorter; and residual bin number display means for displaying the residual number of bins provided by said residual bin number calculating means.

7. An electronic copier as claimed in claim 6, wherein the set copy number store means stores respective set numbers of copies for each group associated with a multi-job mode, before the copying of any document of any group.

8. An electronic copier equipped with an automatic document feeder and a sorter and capable of selectively operating in a stack mode in which the sorter stacks in one bin a plurality of papers, or copies, obtained from a single document and a sort mode in which a plurality of copies obtained from a single document are sequentially distributed to a plurality of bins one by one, said copier comprising:

set document number inputting means for inputting a number of documents;

set copy number inputting means for inputting a number of copies;

set document number decision means for deciding whether the set number of documents entered through the set document number inputting means is one;

sorter mode setting means for selecting the stack mode when said set document number decision means has decided that the set document number is one and the sort mode when the set document number decision means has decided that the set document number is at least two; and copy paper classification control means for controlling the disposition of copy papers in the sorter based on the set document number entered through the set document number inputting means, set copy number entered through the set copy number inputting means, and mode selected by the sorter mode setting means.

9. An electronic copier equipped with an automatic document feeder and a sorter and capable of selectively operating in a multi-job mode for copying without operator intervention a plurality of groups of documents which differ in copying condition from each other, comprising:

copying condition inputting means for inputting, before the copying of any document of any group, copying conditions respectively associated with each of the plurality of groups of documents;

executed copy counters for counting a number of documents which have been copied and a number of copies which have been made;

job data store means for storing the respective copying conditions entered for each group through the copying condition inputting means and counts of the executed copy counters;

job data display means for selectively displaying the job data for each of the groups which are stored in said job data store means; and display command inputting means for inputting a display command signal for causing the job data for individual groups to be selectively read out of the job data store means and displayed by the job data display means.

10. An electronic copier equipped with an automatic document feeder and a sorter and capable of selectively operating in a multi-job mode for copying without operator intervention a plurality of groups of documents which differ in copying condition from each other, comprising:

copying condition inputting means for inputting, before the copying of any document of any group, copying conditions respectively associated with each of the plurality of groups of documents;

executed copy counters for counting a number of documents which have been copied and a number of copies which have been made;

job data store means for storing the respective copying conditions entered for each group through the copying condition inputting means and counts of the executed copy counters;

job data display means for selectively displaying the job data for each of the groups which are stored in said job data store means;

display command inputting means for inputting a display command signal for causing the job data for individual groups to be selectively read out of the job data store means and displayed by the job data display means; and display switching means for causing the job data display means to display job data associated with a group of documents which are about to be copied in response to a copy start signal.

11. An electronic copier as claimed in claim 8, said copier being capable of operating in a multi-job mode for copying without operator intervention a plurality of groups of documents which differ in copying condition from each other, said set document number inputting means comprising means for inputting the respective number of documents in each group before the copying of any document in any group, said set copy number inputting means comprising means for inputting the respective number of copies to be made for each group before the copying of any document in any group, said sorter mode setting means comprising means for selecting either the stack mode or the sort mode for each group, based upon the operation of the set document number decision means for each group.

* * * * *

UNITED STATES PATENT AND TRADEMARK OFFICE

CERTIFICATE OF CORRECTION

PATENT NO. : 4,693,590

DATED : September 15, 1987

INVENTOR(S) : Shin Umeda

It is certified that error appears in the above-identified patent and that said Letters Patent is hereby corrected as shown below:

On the Title Page:

Number of drawings listed is incorrect.
Should read as follows:

- 11 Claims, 54 Drawing Figures -

Signed and Sealed this

Eighth Day of March, 1988

*Attest:*

DONALD J. QUIGG

*Attesting Officer*

*Commissioner of Patents and Trademarks*